US012557850B2

(12) United States Patent
Worm et al.

(10) Patent No.: US 12,557,850 B2
(45) Date of Patent: Feb. 24, 2026

(54) CONTROL BODY FOR AN ELECTRONIC SMOKING ARTICLE

(71) Applicant: RAI Strategic Holdings, Inc., Winston-Salem, NC (US)

(72) Inventors: Steven L. Worm, Raleigh, NC (US); Michael Ryan Galloway, Winston-Salem, NC (US); Frederic Philippe Ampolini, Winston-Salem, NC (US); Randy Lee McKnight, Lewisville, NC (US); David Glen Christopherson, Raleigh, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 0 days.

(21) Appl. No.: 18/082,940

(22) Filed: Dec. 16, 2022

(65) Prior Publication Data

US 2023/0124339 A1 Apr. 20, 2023

Related U.S. Application Data

(63) Continuation of application No. 16/734,982, filed on Jan. 6, 2020, now Pat. No. 11,659,868, which is a (Continued)

(51) Int. Cl.
*A24F 40/51* (2020.01)
*A24F 40/40* (2020.01)

(Continued)

(52) U.S. Cl.
CPC ..... *A24F 40/51* (2020.01); *A24F 40/40* (2020.01); *A24F 40/50* (2020.01); *A24F 40/60* (2020.01); *A24F 40/10* (2020.01)

(58) Field of Classification Search
None
See application file for complete search history.

(56) References Cited

U.S. PATENT DOCUMENTS 32,013 A 4/1861 Taylor
374,584 A 12/1887 Cook (Continued)

FOREIGN PATENT DOCUMENTS

AU 276250 7/1965
AU 1964039525 A 7/1965

(Continued)

OTHER PUBLICATIONS

Definition of wall, The Britannica Dictionary, 2024, [online] retrieved from the Internet, [retrieved Jan. 4, 2025], <URL:https:// www.britannica.com/dictionary/wall> (Year: 2025).*

(Continued)

*Primary Examiner* — Dennis R Cordray
(74) *Attorney, Agent, or Firm* — Womble Bond Dickinson (US) LLP

(57) ABSTRACT

The present disclosure provides a control body adapted for use in an electronic smoking article. The control body includes a shell and a coupler that is adapted to connect the control body to a cartridge of an electronic smoking article. The coupler further is adapted to communicate a pressure reduction within the coupler to a pressure reduction space in the shell. Also positioned within the shell is an electronic circuit board having a pressure sensor attached thereto. The electronic circuit board can be positioned to be parallel to a central axis of the shell. A first end of the pressure sensor can be isolated within the pressure reduction space, and a second end of the pressure sensor can be in communication with a normal pressure space within the shell. One or more light emitting diodes can be attached to the electronic circuit board. At least a portion of the coupler can be light trans- (Continued)

missive so that light from the LED is visible through the coupler.

18 Claims, 10 Drawing Sheets

Related U.S. Application Data continuation of application No. 15/815,223, filed on Nov. 16, 2017, now Pat. No. 10,524,511, which is a continuation of application No. 14/193,961, filed on Feb. 28, 2014, now Pat. No. 9,839,238.

(51) Int. Cl.

| | |
|---|---|
| ***A24F 40/50*** | (2020.01) |
| ***A24F 40/60*** | (2020.01) |
| *A24F 40/10* | (2020.01) |

(56) References Cited

U.S. PATENT DOCUMENTS

| | | | |
|---|---|---|---|
| 438,310 | A | 10/1890 | Edison |
| 576,653 | A | 2/1897 | Bowlby |
| 595,070 | A | 12/1897 | Oldenbusch |
| 705,919 | A | 7/1902 | Gill |
| 720,007 | A | 2/1903 | Dexter |
| 780,087 | A | 1/1905 | Burt |
| 799,844 | A | 9/1905 | Fuller |
| 968,160 | A | 8/1910 | Johnson |
| 969,076 | A | 8/1910 | Pender |
| 1,016,844 | A | 2/1912 | Moonelis |
| 1,067,531 | A | 7/1913 | MacGregor |
| 1,084,304 | A | 1/1914 | Vaughn |
| 1,147,416 | A | 7/1915 | MacDonald |
| 1,163,183 | A | 12/1915 | Stoll |
| 1,299,162 | A | 4/1919 | Fisher |
| 1,304,075 | A | 5/1919 | Lofgren |
| 1,347,631 | A | 7/1920 | Jean |
| 1,446,087 | A | 2/1923 | Griffin |
| 1,485,260 | A | 2/1924 | Fritz |
| 1,505,748 | A | 8/1924 | Louis |
| 1,514,682 | A | 11/1924 | Wilson |
| 1,517,584 | A | 12/1924 | Reece |
| 1,552,877 | A | 9/1925 | Phillipps et al. |
| 1,632,335 | A | 6/1927 | Hiering |
| 1,654,905 | A | 1/1928 | Voos |
| 1,706,244 | A | 3/1929 | Meyerson |
| 1,771,366 | A | 7/1930 | Wyss et al. |
| 1,775,947 | A | 9/1930 | Robinson |
| 1,845,340 | A | 2/1932 | Ritz |
| 1,879,128 | A | 9/1932 | Despe |
| 1,968,509 | A | 7/1934 | Tiffany |
| 1,972,118 | A | 9/1934 | McDill |
| 1,998,683 | A | 4/1935 | Montgomery |
| 2,031,363 | A | 2/1936 | Elof |
| 2,032,695 | A | 3/1936 | Gimera |
| 2,039,559 | A | 5/1936 | Segal |
| 2,057,353 | A | 10/1936 | Whittemore, Jr. |
| 2,086,192 | A | 7/1937 | Schumaker |
| 2,104,266 | A | 1/1938 | McCormick |
| 2,140,516 | A | 12/1938 | Cowan |
| 2,159,698 | A | 5/1939 | Julius et al. |
| 2,177,636 | A | 10/1939 | Norma et al. |
| 2,195,260 | A | 3/1940 | Rasener |
| 2,231,909 | A | 2/1941 | Hempel |
| 2,327,120 | A | 8/1943 | Mccoon |
| D142,178 | S | 8/1945 | Becwar |
| 2,460,427 | A | 2/1949 | Musselman et al. |
| 2,461,664 | A | 2/1949 | Smith |
| 2,472,282 | A | 6/1949 | Burchett |
| 2,483,304 | A | 9/1949 | Rudolf |
| 2,502,561 | A | 4/1950 | Ludwig |
| 2,545,851 | A | 3/1951 | Kardos |
| 2,765,949 | A | 10/1956 | Swan |
| 2,805,669 | A | 9/1957 | Meriro |
| 2,830,597 | A | 4/1958 | Jakob |
| 2,860,638 | A | 11/1958 | Frank |
| 2,897,958 | A | 8/1959 | Tarleton et al. |
| 2,935,987 | A | 5/1960 | Ackerbauer |
| 2,956,569 | A | 10/1960 | Adams |
| 2,959,664 | A | 11/1960 | Fenn |
| 3,060,429 | A | 10/1962 | Winston |
| D194,088 | S | 11/1962 | Mann |
| 3,085,145 | A | 4/1963 | Wray, Jr. |
| 3,146,937 | A | 9/1964 | Joseph |
| 3,200,819 | A | 8/1965 | Gilbert |
| 3,203,025 | A | 8/1965 | Schreur |
| 3,234,357 | A | 2/1966 | Seuthe |
| 3,258,015 | A | 6/1966 | Ellis et al. |
| 3,271,719 | A | 9/1966 | Ovshinsky |
| 3,281,637 | A | 10/1966 | Hultquist |
| 3,292,634 | A | 12/1966 | Beucler |
| 3,292,635 | A | 12/1966 | Kolodny |
| 3,316,919 | A | 5/1967 | Green et al. |
| D207,887 | S | 6/1967 | Parsisson et al. |
| 3,356,094 | A | 12/1967 | Ellis et al. |
| 3,365,102 | A | 1/1968 | Castleberry |
| 3,373,915 | A | 3/1968 | Anderson et al. |
| 3,385,303 | A | 5/1968 | Hind |
| 3,393,927 | A | 7/1968 | Kelly et al. |
| 3,398,754 | A | 8/1968 | Tughan |
| 3,419,015 | A | 12/1968 | Wochnowski |
| 3,420,360 | A | 1/1969 | Young |
| 3,424,171 | A | 1/1969 | Rooker |
| 3,428,053 | A | 2/1969 | Schoenbaum |
| 3,431,393 | A | 3/1969 | Katsuda |
| 3,443,827 | A | 5/1969 | Acker et al. |
| 3,456,645 | A | 7/1969 | Brock |
| 3,476,118 | A | 11/1969 | Luttich |
| 3,479,561 | A | 11/1969 | Janning |
| 3,486,508 | A | 12/1969 | Sipos |
| 3,502,588 | A | 3/1970 | Winberg |
| 3,516,417 | A | 6/1970 | Moses |
| 3,567,014 | A | 3/1971 | Feigelman |
| 3,614,956 | A | 10/1971 | Thornton |
| 3,651,240 | A | 3/1972 | Kirkpatrick |
| 3,675,661 | A | 7/1972 | Weaver |
| 3,685,521 | A | 8/1972 | Dock |
| 3,685,522 | A | 8/1972 | Kleinhans |
| 3,707,017 | A | 12/1972 | Paquette |
| 3,738,374 | A | 6/1973 | Bennett |
| 3,747,120 | A | 7/1973 | Stemme |
| 3,766,000 | A | 10/1973 | Gibson |
| 3,771,533 | A | 11/1973 | Armstrong et al. |
| 3,779,770 | A | 12/1973 | Alston et al. |
| 3,792,704 | A | 2/1974 | Parker |
| 3,815,597 | A | 6/1974 | Goettelman |
| 3,844,294 | A | 10/1974 | Webster |
| 3,860,012 | A | 1/1975 | Selke |
| 3,861,523 | A | 1/1975 | Fountain et al. |
| 3,878,850 | A | 4/1975 | Gibson et al. |
| 3,891,827 | A | 6/1975 | Wyse |
| 3,903,883 | A | 9/1975 | Pecina et al. |
| 3,927,300 | A | 12/1975 | Wada et al. |
| 3,931,824 | A | 1/1976 | Miano et al. |
| 3,933,643 | A | 1/1976 | Colvin |
| 3,934,117 | A | 1/1976 | Schladitz |
| 3,941,300 | A | 3/1976 | Troth |
| 3,943,941 | A | 3/1976 | Boyd et al. |
| 4,016,878 | A | 4/1977 | Castel et al. |
| 4,019,021 | A | 4/1977 | Schladitz |
| 4,020,853 | A | 5/1977 | Nuttall |
| 4,044,777 | A | 8/1977 | Boyd et al. |
| 4,049,005 | A | 9/1977 | Hernandez et al. |
| 4,054,145 | A | 10/1977 | Berndt et al. |
| 4,056,707 | A | 11/1977 | Farnam |
| 4,066,088 | A | 1/1978 | Ensor |
| 4,079,742 | A | 3/1978 | Rainer et al. |
| 4,083,372 | A | 4/1978 | Boden |
| D250,485 | S | 12/1978 | Cuthbertson |
| 4,131,117 | A | 12/1978 | Kite et al. |
| 4,150,677 | A | 4/1979 | Osborne |
| 4,168,712 | A | 9/1979 | Labbe |

(56) References Cited

U.S. PATENT DOCUMENTS 4,170,262 A 10/1979 Marcus et al.
4,190,046 A 2/1980 Virag
4,195,646 A 4/1980 Kite
D255,548 S 6/1980 Grodin
4,207,457 A 6/1980 Haglund
4,207,976 A 6/1980 Herman
4,215,708 A 8/1980 Bron
4,219,031 A 8/1980 Rainer et al.
4,219,032 A 8/1980 Tabatznik et al.
4,233,993 A 11/1980 Miano et al.
4,259,970 A 4/1981 Green, Jr.
4,270,552 A 6/1981 Jenkins
4,284,089 A 8/1981 Ray
D260,690 S 9/1981 Stutzer
4,286,604 A 9/1981 Ehretsmann et al.
4,303,083 A 12/1981 Burruss, Jr.
4,312,367 A 1/1982 Seeman
4,326,544 A 4/1982 Hardwick et al.
4,340,072 A 7/1982 Bolt et al.
4,341,228 A 7/1982 Keritsis et al.
4,347,855 A 9/1982 Lanzillotti et al.
4,361,374 A 11/1982 Marmillion et al.
4,382,707 A 5/1983 Anderka
4,391,285 A 7/1983 Burnett et al.
D271,255 S 11/1983 Rousseau
4,449,541 A 5/1984 Mays et al.
4,484,376 A 11/1984 Glock et al.
4,492,480 A 1/1985 Wadso et al.
4,494,541 A 1/1985 Archibald
4,506,682 A 3/1985 Muller
4,506,683 A 3/1985 Cantrell et al.
4,510,950 A 4/1985 Keritsis et al.
4,519,319 A 5/1985 Howlett
4,520,938 A 6/1985 Finke
4,531,178 A 7/1985 Uke
D280,494 S 9/1985 Abel
RE32,013 E 10/1985 de la Burde et al.
4,550,967 A 11/1985 Riches et al.
4,577,646 A 3/1986 Ziehn
4,583,559 A 4/1986 Hedge
4,589,428 A 5/1986 Keritsis
4,595,024 A 6/1986 Greene et al.
4,611,608 A 9/1986 Vos et al.
4,625,737 A 12/1986 Keritsis et al.
4,629,665 A 12/1986 Matsuo
4,635,651 A 1/1987 Jacobs
4,637,407 A 1/1987 Bonanno
4,648,393 A 3/1987 Landis et al.
4,674,519 A 6/1987 Keritsis et al.
4,676,237 A 6/1987 Wood
4,682,010 A 7/1987 Drapeau et al.
4,700,727 A 10/1987 Torigian
4,706,692 A 11/1987 Gellatly
4,708,151 A 11/1987 Shelar
4,714,082 A 12/1987 Banerjee et al.
4,735,217 A 4/1988 Gerth et al.
4,756,318 A 7/1988 Clearman et al.
4,765,347 A 8/1988 Sensabaugh, Jr. et al.
4,771,295 A 9/1988 Baker
4,771,795 A 9/1988 White et al.
4,771,796 A 9/1988 Myer
4,776,353 A 10/1988 Lilja et al.
4,793,365 A 12/1988 Sensabaugh, Jr. et al.
4,794,323 A 12/1988 Zhou et al.
4,797,692 A 1/1989 Ims
4,798,310 A 1/1989 Kasai et al.
4,800,903 A 1/1989 Ray et al.
4,807,809 A 2/1989 Pryor et al.
4,813,536 A 3/1989 Willis
4,819,665 A 4/1989 Roberts et al.
4,821,749 A 4/1989 Toft et al.
4,823,817 A 4/1989 Luke
4,830,028 A 5/1989 Lawson et al.
D301,837 S 6/1989 Peterson et al.
4,836,224 A 6/1989 Lawson et al.
4,836,225 A 6/1989 Sudoh
4,846,199 A 7/1989 Rose
4,848,374 A 7/1989 Chard et al.
4,848,376 A 7/1989 Lilja et al.
4,848,563 A 7/1989 Robbins
D302,659 S 8/1989 Peterson et al.
D303,722 S 9/1989 Marlow et al.
4,870,748 A 10/1989 Hensgen et al.
4,874,000 A 10/1989 Tamol et al.
D304,771 S 11/1989 Katayama
4,878,506 A 11/1989 Pinck
4,880,018 A 11/1989 Graves, Jr. et al.
4,887,619 A 12/1989 Burcham, Jr. et al.
4,892,109 A 1/1990 Strubel
4,893,639 A 1/1990 White
4,896,683 A 1/1990 Cohen et al.
4,907,606 A 3/1990 Lilja et al.
4,913,168 A 4/1990 Potter et al.
4,917,119 A 4/1990 Potter et al.
4,917,121 A 4/1990 Riehl et al.
4,917,128 A 4/1990 Clearman et al.
4,920,990 A 5/1990 Lawrence et al.
4,922,901 A 5/1990 Brooks et al.
4,924,883 A 5/1990 Perfetti et al.
4,924,886 A 5/1990 Litzinger
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,941,486 A 7/1990 Dube
4,944,317 A 7/1990 Thal
4,945,448 A 7/1990 Bremenour
D310,171 S 8/1990 Cusenza
4,945,929 A 8/1990 Egilmex
4,945,931 A 8/1990 Gori
4,947,874 A 8/1990 Brooks et al.
4,947,875 A 8/1990 Brooks et al.
D310,349 S 9/1990 Rowen
4,955,397 A 9/1990 Johnson et al.
4,961,438 A 10/1990 Korte
4,962,773 A 10/1990 White et al.
4,966,171 A 10/1990 Serrano et al.
4,968,263 A 11/1990 Silbernagel
4,969,476 A 11/1990 Bale et al.
4,972,854 A 11/1990 Kiernan et al.
4,972,855 A 11/1990 Kuriyama et al.
4,974,609 A 12/1990 Southwick et al.
4,977,908 A 12/1990 Luke
4,981,522 A 1/1991 Nichols et al.
4,984,588 A 1/1991 Steward, Jr.
4,986,286 A 1/1991 Roberts et al.
4,987,906 A 1/1991 Young et al.
D315,032 S 2/1991 Haynes
4,990,939 A 2/1991 Sekiya
4,991,606 A 2/1991 Serrano et al.
4,993,436 A 2/1991 Bloom
4,995,405 A 2/1991 Lettau
5,005,593 A 4/1991 Fagg
5,005,759 A 4/1991 Bouche
5,019,122 A 5/1991 Clearman et al.
5,020,548 A 6/1991 Farrier et al.
5,022,416 A 6/1991 Watson
5,025,814 A 6/1991 Raker
5,027,836 A 7/1991 Shannon et al.
5,027,837 A 7/1991 Clearman et al.
5,031,646 A 7/1991 Lippiello et al.
5,033,483 A 7/1991 Clearman et al.
5,040,551 A 8/1991 Schlatter et al.
5,042,509 A 8/1991 Banerjee et al.
5,042,510 A 8/1991 Curtiss et al.
5,046,514 A 9/1991 Bolt
5,050,621 A 9/1991 Creighton et al.
5,056,537 A 10/1991 Brown et al.
5,060,667 A 10/1991 Strubel
5,060,669 A 10/1991 White et al.
5,060,671 A 10/1991 Counts et al.
5,060,676 A 10/1991 Hearn et al.
5,065,775 A 11/1991 Fagg

(56) References Cited

U.S. PATENT DOCUMENTS 5,065,776 A 11/1991 Lawson et al.
5,072,744 A 12/1991 Luke et al.
5,074,319 A 12/1991 White et al.
5,074,321 A 12/1991 Gentry et al.
5,076,296 A 12/1991 Nystrom et al.
5,076,297 A 12/1991 Farrier et al.
5,092,353 A 3/1992 Montoya et al.
5,093,894 A 3/1992 Deevi et al.
5,095,921 A 3/1992 Losee et al.
5,095,922 A 3/1992 Johnson et al.
5,097,850 A 3/1992 Braunshteyn et al.
5,099,861 A 3/1992 Clearman et al.
5,099,862 A 3/1992 White et al.
5,099,864 A 3/1992 Young et al.
5,101,838 A 4/1992 Schwartz et al.
5,101,839 A 4/1992 Jakob et al.
5,103,842 A 4/1992 Strang et al.
5,105,831 A 4/1992 Banerjee et al.
5,105,835 A 4/1992 Drewett et al.
5,105,836 A 4/1992 Gentry et al.
5,105,837 A 4/1992 Barnes et al.
5,105,838 A 4/1992 White et al.
5,115,820 A 5/1992 Hauser et al.
5,121,757 A 6/1992 White et al.
5,123,530 A 6/1992 Lee
5,124,200 A 6/1992 Mallonee
5,127,511 A 7/1992 Keen, Jr. et al.
5,129,409 A 7/1992 White et al.
5,131,415 A 7/1992 Munoz et al.
5,133,368 A 7/1992 Neumann et al.
5,137,034 A 8/1992 Perfetti et al.
5,141,004 A 8/1992 Porenski
5,143,096 A 9/1992 Steinberg
5,143,097 A 9/1992 Sohn et al.
5,144,962 A 9/1992 Counts et al.
5,146,934 A 9/1992 Deevi et al.
5,148,817 A 9/1992 Houminer et al.
5,148,821 A 9/1992 Best et al.
5,152,456 A 10/1992 Ross et al.
5,159,940 A 11/1992 Hayward et al.
5,159,942 A 11/1992 Brinkley et al.
5,172,707 A 12/1992 Zambelli
5,175,791 A 12/1992 Muderlak et al.
5,177,424 A 1/1993 Connors
5,178,167 A 1/1993 Riggs et al.
5,179,966 A 1/1993 Losee et al.
5,183,062 A 2/1993 Clearman et al.
5,203,355 A 4/1993 Clearman et al.
5,211,684 A 5/1993 Shannon et al.
D336,346 S 6/1993 Miller et al.
5,220,930 A 6/1993 Gentry
5,224,265 A 7/1993 Dux
5,224,498 A 7/1993 Deevi et al.
5,228,460 A 7/1993 Sprinkel et al.
5,230,354 A 7/1993 Smith et al.
5,235,992 A 8/1993 Sensabaugh
5,240,012 A 8/1993 Ehrman et al.
5,240,014 A 8/1993 Deevi et al.
5,240,016 A 8/1993 Nichols et al.
5,243,999 A 9/1993 Smith
5,246,018 A 9/1993 Deevi et al.
5,247,947 A 9/1993 Clearman et al.
5,249,586 A 10/1993 Morgan et al.
5,249,588 A 10/1993 Brown et al.
5,255,674 A 10/1993 Oftedal et al.
5,261,424 A 11/1993 Sprinkel, Jr.
5,266,746 A 11/1993 Nishihara
5,269,237 A 12/1993 Baker et al.
5,269,327 A 12/1993 Counts et al.
5,271,419 A 12/1993 Arzonico et al.
H1271 H 1/1994 Shouse
5,282,798 A 2/1994 Bruse et al.
5,285,798 A 2/1994 Banerjee et al.
5,293,883 A 3/1994 Edwards
5,296,685 A 3/1994 Burstein et al.
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,324,498 A 6/1994 Streusand et al.
5,327,915 A 7/1994 Porenski
5,327,917 A 7/1994 Lekwauwa et al.
5,331,981 A 7/1994 Tamaoki et al.
5,339,838 A 8/1994 Young et al.
5,345,951 A 9/1994 Serrano et al.
5,345,955 A 9/1994 Clearman et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,396,911 A 3/1995 Casey, III et al.
5,408,574 A 4/1995 Deevi et al.
5,415,186 A 5/1995 Casey, III et al.
5,435,325 A 7/1995 Clapp et al.
5,445,169 A 8/1995 Brinkley et al.
5,449,078 A 9/1995 Akers
5,456,269 A 10/1995 Kollasch
5,468,266 A 11/1995 Bensalem et al.
5,468,936 A 11/1995 Deevi et al.
5,472,001 A 12/1995 Nicholson
5,479,948 A 1/1996 Counts et al.
D367,605 S 3/1996 Moore
5,497,791 A 3/1996 Bowen et al.
5,498,850 A 3/1996 Das
5,498,855 A 3/1996 Deevi et al.
5,499,636 A 3/1996 Baggett, Jr. et al.
5,501,237 A 3/1996 Young et al.
D368,552 S 4/1996 Adams
5,505,214 A 4/1996 Collins et al.
5,515,842 A 5/1996 Ramseyer et al.
5,529,078 A 6/1996 Rehder et al.
5,530,225 A 6/1996 Hajaligol
D371,633 S 7/1996 Chenard
5,533,530 A 7/1996 Young et al.
5,545,904 A 8/1996 Orbach
5,551,450 A 9/1996 Hemsley
5,551,451 A 9/1996 Riggs et al.
5,564,442 A 10/1996 MacDonald et al.
5,573,692 A 11/1996 Das et al.
5,579,934 A 12/1996 Buono
5,588,446 A 12/1996 Clearman
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,598,868 A 2/1997 Jakob et al.
5,605,226 A 2/1997 Hernlein
5,611,360 A 3/1997 Tang
5,613,504 A 3/1997 Collins et al.
5,613,505 A 3/1997 Campbell et al.
D379,810 S 6/1997 Giordano et al.
5,641,064 A 6/1997 Goserud
D380,293 S 7/1997 Cudmore
5,646,666 A 7/1997 Cowger
5,649,552 A 7/1997 Cho et al.
5,649,554 A 7/1997 Sprinkel et al.
D382,146 S 8/1997 Sandy
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,687,746 A 11/1997 Rose et al.
5,687,748 A 11/1997 Conrad et al.
5,692,525 A 12/1997 Counts et al.
5,692,526 A 12/1997 Adams et al.
5,703,633 A 12/1997 Gehrer
5,708,258 A 1/1998 Counts et al.
5,711,320 A 1/1998 Martin

(56) References Cited

U.S. PATENT DOCUMENTS

| | | | |
|---|---|---|---|
| 5,715,844 | A | 2/1998 | Young et al. |
| 5,724,998 | A | 3/1998 | Gellatly et al. |
| 5,726,421 | A | 3/1998 | Fleischhauer et al. |
| 5,727,571 | A | 3/1998 | Meiring et al. |
| 5,730,118 | A | 3/1998 | Harmanson |
| 5,730,158 | A | 3/1998 | Collins et al. |
| 5,732,685 | A | 3/1998 | Nakamura |
| 5,743,251 | A | 4/1998 | Howell et al. |
| 5,745,985 | A | 5/1998 | Ghosh |
| 5,746,587 | A | 5/1998 | Racine et al. |
| 5,750,964 | A | 5/1998 | Counts et al. |
| 5,778,899 | A | 7/1998 | Saito et al. |
| D397,504 | S | 8/1998 | Zelenik |
| D398,150 | S | 9/1998 | Vonarburg |
| 5,799,663 | A | 9/1998 | Gross et al. |
| 5,807,509 | A | 9/1998 | Shrier et al. |
| 5,810,164 | A | 9/1998 | Rennecamp |
| 5,816,263 | A | 10/1998 | Counts et al. |
| 5,819,751 | A | 10/1998 | Barnes et al. |
| 5,819,756 | A | 10/1998 | Mielordt |
| 5,829,453 | A | 11/1998 | White et al. |
| 5,845,649 | A | 12/1998 | Saito et al. |
| D405,007 | S | 2/1999 | Naas, Sr. |
| 5,865,185 | A | 2/1999 | Collins et al. |
| 5,865,186 | A | 2/1999 | Volsey, II |
| 5,873,372 | A | 2/1999 | Honeycutt et al. |
| 5,878,752 | A | 3/1999 | Adams et al. |
| 5,880,439 | A | 3/1999 | Deevi et al. |
| 5,881,884 | A | 3/1999 | Podosek |
| 5,894,841 | A | 4/1999 | Voges |
| D411,332 | S | 6/1999 | Zelenik |
| 5,908,032 | A | 6/1999 | Poindexter et al. |
| 5,915,387 | A | 6/1999 | Baggett, Jr. et al. |
| D412,279 | S | 7/1999 | Brice |
| 5,931,828 | A | 8/1999 | Durkee |
| 5,934,289 | A | 8/1999 | Watkins et al. |
| 5,938,018 | A | 8/1999 | Keaveney et al. |
| 5,944,025 | A | 8/1999 | Cook |
| 5,954,979 | A | 9/1999 | Counts et al. |
| D414,893 | S | 10/1999 | Moore |
| 5,967,148 | A | 10/1999 | Harris et al. |
| 5,967,310 | A | 10/1999 | Hill |
| 5,975,415 | A | 11/1999 | Zehnal |
| 5,979,460 | A | 11/1999 | Matsumura |
| 5,979,548 | A | 11/1999 | Rhodes et al. |
| 5,994,025 | A | 11/1999 | Iwasa et al. |
| 5,996,589 | A | 12/1999 | St. Charles |
| 6,024,097 | A | 2/2000 | Von Wielligh |
| 6,026,820 | A | 2/2000 | Baggett, Jr. et al. |
| 6,033,623 | A | 3/2000 | Deevi et al. |
| 6,040,560 | A | 3/2000 | Fleischhauer et al. |
| D422,884 | S | 4/2000 | Lafond |
| 6,053,176 | A | 4/2000 | Adams et al. |
| D424,236 | S | 5/2000 | Reed |
| D424,739 | S | 5/2000 | Ross |
| 6,062,213 | A | 5/2000 | Fuisz |
| 6,089,857 | A | 7/2000 | Matsuura et al. |
| 6,095,152 | A | 8/2000 | Beven et al. |
| 6,095,153 | A | 8/2000 | Kessler et al. |
| 6,102,036 | A | 8/2000 | Slutsky |
| 6,116,247 | A | 9/2000 | Banyasz et al. |
| 6,119,684 | A | 9/2000 | Nohl et al. |
| 6,119,700 | A | 9/2000 | Fleischhauer et al. |
| 6,125,853 | A | 10/2000 | Susa et al. |
| 6,125,855 | A | 10/2000 | Nevett et al. |
| 6,125,866 | A | 10/2000 | Nichols et al. |
| D433,532 | S | 11/2000 | Higgins et al. |
| 6,146,934 | A | 11/2000 | Gardner et al. |
| 6,155,268 | A | 12/2000 | Takeuchi |
| 6,164,287 | A | 12/2000 | White |
| D436,686 | S | 1/2001 | Fujisawa |
| 6,182,670 | B1 | 2/2001 | White |
| 6,196,218 | B1 | 3/2001 | Voges |
| 6,196,219 | B1 | 3/2001 | Hess et al. |
| 6,196,232 | B1 | 3/2001 | Chkadua |
| 6,216,705 | B1 | 4/2001 | Ossepian |
| 6,216,706 | B1 | 4/2001 | Kumar et al. |
| 6,216,707 | B1 | 4/2001 | Pauly |
| 6,217,315 | B1 | 4/2001 | Mifune |
| D442,328 | S | 5/2001 | Barmes |
| 6,232,784 | B1 | 5/2001 | Dulasky |
| 6,234,167 | B1 | 5/2001 | Cox et al. |
| 6,234,169 | B1 | 5/2001 | Bulbrook et al. |
| 6,239,687 | B1 | 5/2001 | Shrier et al. |
| 6,265,789 | B1 | 7/2001 | Honda et al. |
| D446,499 | S | 8/2001 | Andre et al. |
| D447,276 | S | 8/2001 | Gustafson |
| 6,269,966 | B1 | 8/2001 | Pallo et al. |
| 6,285,017 | B1 | 9/2001 | Brickell |
| 6,289,898 | B1 | 9/2001 | Fournier et al. |
| 6,310,752 | B1 | 10/2001 | Shrier et al. |
| D450,313 | S | 11/2001 | Koinuma |
| D450,662 | S | 11/2001 | Kwok |
| 6,311,561 | B1 | 11/2001 | Bang |
| 6,322,268 | B1 | 11/2001 | Kaufmann |
| 6,324,261 | B1 | 11/2001 | Merte |
| 6,349,728 | B1 | 2/2002 | Pham |
| 6,349,729 | B1 | 2/2002 | Meyer et al. |
| D454,079 | S | 3/2002 | Fong |
| 6,357,671 | B1 | 3/2002 | Cewers |
| 6,376,816 | B2 | 4/2002 | Cooper et al. |
| 6,381,739 | B1 | 4/2002 | Breternitz, Jr. et al. |
| 6,386,371 | B1 | 5/2002 | Parsons |
| 6,397,852 | B1 | 6/2002 | McAdam |
| 6,407,371 | B1 | 6/2002 | Toya et al. |
| 6,408,856 | B1 | 6/2002 | McAdam |
| 6,418,938 | B1 | 7/2002 | Fleischhauer et al. |
| 6,431,363 | B1 | 8/2002 | Hackler |
| 6,443,146 | B1 | 9/2002 | Voges |
| 6,446,426 | B1 | 9/2002 | Sweeney et al. |
| 6,446,793 | B1 | 9/2002 | Layshock |
| D465,660 | S | 11/2002 | Doeing |
| 6,476,151 | B1 | 11/2002 | Araki |
| 6,491,233 | B2 | 12/2002 | Nichols |
| 6,501,052 | B2 | 12/2002 | Cox |
| 6,510,982 | B2 | 1/2003 | White et al. |
| 6,516,796 | B1 | 2/2003 | Cox et al. |
| D471,104 | S | 3/2003 | Hunt |
| 6,532,965 | B1 | 3/2003 | Abhulimen et al. |
| 6,533,395 | B2 | 3/2003 | Dante et al. |
| 6,536,442 | B2 | 3/2003 | St. Charles et al. |
| 6,537,186 | B1 | 3/2003 | Veluz |
| 6,542,065 | B2 | 4/2003 | Shrier et al. |
| 6,557,708 | B2 | 5/2003 | Polacco |
| 6,578,584 | B1 | 6/2003 | Beven et al. |
| 6,591,841 | B1 | 7/2003 | White et al. |
| 6,595,362 | B2 | 7/2003 | Penney et al. |
| 6,598,607 | B2 | 7/2003 | Adiga et al. |
| D477,920 | S | 8/2003 | McCarty et al. |
| D478,569 | S | 8/2003 | Hussaini et al. |
| D478,897 | S | 8/2003 | Tsuge |
| 6,601,776 | B1 | 8/2003 | Oljaca et al. |
| 6,603,924 | B2 | 8/2003 | Brown et al. |
| 6,606,998 | B1 | 8/2003 | Gold |
| 6,612,404 | B2 | 9/2003 | Sweet et al. |
| 6,615,840 | B1 | 9/2003 | Fournier et al. |
| 6,620,659 | B2 | 9/2003 | Emma et al. |
| 6,622,867 | B2 | 9/2003 | Menceles |
| 6,637,430 | B1 | 10/2003 | Voges et al. |
| 6,655,379 | B2 | 12/2003 | Clark et al. |
| 6,657,532 | B1 | 12/2003 | Shrier et al. |
| D485,639 | S | 1/2004 | Stronski |
| 6,672,762 | B1 | 1/2004 | Faircloth et al. |
| 6,681,998 | B2 | 1/2004 | Sharpe et al. |
| 6,688,313 | B2 | 2/2004 | Wrenn et al. |
| 6,690,121 | B1 | 2/2004 | Weindorf |
| 6,701,921 | B2 | 3/2004 | Sprinkel, Jr. et al. |
| 6,701,936 | B2 | 3/2004 | Shafer et al. |
| 6,707,274 | B1 | 3/2004 | Karr |
| 6,708,846 | B1 | 3/2004 | Fuchs et al. |
| 6,715,494 | B1 | 4/2004 | McCoy |
| 6,719,443 | B2 | 4/2004 | Gutstein |
| 6,722,756 | B2 | 4/2004 | Choy et al. |
| 6,722,763 | B1 | 4/2004 | Hsu |

(56) References Cited

U.S. PATENT DOCUMENTS

| | | | |
|---|---|---|---|
| 6,726,006 | B1 | 4/2004 | Funderburk et al. |
| 6,730,832 | B1 | 5/2004 | Dominguez et al. |
| 6,739,700 | B2 | 5/2004 | Dante et al. |
| 6,743,030 | B2 | 6/2004 | Lin et al. |
| 6,747,573 | B1 | 6/2004 | Gerlach et al. |
| 6,752,649 | B2 | 6/2004 | Arkin et al. |
| D494,315 | S | 8/2004 | Cartier |
| 6,769,436 | B2 | 8/2004 | Horian |
| 6,772,756 | B2 | 8/2004 | Shayan |
| D495,599 | S | 9/2004 | Biesecker |
| 6,799,572 | B2 | 10/2004 | Nichols et al. |
| 6,799,576 | B2 | 10/2004 | Farr |
| 6,803,545 | B2 | 10/2004 | Blake et al. |
| 6,803,550 | B2 | 10/2004 | Sharpe et al. |
| 6,803,744 | B1 | 10/2004 | Sabo |
| 6,804,458 | B2 | 10/2004 | Sherwood et al. |
| 6,805,545 | B2 | 10/2004 | Slaboden |
| 6,808,407 | B1 | 10/2004 | Cannon |
| 6,810,883 | B2 | 11/2004 | Felter et al. |
| 6,823,873 | B2 | 11/2004 | Nichols et al. |
| D500,301 | S | 12/2004 | Deguchi |
| D500,302 | S | 12/2004 | Deguchi |
| 6,827,573 | B2 | 12/2004 | St. Charles et al. |
| 6,854,461 | B2 | 2/2005 | Nichols et al. |
| 6,854,470 | B1 | 2/2005 | Pu |
| 6,874,507 | B2 | 4/2005 | Farr |
| 6,874,508 | B2 | 4/2005 | Shafer et al. |
| 6,885,814 | B2 | 4/2005 | Saito |
| 6,889,687 | B1 | 5/2005 | Olsson |
| 6,895,974 | B2 | 5/2005 | Peele |
| D505,922 | S | 6/2005 | Mayo et al. |
| D506,447 | S | 6/2005 | Mayo et al. |
| D506,731 | S | 6/2005 | Mayo et al. |
| 6,909,840 | B2 | 6/2005 | Harwig et al. |
| D507,244 | S | 7/2005 | Mayo et al. |
| 6,923,327 | B1 | 8/2005 | Cohen |
| 6,923,890 | B2 | 8/2005 | Ricatto et al. |
| 6,938,986 | B2 | 9/2005 | Macler |
| 6,954,979 | B2 | 10/2005 | Logan |
| 6,976,493 | B2 | 12/2005 | Chapman et al. |
| 6,994,096 | B2 | 2/2006 | Rostami et al. |
| 7,000,775 | B2 | 2/2006 | Gelardi et al. |
| 7,011,096 | B2 | 3/2006 | Li et al. |
| 7,015,796 | B2 | 3/2006 | Snyder |
| 7,017,585 | B2 | 3/2006 | Li et al. |
| 7,025,066 | B2 | 4/2006 | Lawson et al. |
| 7,040,314 | B2 | 5/2006 | Nguyen et al. |
| 7,047,982 | B2 | 5/2006 | Seymour et al. |
| 7,049,926 | B2 | 5/2006 | Shrier et al. |
| D523,171 | S | 6/2006 | Mitten et al. |
| D525,948 | S | 8/2006 | Blair et al. |
| 7,082,825 | B2 | 8/2006 | Aoshima et al. |
| D528,992 | S | 9/2006 | Hobart et al. |
| D529,044 | S | 9/2006 | Andre et al. |
| 7,109,876 | B2 | 9/2006 | Smith et al. |
| D530,340 | S | 10/2006 | Andre et al. |
| D531,190 | S | 10/2006 | Lee et al. |
| 7,117,707 | B2 | 10/2006 | Adams et al. |
| 7,117,867 | B2 | 10/2006 | Cox et al. |
| D532,927 | S | 11/2006 | Sann |
| 7,147,170 | B2 | 12/2006 | Nguyen et al. |
| D534,921 | S | 1/2007 | Andre et al. |
| D535,261 | S | 1/2007 | Daniels |
| D535,308 | S | 1/2007 | Andre et al. |
| 7,159,464 | B2 | 1/2007 | Tohyama et al. |
| 7,163,015 | B2 | 1/2007 | Moffitt |
| 7,173,222 | B2 | 2/2007 | Cox et al. |
| 7,173,322 | B2 | 2/2007 | Sakata et al. |
| 7,185,651 | B2 | 3/2007 | Alston et al. |
| 7,185,659 | B2 | 3/2007 | Sharpe et al. |
| D539,813 | S | 4/2007 | Chen |
| D540,131 | S | 4/2007 | Swann |
| D540,687 | S | 4/2007 | Egawa |
| D540,749 | S | 4/2007 | Kaule |
| 7,214,075 | B2 | 5/2007 | He et al. |
| D544,643 | S | 6/2007 | Lin |
| D545,303 | S | 6/2007 | Chang |
| 7,234,470 | B2 | 6/2007 | Yang |
| 7,234,593 | B2 | 6/2007 | Fath et al. |
| D545,904 | S | 7/2007 | Chen et al. |
| D546,782 | S | 7/2007 | Poulet et al. |
| D547,002 | S | 7/2007 | Lin |
| D551,548 | S | 9/2007 | Didier |
| D551,970 | S | 10/2007 | Didier |
| D553,458 | S | 10/2007 | Hood |
| 7,275,941 | B1 | 10/2007 | Bushby |
| 7,284,424 | B2 | 10/2007 | Kanke |
| D556,154 | S | 11/2007 | Poulet et al. |
| 7,290,549 | B2 | 11/2007 | Banerjee et al. |
| 7,293,565 | B2 | 11/2007 | Griffin et al. |
| D557,209 | S | 12/2007 | Ahlgren et al. |
| D558,060 | S | 12/2007 | Šír |
| D562,151 | S | 2/2008 | Ueda et al. |
| D562,761 | S | 2/2008 | Ueda et al. |
| 7,337,782 | B2 | 3/2008 | Thompson |
| D565,496 | S | 4/2008 | Disla |
| D568,298 | S | 5/2008 | Lundren et al. |
| D569,727 | S | 5/2008 | Moretti |
| 7,367,334 | B2 | 5/2008 | Faison, Jr. et al. |
| 7,374,048 | B2 | 5/2008 | Mazurek |
| D571,202 | S | 6/2008 | Vogt |
| D571,556 | S | 6/2008 | Raile |
| D573,474 | S | 7/2008 | Beam et al. |
| 7,392,809 | B2 | 7/2008 | Larson et al. |
| 7,415,982 | B1 | 8/2008 | Sheridan |
| D576,619 | S | 9/2008 | Udagawa et al. |
| D577,019 | S | 9/2008 | Udagawa et al. |
| D577,150 | S | 9/2008 | Bryman et al. |
| D577,591 | S | 9/2008 | Bouroullec |
| 7,428,905 | B2 | 9/2008 | Mua |
| 7,434,584 | B2 | 10/2008 | Steinberg |
| D580,756 | S | 11/2008 | Seebold |
| 7,445,007 | B2 | 11/2008 | Balch |
| 7,451,877 | B2 | 11/2008 | Koga et al. |
| 7,513,253 | B2 | 4/2009 | Kobayashi et al. |
| 7,647,932 | B2 | 1/2010 | Cantrell et al. |
| 7,690,385 | B2 | 4/2010 | Moffitt |
| 7,692,123 | B2 | 4/2010 | Baba et al. |
| 7,726,320 | B2 | 6/2010 | Robinson et al. |
| 7,775,459 | B2 | 8/2010 | Martens, III et al. |
| 7,810,505 | B2 | 10/2010 | Yang |
| 7,832,410 | B2 | 11/2010 | Hon |
| 7,845,359 | B2 | 12/2010 | Montaser |
| 7,878,209 | B2 | 2/2011 | Newbery et al. |
| 7,896,006 | B2 | 3/2011 | Hamano et al. |
| 7,992,626 | B1 | 8/2011 | Tilton et al. |
| 7,997,280 | B2 | 8/2011 | Rosenthal |
| 8,066,010 | B2 | 11/2011 | Newbery et al. |
| 8,079,371 | B2 | 12/2011 | Robinson et al. |
| 8,127,772 | B2 | 3/2012 | Montaser |
| 8,156,944 | B2 | 4/2012 | Han |
| 8,205,622 | B2 | 6/2012 | Pan |
| 8,314,591 | B2 | 11/2012 | Terry et al. |
| 8,365,742 | B2 | 2/2013 | Hon |
| 8,375,957 | B2 | 2/2013 | Hon |
| 8,393,331 | B2 | 3/2013 | Hon |
| 8,402,976 | B2 | 3/2013 | Fernando et al. |
| 8,499,766 | B1 | 8/2013 | Newton |
| 8,528,569 | B1 | 9/2013 | Newton |
| 8,550,069 | B2 | 10/2013 | Alelov |
| 8,833,364 | B2 | 9/2014 | Buchberger |
| 8,851,068 | B2 | 10/2014 | Cohen et al. |
| 8,899,238 | B2 | 12/2014 | Robinson et al. |
| 8,950,587 | B2 | 2/2015 | Thomson et al. |
| 9,259,035 | B2 | 2/2016 | Terry et al. |
| 9,301,549 | B2 | 4/2016 | Liu |
| 9,427,022 | B2 | 8/2016 | Levin et al. |
| 9,462,832 | B2 | 10/2016 | Lord |
| 9,549,573 | B2 | 1/2017 | Monsees et al. |
| 9,714,878 | B2 | 7/2017 | Powers et al. |
| 9,801,416 | B2 | 10/2017 | Robinson et al. |
| 9,814,268 | B2 | 11/2017 | Robinson et al. |
| 9,839,238 | B2 | 12/2017 | Worm et al. |
| 9,901,123 | B2 | 2/2018 | Robinson et al. |

(56) References Cited

U.S. PATENT DOCUMENTS

| | | | |
|---|---|---|---|
| 9,930,915 | B2 | 4/2018 | Worm et al. |
| 9,980,514 | B2 | 5/2018 | Malamud et al. |
| 9,993,024 | B2 | 6/2018 | Liu |
| 10,231,488 | B2 | 3/2019 | Robinson et al. |
| 10,524,511 | B2 | 1/2020 | Worm et al. |
| 10,543,323 | B2 | 1/2020 | Buchberger |
| 11,758,936 | B2 | 9/2023 | Robinson et al. |
| 11,785,978 | B2 | 10/2023 | Robinson et al. |
| 11,925,202 | B2 | 3/2024 | Robinson et al. |
| 2001/0015209 | A1 | 8/2001 | Zielke |
| 2001/0026788 | A1 | 10/2001 | Piskorz |
| 2001/0032643 | A1 | 10/2001 | Hochrainer et al. |
| 2001/0032795 | A1 | 10/2001 | Weinstein et al. |
| 2001/0036365 | A1 | 11/2001 | Sanda et al. |
| 2001/0052480 | A1 | 12/2001 | Kawaguchi et al. |
| 2002/0029779 | A1 | 3/2002 | Schmidt et al. |
| 2002/0043554 | A1 | 4/2002 | White et al. |
| 2002/0078951 | A1 | 6/2002 | Nichols et al. |
| 2002/0088469 | A1 | 7/2002 | Rennecamp |
| 2002/0142291 | A1 | 10/2002 | Bauer et al. |
| 2002/0146242 | A1 | 10/2002 | Vieira |
| 2002/0175164 | A1 | 11/2002 | Dees et al. |
| 2003/0004426 | A1 | 1/2003 | Melker et al. |
| 2003/0005926 | A1 | 1/2003 | Jones et al. |
| 2003/0011579 | A1 | 1/2003 | Gong |
| 2003/0033055 | A1 | 2/2003 | McRae |
| 2003/0089377 | A1 | 5/2003 | Hajaligol et al. |
| 2003/0106551 | A1 | 6/2003 | Sprinkel, Jr. et al. |
| 2003/0108342 | A1 | 6/2003 | Sherwood |
| 2003/0131859 | A1 | 7/2003 | Li et al. |
| 2003/0149372 | A1 | 8/2003 | Smith et al. |
| 2003/0150451 | A1 | 8/2003 | Shayan |
| 2003/0154991 | A1 | 8/2003 | Fournier et al. |
| 2003/0189826 | A1 | 10/2003 | Yoon |
| 2003/0226837 | A1 | 12/2003 | Blake et al. |
| 2004/0020500 | A1 | 2/2004 | Wrenn et al. |
| 2004/0020508 | A1 | 2/2004 | Earl |
| 2004/0031495 | A1 | 2/2004 | Steinberg |
| 2004/0050382 | A1 | 3/2004 | Goodchild |
| 2004/0099266 | A1 | 5/2004 | Cross et al. |
| 2004/0118401 | A1 | 6/2004 | Smith et al. |
| 2004/0129280 | A1 | 7/2004 | Woodson et al. |
| 2004/0149282 | A1 | 8/2004 | Hickle |
| 2004/0149296 | A1 | 8/2004 | Rostami et al. |
| 2004/0149624 | A1 | 8/2004 | Wischusen et al. |
| 2004/0173224 | A1 | 9/2004 | Burgard et al. |
| 2004/0173229 | A1 | 9/2004 | Crooks et al. |
| 2004/0182403 | A1 | 9/2004 | Andersson et al. |
| 2004/0182404 | A1 | 9/2004 | Poindexter et al. |
| 2004/0191322 | A1 | 9/2004 | Hansson |
| 2004/0198127 | A1 | 10/2004 | Yamamoto et al. |
| 2004/0200488 | A1 | 10/2004 | Felter et al. |
| 2004/0206350 | A1 | 10/2004 | Alston et al. |
| 2004/0221857 | A1 | 11/2004 | Dominguez |
| 2004/0224435 | A1 | 11/2004 | Shibata et al. |
| 2004/0226568 | A1 | 11/2004 | Takeuchi et al. |
| 2004/0226569 | A1 | 11/2004 | Yang et al. |
| 2004/0234916 | A1 | 11/2004 | Hale |
| 2004/0237974 | A1 | 12/2004 | Min |
| 2004/0255965 | A1 | 12/2004 | Perfetti et al. |
| 2004/0261802 | A1 | 12/2004 | Griffin |
| 2005/0005947 | A1 | 1/2005 | Hampl et al. |
| 2005/0016533 | A1 | 1/2005 | Schuler et al. |
| 2005/0016549 | A1 | 1/2005 | Banerjee et al. |
| 2005/0016550 | A1 | 1/2005 | Katase |
| 2005/0029137 | A1 | 2/2005 | Wang |
| 2005/0034723 | A1 | 2/2005 | Bennett et al. |
| 2005/0051453 | A1 | 3/2005 | Schuler et al. |
| 2005/0056280 | A1 | 3/2005 | Alston et al. |
| 2005/0061759 | A1 | 3/2005 | Doucette |
| 2005/0066986 | A1 | 3/2005 | Nestor et al. |
| 2005/0067503 | A1 | 3/2005 | Katase |
| 2005/0069831 | A1 | 3/2005 | St. Charles et al. |
| 2005/0081601 | A1 | 4/2005 | Lawson |
| 2005/0090798 | A1 | 4/2005 | Clark et al. |
| 2005/0115243 | A1 | 6/2005 | Adle |
| 2005/0118545 | A1 | 6/2005 | Wong |
| 2005/0145533 | A1 | 7/2005 | Seligson |
| 2005/0151126 | A1 | 7/2005 | Yamakawa et al. |
| 2005/0161467 | A1 | 7/2005 | Jones |
| 2005/0172976 | A1 | 8/2005 | Newman et al. |
| 2005/0205084 | A1 | 9/2005 | Gupta et al. |
| 2005/0229918 | A1 | 10/2005 | Shim |
| 2005/0236006 | A1 | 10/2005 | Cowan |
| 2005/0244521 | A1 | 11/2005 | Strickland et al. |
| 2005/0268908 | A1 | 12/2005 | Bonney et al. |
| 2005/0268911 | A1 | 12/2005 | Cross et al. |
| 2005/0274390 | A1 | 12/2005 | Banerjee et al. |
| 2006/0016453 | A1 | 1/2006 | Kim |
| 2006/0018840 | A1 | 1/2006 | Lechuga-Ballesteros et al. |
| 2006/0032501 | A1 | 2/2006 | Hale et al. |
| 2006/0047368 | A1 | 3/2006 | Maharajh et al. |
| 2006/0054676 | A1 | 3/2006 | Wischusen |
| 2006/0070633 | A1 | 4/2006 | Rostami et al. |
| 2006/0093977 | A1 | 5/2006 | Pellizzari |
| 2006/0102175 | A1 | 5/2006 | Nelson |
| 2006/0150991 | A1 | 7/2006 | Lee |
| 2006/0162733 | A1 | 7/2006 | McGrath et al. |
| 2006/0185687 | A1 | 8/2006 | Hearn et al. |
| 2006/0191546 | A1 | 8/2006 | Takano et al. |
| 2006/0191548 | A1 | 8/2006 | Strickland et al. |
| 2006/0191594 | A1 | 8/2006 | Py |
| 2006/0196518 | A1 | 9/2006 | Hon |
| 2006/0254948 | A1 | 11/2006 | Herbert et al. |
| 2006/0255105 | A1 | 11/2006 | Sweet |
| 2007/0006889 | A1 | 1/2007 | Kobal et al. |
| 2007/0030306 | A1 | 2/2007 | Okamura |
| 2007/0045288 | A1 | 3/2007 | Nelson |
| 2007/0062548 | A1 | 3/2007 | Horstmann et al. |
| 2007/0062549 | A1 | 3/2007 | Holton et al. |
| 2007/0074734 | A1 | 4/2007 | Braunshteyn et al. |
| 2007/0089757 | A1 | 4/2007 | Bryman |
| 2007/0098148 | A1 | 5/2007 | Sherman |
| 2007/0102013 | A1 | 5/2007 | Adams et al. |
| 2007/0125765 | A1 | 6/2007 | Nelson |
| 2007/0144514 | A1 | 6/2007 | Yeates et al. |
| 2007/0163610 | A1 | 7/2007 | Lindell et al. |
| 2007/0169773 | A1 | 7/2007 | Rock |
| 2007/0191756 | A1 | 8/2007 | Tapper |
| 2007/0215164 | A1 | 9/2007 | Mehio |
| 2007/0215167 | A1 | 9/2007 | Crooks et al. |
| 2007/0215168 | A1 | 9/2007 | Banerjee et al. |
| 2007/0229025 | A1 | 10/2007 | Tsai et al. |
| 2007/0235046 | A1 | 10/2007 | Gedevanishvili |
| 2007/0267031 | A1 | 11/2007 | Hon |
| 2007/0267033 | A1 | 11/2007 | Mishra et al. |
| 2007/0277816 | A1 | 12/2007 | Morrison et al. |
| 2007/0280652 | A1 | 12/2007 | Williams |
| 2007/0283972 | A1 | 12/2007 | Monsees et al. |
| 2007/0295347 | A1 | 12/2007 | Paine et al. |
| 2008/0000763 | A1 | 1/2008 | Cove |
| 2008/0023003 | A1 | 1/2008 | Rosenthal |
| 2008/0029095 | A1 | 2/2008 | Esser |
| 2008/0038363 | A1 | 2/2008 | Zaffaroni et al. |
| 2008/0065176 | A1 | 3/2008 | Zhang et al. |
| 2008/0085103 | A1 | 4/2008 | Beland et al. |
| 2008/0092912 | A1 | 4/2008 | Robinson et al. |
| 2008/0138423 | A1 | 6/2008 | Gonda |
| 2008/0149118 | A1 | 6/2008 | Oglesby et al. |
| 2008/0207276 | A1 | 8/2008 | Burrell |
| 2008/0214103 | A1 | 9/2008 | Nelson et al. |
| 2008/0216828 | A1 | 9/2008 | Wensley et al. |
| 2008/0241255 | A1 | 10/2008 | Rose et al. |
| 2008/0245377 | A1 | 10/2008 | Marshall et al. |
| 2008/0257367 | A1 | 10/2008 | Paterno et al. |
| 2008/0276947 | A1 | 11/2008 | Martzel |
| 2008/0286340 | A1 | 11/2008 | Andersson et al. |
| 2008/0302374 | A1 | 12/2008 | Wengert et al. |
| 2008/0302375 | A1 | 12/2008 | Andersson et al. |
| 2009/0065010 | A1 | 3/2009 | Shands |
| 2009/0095311 | A1 | 4/2009 | Hon |
| 2009/0095312 | A1 | 4/2009 | Herbrich et al. |
| 2009/0126745 | A1 | 5/2009 | Hon |
| 2009/0151717 | A1 | 6/2009 | Bowen et al. |

(56) References Cited

U.S. PATENT DOCUMENTS

| | | | |
|---|---|---|---|
| 2009/0188490 | A1 | 7/2009 | Hon |
| 2009/0230117 | A1 | 9/2009 | Fernando et al. |
| 2009/0260641 | A1 | 10/2009 | Monsees et al. |
| 2009/0260642 | A1 | 10/2009 | Monsees et al. |
| 2009/0272379 | A1 | 11/2009 | Thorens et al. |
| 2009/0283103 | A1 | 11/2009 | Nielsen et al. |
| 2009/0293892 | A1 | 12/2009 | Williams et al. |
| 2009/0320863 | A1 | 12/2009 | Fernando et al. |
| 2009/0320864 | A1 | 12/2009 | Rowley |
| 2009/0324206 | A1 | 12/2009 | Young et al. |
| 2010/0006113 | A1 | 1/2010 | Urtsev et al. |
| 2010/0024834 | A1 | 2/2010 | Oglesby et al. |
| 2010/0028766 | A1 | 2/2010 | Peckerar et al. |
| 2010/0043809 | A1 | 2/2010 | Magnon |
| 2010/0059070 | A1 | 3/2010 | Potter et al. |
| 2010/0059073 | A1 | 3/2010 | Hoffmann et al. |
| 2010/0065075 | A1 | 3/2010 | Banerjee et al. |
| 2010/0083959 | A1 | 4/2010 | Siller |
| 2010/0163063 | A1 | 7/2010 | Fernando et al. |
| 2010/0200006 | A1 | 8/2010 | Robinson et al. |
| 2010/0229881 | A1 | 9/2010 | Hearn |
| 2010/0242974 | A1 | 9/2010 | Pan |
| 2010/0242976 | A1 | 9/2010 | Katayama et al. |
| 2010/0258139 | A1 | 10/2010 | Onishi et al. |
| 2010/0300467 | A1 | 12/2010 | Kuistilla et al. |
| 2010/0307518 | A1 | 12/2010 | Wang |
| 2010/0313901 | A1 | 12/2010 | Fernando et al. |
| 2010/0319686 | A1 | 12/2010 | Schennum |
| 2011/0005535 | A1 | 1/2011 | Xiu |
| 2011/0011286 | A1 | 1/2011 | Strasser |
| 2011/0011396 | A1 | 1/2011 | Fang |
| 2011/0015513 | A1 | 1/2011 | Yanez |
| 2011/0036346 | A1 | 2/2011 | Cohen et al. |
| 2011/0036363 | A1 | 2/2011 | Urtsev et al. |
| 2011/0036365 | A1 | 2/2011 | Chong et al. |
| 2011/0073121 | A1 | 3/2011 | Levin et al. |
| 2011/0088707 | A1 | 4/2011 | Hajaligol |
| 2011/0094523 | A1 | 4/2011 | Thorens et al. |
| 2011/0120480 | A1 | 5/2011 | Gedevanishvili et al. |
| 2011/0120482 | A1 | 5/2011 | Brenneise |
| 2011/0126847 | A1 | 6/2011 | El-Shall et al. |
| 2011/0126848 | A1 | 6/2011 | Zuber et al. |
| 2011/0155153 | A1 | 6/2011 | Thorens et al. |
| 2011/0155718 | A1 | 6/2011 | Greim et al. |
| 2011/0162663 | A1 | 7/2011 | Bryman |
| 2011/0168194 | A1 | 7/2011 | Hon |
| 2011/0180082 | A1 | 7/2011 | Banerjee et al. |
| 2011/0226236 | A1 | 9/2011 | Buchberger |
| 2011/0265806 | A1 | 11/2011 | Alarcon et al. |
| 2011/0290248 | A1 | 12/2011 | Schennum |
| 2011/0290268 | A1 | 12/2011 | Schennum |
| 2011/0309157 | A1 | 12/2011 | Yang et al. |
| 2012/0042885 | A1 | 2/2012 | Stone et al. |
| 2012/0060853 | A1 | 3/2012 | Robinson et al. |
| 2012/0111347 | A1 | 5/2012 | Hon |
| 2012/0132643 | A1 | 5/2012 | Choi et al. |
| 2012/0186594 | A1 | 7/2012 | Liu |
| 2012/0199146 | A1 | 8/2012 | Marangos |
| 2012/0227752 | A1 | 9/2012 | Alelov |
| 2012/0227753 | A1 | 9/2012 | Newton |
| 2012/0231464 | A1 | 9/2012 | Yu et al. |
| 2012/0260927 | A1 | 10/2012 | Liu |
| 2012/0279512 | A1 | 11/2012 | Hon |
| 2012/0318882 | A1 | 12/2012 | Abehasera |
| 2013/0037031 | A1 | 2/2013 | Gredat |
| 2013/0037041 | A1 | 2/2013 | Worm et al. |
| 2013/0042865 | A1 | 2/2013 | Monsees et al. |
| 2013/0056013 | A1 | 3/2013 | Terry et al. |
| 2013/0081625 | A1 | 4/2013 | Rustad et al. |
| 2013/0081642 | A1 | 4/2013 | Safari |
| 2013/0185903 | A1 | 7/2013 | Matsuzawa et al. |
| 2013/0192619 | A1 | 8/2013 | Tucker et al. |
| 2013/0213418 | A1 | 8/2013 | Tucker et al. |
| 2013/0213419 | A1 | 8/2013 | Tucker et al. |
| 2013/0220315 | A1 | 8/2013 | Conley et al. |
| 2013/0228191 | A1 | 9/2013 | Newton |
| 2013/0255702 | A1 | 10/2013 | Griffith, Jr. et al. |
| 2013/0284192 | A1 | 10/2013 | Peleg et al. |
| 2013/0298905 | A1 | 11/2013 | Levin et al. |
| 2013/0306064 | A1 | 11/2013 | Thorens et al. |
| 2013/0306074 | A1 | 11/2013 | Bowditch et al. |
| 2013/0306084 | A1 | 11/2013 | Flick |
| 2013/0312742 | A1 | 11/2013 | Monsees et al. |
| 2013/0312776 | A1 | 11/2013 | Newton |
| 2013/0319431 | A1 | 12/2013 | Cyphert et al. |
| 2013/0319439 | A1 | 12/2013 | Gorelick et al. |
| 2013/0340750 | A1 | 12/2013 | Thorens et al. |
| 2013/0340775 | A1 | 12/2013 | Juster et al. |
| 2014/0000638 | A1 | 1/2014 | Sebastian et al. |
| 2014/0014124 | A1 | 1/2014 | Glasberg et al. |
| 2014/0020696 | A1 | 1/2014 | Liu |
| 2014/0034071 | A1 | 2/2014 | Levitz et al. |
| 2014/0060552 | A1 | 3/2014 | Cohen |
| 2014/0060554 | A1 | 3/2014 | Collett et al. |
| 2014/0060555 | A1 | 3/2014 | Chang et al. |
| 2014/0076310 | A1 | 3/2014 | Newton |
| 2014/0083442 | A1 | 3/2014 | Scatterday |
| 2014/0096781 | A1 | 4/2014 | Sears et al. |
| 2014/0096782 | A1 | 4/2014 | Ampolini et al. |
| 2014/0109921 | A1 | 4/2014 | Chen |
| 2014/0157583 | A1 | 6/2014 | Ward et al. |
| 2014/0209105 | A1 | 7/2014 | Sears et al. |
| 2014/0253144 | A1 | 9/2014 | Novak et al. |
| 2014/0261408 | A1 | 9/2014 | DePiano et al. |
| 2014/0261486 | A1 | 9/2014 | Potter et al. |
| 2014/0261487 | A1 | 9/2014 | Chapman et al. |
| 2014/0261489 | A1 | 9/2014 | Cadieux et al. |
| 2014/0261495 | A1 | 9/2014 | Novak et al. |
| 2014/0270727 | A1 | 9/2014 | Ampolini et al. |
| 2014/0270729 | A1 | 9/2014 | DePiano et al. |
| 2014/0270730 | A1 | 9/2014 | DePiano et al. |
| 2014/0290674 | A1 | 10/2014 | Liu |
| 2014/0305453 | A1 | 10/2014 | Hon |
| 2014/0334804 | A1 | 11/2014 | Choi |
| 2014/0345631 | A1 | 11/2014 | Bowen et al. |
| 2014/0366898 | A1 | 12/2014 | Monsees et al. |
| 2015/0020824 | A1 | 1/2015 | Bowen et al. |
| 2015/0147055 | A1 | 5/2015 | Mino |
| 2015/0201675 | A1 | 7/2015 | Lord |
| 2015/0208729 | A1 | 7/2015 | Monsees et al. |
| 2015/0245659 | A1 | 9/2015 | DePiano et al. |
| 2016/0198767 | A1 | 7/2016 | Verleur |

FOREIGN PATENT DOCUMENTS

| | | | |
|---|---|---|---|
| CA | 2562581 | | 10/2005 |
| CA | 2 641 869 | | 5/2010 |
| CA | 2 752 255 | | 8/2010 |
| CN | 85106876 | A | 9/1986 |
| CN | 1122213 | A | 5/1996 |
| CN | 1135860 | | 11/1996 |
| CN | 2 291 796 | Y | 9/1998 |
| CN | 2293957 | | 10/1998 |
| CN | 2293957 | Y | 10/1998 |
| CN | 1233436 | A | 11/1999 |
| CN | 1333657 | | 1/2002 |
| CN | 1530041 | A | 9/2004 |
| CN | 1541577 | | 11/2004 |
| CN | 1596775 | A | 3/2005 |
| CN | 2719043 | | 8/2005 |
| CN | 1775123 | | 5/2006 |
| CN | 2777995 | | 5/2006 |
| CN | 2819833 | | 9/2006 |
| CN | 2870485 | | 2/2007 |
| CN | 1931040 | | 3/2007 |
| CN | 1931042 | | 3/2007 |
| CN | 200997909 | | 1/2008 |
| CN | 101116542 | | 2/2008 |
| CN | 201018481 | Y | 2/2008 |
| CN | 201018927 | Y | 2/2008 |
| CN | 101176805 | | 5/2008 |
| CN | 201085044 | Y | 7/2008 |
| CN | 201104488 | | 8/2008 |
| CN | 201226774 | | 4/2009 |

(56) References Cited

FOREIGN PATENT DOCUMENTS

| | | | |
|---|---|---|---|
| CN | 201379072 | | 1/2010 |
| CN | 301547686 | S | 5/2011 |
| CN | 201860753 | | 6/2011 |
| CN | 102132957 | A | 7/2011 |
| CN | 201900065 | | 7/2011 |
| CN | 301970169 | S | 6/2012 |
| CN | 202566289 | U | 12/2012 |
| CN | 202774133 | U | 3/2013 |
| CN | 302396126 | S | 4/2013 |
| CN | 103584287 | A | 2/2014 |
| CN | 303103389 | S | 2/2014 |
| CN | 302799554 | S | 4/2014 |
| CN | 302810246 | S | 4/2014 |
| CN | 302884434 | S | 7/2014 |
| CN | 302926289 | S | 8/2014 |
| CN | 302950830 | S | 9/2014 |
| CN | 104095291 | A | 10/2014 |
| CN | 303089422 | S | 1/2015 |
| CN | 303091331 | S | 1/2015 |
| CN | 303103390 | S | 2/2015 |
| CN | 303210086 | S | 5/2015 |
| CN | 303568163 | S | 1/2016 |
| DE | 2653133 | | 5/1978 |
| DE | 2704218 | A1 | 8/1978 |
| DE | 4200639 | A1 | 7/1992 |
| DE | 199410665 | U1 | 12/1994 |
| DE | 19854005 | A1 | 5/2000 |
| DE | 19854008 | | 5/2000 |
| DE | 19854012 | A1 | 5/2000 |
| DE | 19935706 | A1 | 2/2001 |
| DE | 10 2006 004 484 | | 8/2007 |
| DE | 102006041042 | | 3/2008 |
| DE | 20 2009 010 400 | | 11/2009 |
| EM | XHDM079112 | S | 6/2012 |
| EM | 2626416-001 | S | 4/2015 |
| EM | 2626416-002 | S | 4/2015 |
| EP | 0 283 672 | | 9/1988 |
| EP | 0 295 122 | | 12/1988 |
| EP | 0 342 538 | | 11/1989 |
| EP | 0173845 | | 11/1989 |
| EP | 0 358 114 | A2 | 3/1990 |
| EP | 0 430 559 | A2 | 6/1991 |
| EP | 0 430 566 | | 6/1991 |
| EP | 0 501 419 | A1 | 9/1992 |
| EP | 0 503 767 | | 9/1992 |
| EP | 0 532 194 | A1 | 3/1993 |
| EP | 0 535 695 | A2 | 4/1993 |
| EP | 0 283 672 | B1 | 9/1993 |
| EP | 0 762 258 | A2 | 3/1997 |
| EP | 0 845 220 | | 6/1998 |
| EP | 0 706 352 | | 3/2002 |
| EP | 0 845 220 | B1 | 9/2003 |
| EP | 1 154 815 | | 7/2004 |
| EP | 1458388 | A1 | 9/2004 |
| EP | 1 618 803 | | 1/2006 |
| EP | 1942754 | A2 | 7/2008 |
| EP | 1989946 | | 11/2008 |
| EP | 2022349 | | 2/2009 |
| EP | 1 942 754 | | 12/2010 |
| EP | 2 316 286 | | 5/2011 |
| EP | 2319334 | | 5/2011 |
| EP | 2 468 116 | | 6/2012 |
| EP | 3266322 | A1 | 10/2018 |
| EP | 3 669 682 | | 6/2022 |
| ES | 2118034 | A1 | 9/1998 |
| ES | 1070375 | | 8/2009 |
| FR | 2128256 | A1 | 10/1972 |
| GB | 191125575 | A | 3/1912 |
| GB | 588117 | | 5/1947 |
| GB | 755475 | | 8/1956 |
| GB | 1025630 | A | 4/1966 |
| GB | 1065678 | A | 4/1967 |
| GB | 1 431 045 | | 4/1976 |
| GB | 1444461 | | 7/1976 |
| GB | 2 070 409 | | 9/1981 |
| GB | 2469850 | | 11/2010 |
| JP | S54-16614 | B2 | 6/1979 |
| JP | S6437276 | A | 2/1989 |
| JP | H02234905 | A | 9/1990 |
| JP | H05247711 | A | 9/1993 |
| JP | 9075058 | | 3/1997 |
| JP | H09-326299 | | 12/1997 |
| JP | H10501999 | A | 2/1998 |
| JP | 11075807 | | 3/1999 |
| JP | 2949114 | | 9/1999 |
| JP | 2000041654 | A | 2/2000 |
| JP | 2000203639 | A | 7/2000 |
| JP | 2000236865 | A | 9/2000 |
| JP | 2001161819 | A | 6/2001 |
| JP | 2001165437 | A | 6/2001 |
| JP | P2001-291598 | | 10/2001 |
| JP | 2005034021 | A | 2/2005 |
| JP | 2006504430 | A | 2/2006 |
| JP | 2006320285 | A | 11/2006 |
| JP | 2006320286 | A | 11/2006 |
| KR | 10-0193885 | B1 | 6/1999 |
| KR | 2002-0067473 | A | 8/2002 |
| KR | 10-0636287 | | 10/2006 |
| KR | 10-0929382 | | 12/2009 |
| KR | 100933516 | | 12/2009 |
| KR | 200448259 | | 3/2010 |
| KR | 20-20100006995 | | 7/2010 |
| KR | 20110001457 | | 2/2011 |
| KR | 20110004049 | | 4/2011 |
| KR | 200453424 | Y1 | 5/2011 |
| KR | 10-2011-0079584 | | 7/2011 |
| KR | 20-2011-0006928 | U | 7/2011 |
| KR | 10-1069342 | B1 | 10/2011 |
| KR | 10-2012-0080287 | A | 7/2012 |
| KR | 10-2012-0105655 | A | 9/2012 |
| KR | 10-2012-0132004 | A | 12/2012 |
| KR | 10-1241782 | | 3/2013 |
| KR | 20-2013-0003312 | | 6/2013 |
| KR | 2013-0127412 | | 11/2013 |
| WO | WO 1986/02528 | | 5/1986 |
| WO | WO 95/01137 | A1 | 1/1995 |
| WO | WO 95/27412 | | 10/1995 |
| WO | WO 96/32854 | | 10/1996 |
| WO | WO 97/12639 | A1 | 4/1997 |
| WO | WO 1997/48293 | | 12/1997 |
| WO | WO 98/16125 | | 4/1998 |
| WO | WO 98/57556 | | 12/1998 |
| WO | WO 00/05976 | A1 | 2/2000 |
| WO | WO 00/28842 | | 5/2000 |
| WO | WO 00/28843 | A1 | 5/2000 |
| WO | WO 00/28844 | | 5/2000 |
| WO | WO 00/50111 | A1 | 8/2000 |
| WO | WO 01/02040 | A1 | 1/2001 |
| WO | WO 02/37990 | | 5/2002 |
| WO | WO 03/000327 | A1 | 1/2003 |
| WO | WO 03/055486 | A1 | 7/2003 |
| WO | WO 03/056948 | A1 | 7/2003 |
| WO | WO 03/082031 | A1 | 10/2003 |
| WO | WO 03/094900 | A1 | 11/2003 |
| WO | WO 03/101454 | A1 | 12/2003 |
| WO | WO 03/103387 | A2 | 12/2003 |
| WO | WO 2004/095955 | A1 | 3/2004 |
| WO | WO 2004/043175 | | 5/2004 |
| WO | WO 2004/064548 | A1 | 8/2004 |
| WO | WO 2004/080216 | A1 | 9/2004 |
| WO | WO 2004/098324 | | 11/2004 |
| WO | WO 2005/020726 | A1 | 3/2005 |
| WO | WO 2005/099494 | A1 | 3/2005 |
| WO | WO 2005/032285 | | 4/2005 |
| WO | WO 2005/039326 | | 5/2005 |
| WO | WO 2005/060366 | A2 | 7/2005 |
| WO | WO 2006/015070 | A1 | 2/2006 |
| WO | WO 2006/021153 | A1 | 3/2006 |
| WO | WO 2006/082571 | | 8/2006 |
| WO | WO 2006/098936 | | 9/2006 |
| WO | WO 2007/015735 | | 2/2007 |
| WO | WO 2007/026131 | A1 | 3/2007 |
| WO | WO 2007/042941 | | 4/2007 |
| WO | WO 2007/066374 | A1 | 6/2007 |

(56) References Cited

FOREIGN PATENT DOCUMENTS

| | | | |
|---|---|---|---|
| WO | WO 2007/077167 | | 7/2007 |
| WO | WO 2007/078273 | | 7/2007 |
| WO | WO 2007/095109 | A2 | 8/2007 |
| WO | WO 2007/117675 | A2 | 10/2007 |
| WO | WO 2007/131449 | | 11/2007 |
| WO | WO 2007/131450 | A1 | 11/2007 |
| WO | WO 2007/141520 | A1 | 12/2007 |
| WO | WO 2008/077271 | A1 | 7/2008 |
| WO | WO 2008/108889 | A1 | 9/2008 |
| WO | WO 2008/139411 | | 11/2008 |
| WO | WO 2008/151777 | A2 | 12/2008 |
| WO | WO 2009/105919 | | 9/2009 |
| WO | WO 2009/155734 | | 12/2009 |
| WO | WO 2010/003480 | | 1/2010 |
| WO | WO 2010/045670 | | 4/2010 |
| WO | WO 2010/073122 | | 7/2010 |
| WO | WO 2010/091593 | | 8/2010 |
| WO | WO 2010/118644 | | 10/2010 |
| WO | WO 2010/140937 | | 12/2010 |
| WO | WO 2011/010334 | | 1/2011 |
| WO | WO 2011/050964 | | 5/2011 |
| WO | WO 2010/073122 | B2 | 7/2011 |
| WO | WO 2011/081558 | | 7/2011 |
| WO | WO 2011/147699 | | 12/2011 |
| WO | WO 2012/062600 | | 5/2012 |
| WO | WO 2012/072762 | | 6/2012 |
| WO | WO 2012/142293 | | 10/2012 |
| WO | WO 2012/174677 | | 12/2012 |
| WO | WO 2013/025921 | | 2/2013 |
| WO | WO 2013/089551 | | 6/2013 |
| WO | WO 2013/098396 | | 7/2013 |
| WO | WO 2013/098405 | | 7/2013 |
| WO | WO 2013/102611 | | 7/2013 |
| WO | WO 2013/147492 | | 10/2013 |
| WO | WO 2014/012906 | | 1/2014 |
| WO | WO 2014/012907 | | 1/2014 |
| WO | 2015/130598 | | 9/2015 |

OTHER PUBLICATIONS

"How the eCigarette Works," Screenshots YouTube Video by esmokeinpeace, https://www.youtube.com/watch?v=eqz6TvAKcBQ, Mar. 1, 2009 "E10".

"How the eCigarette Works," Wayback Machine Screenshots YouTube Video by esmokeinpeace, https://web.archive.org/web/20140227122005/https:/www.youtube.com/watch?v=eqz6TvAKcBQ, Mar. 1, 2009 "E10'".

"How to Use an Electronic Cigarette," Screenshots YouTube Video by Vapin Lizards, https://www.youtube.com/watch?v=xPJxBRxLIfs, Nov. 15, 2013 "E15".

Annex to Notice of Opposition filed in corresponding European Patent Application No. 20156199.0, Patent No. 3669682, dated Mar. 3, 2023, "Feature Analysis of Claim 1".

Notice of Opposition filed in corresponding European Patent Application No. 20156199.0, Patent No. 3669682, dated Mar. 3, 2023.

Notice of Opposition filed in corresponding European Patent Application No. 20156199.0, Patent No. 3669682, dated Mar. 8, 2023. (37 pgs).

Vape Ranks, "E-Cigarette Inventor Complains about Lack of Financial Rewards," Posted Oct. 14, 2013, Retrieved Feb. 20, 2023, "Hon Lik Article".

Notice of Opposition filed in corresponding European Patent Application No. 20156199.0, Patent No. 3669682, dated Mar. 8, 2023. (47 pgs).

Letter Accompanying Notice of Opposition filed in corresponding European Patent Application No. 20156199.0, Patent No. 3669682, dated Feb. 20, 2023.

"(±)-1,2-propanediol," ChemSpider, [online], 2019, retrieved from the Internet, [retrieved Jan. 16, 2019], <URL: http://www.chemspider.com/Chemical-Structure.13835224.html?rid=ae1c106a-376d-4104-9a7c-f0910a5b5b20&page_num=0>. (Year: 2019).

"(±)-nicotine," ChemSpider, [online], 2019, retrieved from the Internet, [retrieved Jan. 16, 2019], <URL: http://www.chemspider.com/Chemical-Structure.917.html>. (Year: 2019).

"Coresta Recommended Method No. 76; Determination of Moisture Content (Oven Volatiles) of Tobacco and Tobacco Products" CRM 76, Jul. 2017.

Aug. 13, 2020—717260—Respondents' notice of prior art (Public).

Dec. 18, 2020—728462—Respondents' pre-hearing brief, Part 1 of 2 (Public).

Dec. 18, 2020—728462—Respondents' pre-hearing brief, Part 2 of 2 (Public).

Dec. 18, 2020—728487—Complainants' Pre-Hearing Trial Brief, Part 1 of 8 (Public).

Dec. 18, 2020—728487—Complainants' Pre-Hearing Trial Brief, Part 2 of 8 (Public).

Dec. 18, 2020—728487—Complainants' Pre-Hearing Trial Brief, Part 3 of 8 (Public).

Dec. 18, 2020—728487—Complainants' Pre-Hearing Trial Brief, Part 4 of 8 (Public).

Dec. 18, 2020—728487—Complainants' Pre-Hearing Trial Brief, Part 5 of 8 (Public).

Dec. 18, 2020—728487—Complainants' Pre-Hearing Trial Brief, Part 6 of 8 (Public).

Dec. 18, 2020—728487—Complainants' Pre-Hearing Trial Brief, Part 7 of 8 (Public).

Dec. 18, 2020—728487—Complainants' Pre-Hearing Trial Brief, Part 8 of 8 (Public).

Jan. 19, 2021—731208—Staff's pre-hearing brief Part 1 of 2 (Public).

Jan. 19, 2021—731208—Staff's pre-hearing brief Part 2 of 2 (Public).

Feb. 22, 2021—734799—Respondents Post-Hearing Initial Brief (Public).

A Presentation of CORESTA, updated Sep. 2019, pp. 1-7.

Amended Complaint for Patent Infringement, *RAI Strategic Holdings, Inc.* v. *Altria Client Services LLC*, No. 1:20-cv-00393-LO-TCB, filed Jul. 13, 2020: Exhibit 2007 *Philip Morris Products, S.A.* v. *RAI Strategic Holdings, Inc.* IPR2020-00921.

American Heritage College Dictionary (4th ed. 2010), p. 386.

Andrus et al., "Nicotine Microaerosol Inhaler", Can Respir Journal, vol. 6, No. 6, 1999, pp. 509-512.

Author Unknown, "Beta Patent Review Meeting," 1995, p. 6.

Author Unknown, "Cigarette Brainstorming Team No. 2," May 1994.

Author Unknown, "Heater Development," Mar. 1994.

Author Unknown, "Philip Morris Patent Database Search Invention Disclosures Dating From About 800000 to Present for which Patent Applications Were Not Filed," 1996, p. 65.

Author Unknown, "Project Beta Core Teams—Ashland," May 1994.

Barbara Demick, *A High-Tech Approach to Getting a Nicotine Fix*. L.A. Times (Apr. 25, 2009).

Barney J. Feder, Reynolds Expands Test of Smokeless Cigarette, N.Y. Times, Apr. 30, 1996, at D10.

Beta Patent review meeting, p. 6, 1995.

Bourlas, M.C., et al., "The Generation of Water in the Tobacco Oven Volatile Test", 1980, *Beitraege zur Tabakforschung International*, vol. 10(3), pp. 149-154.

Cambridge Dictionary of American English (2nd ed. 2008), p. 715.

Chambers Dictionary of Science and Technology (Peter M.B. Walker, ed., 1999), pp. 261, 975.

Chemical and Biological Studies on New Cigarette Prototypes that Heat Instead of Burn Tobacco, R. J. Reynolds Tobacco Company Monograph, 1988, pp. 43-72.

*Chemical and Biological Studies on New Cigarette Prototypes that Heat Instead of Burn Tobacco*, R.J. Reynolds Tobacco Company Monograph (1988) ("RJR monograph") (excerpts).

Civil docket report for *RAI Strategic Holdings, Inc.* v. *Altria Client Services LLC*, No. 1:20-cv-00393-LO-TCB (E.D. Va. filed Apr. 9, 2020).

Civil Minutes, *Ancora Technologies, Inc.* v. *TCT Mobile (US), Inc., et al.*, No. SACV 19-2192-GW-ADSx (C.D. Cal. Nov. 12, 2020).

(56) References Cited

OTHER PUBLICATIONS

Claim Construction Order, *RAI Strategic Holdings, Inc.* v. *Altria Client Services LLC*, No. 1:20-cv-00393-LO-TCB (E.D. Va. Nov. 24, 2020), ECF No. 360.
Commission Investigative Staff's Opening Claim Construction Brief in *Certain Tobacco Heating Articles and Components Thereof*, No. 337-TA-1199 (U.S.I.T.C. Aug. 21, 2020).
Commission Investigative Staff's Responsive Claim Construction Brief in *Certain Tobacco Heating Articles and Components Thereof*, No. 337-TA-1199 (U.S.I.T.C. Sept. 4, 2020).
Communication of Further Notices of Opposition filed in corresponding European Application No. 19151511.3, Patent No. 3491944, mailed Mar. 16, 2021, 27 pages.
Communication of Further Notices of Opposition filed in corresponding European Application No. 19151511.3, Patent No. 3491944, mailed Mar. 16, 2021, 63 pages.
Concise Oxford English Dictionary (11th ed., 2008), pp. 311, 1213.
CORESTA, Physical Test Methods Sub-Group Technical Report: Tobacco Moisture, Water and Oven Volatiles, Jul. 2014.
CORESTA, Tobacco and Tobacco Products Analytes Sub-Group Technical Report: 2018 Moisture (OV), Water by Karl Fischer and Gas Chromatography Interlaboratory Study, Aug. 2018.
Curriculum Vitae of Dr. Deevi.
Curriculum Vitae of Dr. Seetharama C. Deevi.
Curriculum Vitae of Stewart Fox.
D. Kirk Davidson, Selling Sin: The Marketing of Socially Unacceptable Products (2d ed. 2003).
Decision Denying Institution of *Inter Partes* Review in *Inter Partes* Review of U.S. Pat. No. 9,814,268, dated Nov. 16, 2020.
Decision Denying Patent Owner's Request for Rehearing in *Inter Partes* Review of U.S. Pat. No. 9,930,915, dated Feb. 25, 2022.
Decision Granting Institution of *Inter Partes* Review in *Inter Partes* Review of U.S. Pat. No. 9,930,915, dated Jan. 25, 2021.
Decision Granting Request for Rehearing and Granting Institution of *Inter Partes* Review in *Inter Partes* Reexamination of U.S. Pat. No. 9,814,268, dated Aug. 5, 2021.
Decision of the Opposition Division dated Jul. 20, 2021 in corresponding European Application No. 18173918.6.
Declaration of Charles E. Clemens in *Inter Partes* Review of U.S. Pat. No. 9,930,915, dated Apr. 16, 2021.
Declaration of Dr. Deevi in Support of Petition for Inter Partes Review of '915 Patent ("Deevi Decl.").
Declaration of Dr. Seetharama C. Deevi in Support of Petition for *Inter Partes* Review of '268 Patent.
Declaration of Dr. Seetharama C. Deevi in Support of Petition for *Inter Partes* Review of '123 Patent.
Declaration of Dr. Seetharama C. Deevi in Support of Petitions for PTAB Review of '542 Patent ("Deevi Decl.").
Declaration of Dr. Seetharama Deevi in support of Petitioner's Reply in *Inter Partes* Review of U.S. Pat. No. 9,930,915, dated Jul. 10, 2021.
Declaration of Jonathan M. Strang in Response to Patent Owner's Objections to Petitioner's Exhibits [served Aug. 12, 2021, not filed].
Declaration of Stewart Fox in Support of Petition for *Inter Partes* Review of '123 Patent.
Douglas C. McGill, 'Smokeless' Cigarette's Hapless Start, N.Y. Times, Nov. 19, 1988, at 33.
Email exchange among Carolyn Carpenter, John Robinson et al. regarding electric cigarette.
Email from Jonathan Strang "Precedential Opinion Panel Request: IPR2020-00921 (USP 9,814,268)", Exhibit 3002 in *Inter Partes* Review of U.S. Pat. No. 9,814,268, dated Dec. 15, 2020.
Excerpts from James W. Dally, Packaging of Electronic Systems: A Mechanical Engineering Approach (1990), 18 pgs.
Extended European Search Report, EP 17 18 5645, mailed Nov. 28, 2017.
FDA News Release, FDA Permits Sale of IQOS Tobacco Heating System Through Premarket Tobacco Product Application Pathway (Apr. 30, 2019).
File history for U.S. Pat. No. 9,814,268.
File History regarding U.S. Pat. No. 10,588,355 ("'355 FH").
George Wypych, *Handbook of Polymers* (2d ed. 2016).
Hajaligol et al., "Method of Making a Heather with Bullet Shape (Design) to be Used in the Beta Article, Specifically Useful for Beta Cigarettes Made with Cut Filler" May 1994, Invention Record.
Hajaligol, M. R., "Method of Making a Heater With Bullet Shape," Mar. 1994. Philip Morris Records; Master Settlement Agreement. https://www.industrydocuments.ucsf.edu/docs/ktbn0130.
Harvard School of Public Health, Division of Public Health Practice, Potentially Reduced Exposure Tobacco Products—A Public Health Information Guide (2008) ("Eclipse-Premier").
Hon Lik, *I Was Sure That the Electronic Cigarette Would Be Welcomed With Open Arms*, Sciences at Avenir (Oct. 7, 2013).
Honeywell datasheet for Pressure Sensors, 160PC Series ("Honeywell datasheet").
Honeywell Microbridge Mass Airflow Sensor/Unamplified, AWM2000 Series.
Horowitz, et al., The Art of Electronics, 1980, pp. 33-35.
IEEE 100, The Authoritative Dictionary of IEEE Standards Terms ($7^{th}$ ed. 2000), pp. 230, 234.
In re Court Operations Under the Exigent Circumstances Created by the Outbreak of Coronavirus Disease 2019 (COVID-19): Temporary Suspension of Criminal Jury Trials (E.D. Va. Nov. 16, 2020).
Inhalation Technology, Dr. Donald E. Garden, ed., vol. 12, No. 5, pp. 1-58, (2000).
IQOS—A New Era in Tobacco (2014).
J.P. Hammond et al., Brazing Ceramic Oxides to Metals at Low Temperatures, Welding Research Supplement, 227-232-s (1998) ("Hammond Brazing").
J.R. Davis, Joining, Metals Handbook Desk Edition, 1049-1056 (2d ed. 1998) ("ASM Joining").
James A. Speck, Mechanical Fastening, Joining, and Assembly, Marcel Dekker, Inc. 1997, 4 pgs.
Joint Proposed Discovery Plan Pursuant to Rule 26(f), *RAI Strategic Holdings, Inc.* v. *Altria Client Services LLC*, No. 1:20-cv-00393-LO-TCB (E.D. Va. Sep. 2, 2020), ECF No. 97.
Jones J. et al. Cigarette Brainstorming Team No. 2. May 13, 1994. Philip Morris Records; Master Settlement Agreement. Unknown. https://www.industrydocuments.ucsf.edu/docs/gqcv0119.
Judgment Final Written Decision Determining All Challenged Claims Unpatentable in *Inter Partes* Review of U.S. Pat. No. 9,814,268, dated Jun. 30, 2022.
Judgment Final Written Decision Determining All Challenged Claims Unpatentable in IPR2020-01094, *Inter Partes* Review of U.S. Pat. No. 9,930,915, Jan. 11, 2022.
Judgment Final Written Decision in *Inter Partes* Review of U.S. Pat. No. 9,901,123, dated Mar. 30, 2022.
Kevin Hatch, et al.,*Preliminary Evaluation of a Commercially Available Electric Aerosol Inhaler from China* (Sep. 14, 2006) ("RJR Teardown").
Laroy, B; Utsch, F. An Outline of Permanent Heater / Disposable Flavor Insert Concepts. Nov. 1991. Philip Morris Records; Master Settlement Agreement. Unknown. https://www.industrydocuments.ucsf.edu/docs/ygcc0114.
Laroy, et al., "An Outline of Permanent Heater/Disposable Flavor Insert Cncepts," Nov. 1991.
Letter accompanying subsequently filed items, Further Written Submissions filed in corresponding European Application No. 19151511.3, Patent No. 3491944. Dec. 13, 2021.
Letter from David M. Maiorana, counsel for Complainants, to The Honorable Lisa R. Barton, regarding *Certain Tobacco Heating Articles and Components Thereof*, No. 337-TA-1199 (U.S.I.T.C. Apr. 9, 2020).
Letter from Maximillian Grant, counsel for Defendants, to David Maiorana, counsel for Plaintiffs, regarding *RAI Strategic Holdings, Inc.* v. *Altria Client Services LLC*, No. 1:20-cv-00393-LO-TCB (Sep. 18, 2020).
Letter from Robert B. Swierupski, Director, National Commodity Specialist Division, to Mark Weiss, Weiss & Moy, P.C. regarding tariff classification ruling (Aug. 22, 2006).
Lu, Zhang, "Safe Substitute", China Daily, Jul. 11, 2005.
Mark's Standard Handbook for Mechanical Engineers, Eugene A. Avallone et al., published 1978, p. 15-6.

(56) References Cited

OTHER PUBLICATIONS

McGraw-Hill Dictionary of Electrical and Computer Engineering (2003), p. 479.
Memorandum in Support of Defendants' Partial Motion to Stay Plaintiffs' Claims Regarding U.S. Pat. Nos. 9,814,268 and 10,492,542, *RAI Strategic Holdings, Inc.* v. *Altria Client Services LLC*, No. 1:20-cv-00393-LO-TCB (E.D. Va. Nov. 27, 2020), ECF No. 371.
Merriam-Webster's Collegiate Dictionary (10th ed., 2001), (excerpt).
Modern Dictionary of Electronics (7th ed., 1999), pp. 151, 636, 637.
Morgan et al., "Philip Morris USA Invention Record," Oct. 1988.
Mosdesign Semiconductor Corp. Datasheet for M1600 LED Drivers ("Mosdesign M1600 Datasheet"), 1 pg.
MPL 502 Series Specifications, Micro Pneumatic Logic, Inc., (Mar. 11, 2006), http://www.pressureswitch.com/PDFs/0502STANDARDA.pdf [https://web.archive.org/web/20060311132848 / 17 pgs.
MPL Pressure Switch Solutions, Micro Pneumatic Logic, Inc., (Product Brochure) (Mar. 11, 2006), http://www.pressureswitch.com/PDFs/2000_MPLBrochure.pdf [https://web.archive.org/web/20060311132419/ http://www.pressureswitch.com/PDFs/2000_MPLBrochure.pdf]. 2 pgs.
N.A. Fuchs, The Mechanics of Aerosols (1989), 22 pgs.
Notice of Opposition filed in corresponding European Application No. 18173918.6, Patent No. 3398460 on Apr. 14, 2020.
Order No. 28: Construing Certain Claims in *Certain Tobacco Heating Articles and Components Thereof*, No. 337-TA-1199 (U.S. I.T.C. Jan. 6, 2021).
Order, *Bushnell Hawthorne, LLC* v. *Cisco Systems, Inc.*, No. 1:18-cv-760 (E.D. Va. Apr. 22, 2019).
Order, *RAI Strategic Holdings, Inc.* v. *Altria Client Services LLC*, No. 1:20-cv-00393-LO-TCB (E.D. Va. Dec. 4, 2020), ECF No. 426.
Order, *RAI Strategic Holdings, Inc.* v. *Altria Client Services LLC*, No. 1:20-cv-00393-LO-TCB (E.D. Va. Dec. 7, 2020), ECF No. 432.
Order, *RAI Strategic Holdings, Inc.* v. *Altria Client Services LLC*, No. 1:20-cv-393 (E.D. Va. Feb. 16, 2021).
Ott, Henry W., Noise Reduction Techniques in Electronic Systems, (2d E. 1988), pp. 286-293.
Oxford Dictionary of English (3d ed. 2010), p. 477.
Patent Owner Preliminary Response in *Inter Partes* Review of U.S. Pat. No. 9,814,268 dated Aug. 17, 2020.
Patent Owner Preliminary Response in *Inter Partes* Review of U.S. Pat. No. 9,930,915 dated Oct. 27, 2020.
Patent Owner Response to Petition for *Inter Partes* Review Pursuant to 37 C.F.R. § 42.220 in *Inter Partes* Review of U.S. Pat. No. 9,814,268, dated Dec. 6, 2021.
Patent Owner Response to Petition for *Inter Partes* Review Pursuant to 37 C.F.R. § 42.220 in *Inter Partes* Review of U.S. Pat. No. 9,930,915, dated Apr. 19, 2021.
Patent Owner Sur-Reply in *Inter Partes* Review of U.S. Pat. No. 9,814,268, dated Apr. 11, 2022.
Patent Owner Sur-Reply in *Inter Partes* Review of U.S. Pat. No. 9,930,915, dated Aug. 30, 2021.
Patent Owner's Demonstratives for Oral Argument: RAI's PTAB Presentation, *Philip Morris Products, S.A.* v. *RAI Strategic Holdings, Inc.*, IPR2020-00921, Exhibit 2011, May 11, 2022.
Patent Owner's Infringement Chart for '123 patent, In the Matter of Certain Tobacco Heating Articles and Components Thereof, Inv. No._, EDIS Doc. ID 707369 (filed Apr. 9, 2020).
Patent Owner's Rehearing Request in *Inter Partes* Review of U.S. Pat. No. 9,930,915, dated Feb. 10, 2022.
Patent Owner's Sur-Reply to Petitioner's Reply to Patent Owner's Preliminary Response in *Inter Partes* Review of U.S. Pat. No. 9,814,268, dated Sep. 29, 2020.
Patent Owner's Sur-Reply to Petitioner's Reply to Patent Owner's Preliminary Response in *Inter Partes* Review of U.S. Pat. No. 9,930,915, dated Dec. 10, 2020.
Petition for *Inter Partes* Review of U.S. Pat. No. 10,492,542.
Petition for *Inter Partes* Review of U.S. Pat. No. 9,930,915.
Petition for *Inter Partes* Review of U.S. Pat. No. 9,814,268, submitted May 8, 2020.
Petition for *Inter Partes* Review of U.S. Pat. No. 9,901,123, submitted May 8, 2020.
Petition for *Inter Partes* Review of U.S. Pat. No. 9,901,123, submitted Sep. 18, 2020.
Petition for Post-Grant Review of U.S. Pat. No. 10,492,542.
Petitioner's Demonstratives: *Philip Morris Products, S.A.* v. *RAI Strategic Holdings, Inc.*, IPR2020-00921, May 11, 2022.
Petitioner's Demonstratives: *Philip Morris Products, S.A.* v. *RAI Strategic Holdings, Inc.*, IPR2020-01094, in *Inter Partes* Review of U.S. Pat. No. 9,930,915, Oct. 27, 2021.
Petitioner's Reply in *Inter Partes* Review of U.S. Pat. No. 9,814,268, entered Feb. 28, 2022.
Petitioner's Reply in *Inter Partes* Review of U.S. Pat. No. 9,930,915, dated Jul. 12, 2021.
Petitioner's Reply to Patent Owner Preliminary Response in *Inter Partes* Review of U.S. Pat. No. 9,814,268, entered Sep. 18, 2020.
Petitioner's Reply to the Patent Owner Preliminary Response in *Inter Partes* Review of U.S. Pat. No. 9,930,915 (Nov. 25, 2020).
Philip Morris Incorporated Invention Record (dated Oct. 11, 1988).
Philip Morris Incorporated Invention Record (submitted May 19, 1994; witnessed May 23, 1994).
Philip Morris Int'l, 2019 Third-Quarter Results Presentation (Oct. 17, 2019).
Philip Morris Int'l, The IQOS Heating System, Tobacco Products Scientific Advisory Committee Presentation (Jan. 24, 2018).
Philip Morris U.S.A. interoffice correspondence from R.H. Moffitt to K. Torrence regarding operational analysis of SBT Ruyan Atomizing Nicotine Inhaler (Sep. 27, 2004) (Original).
Philip Morris U.S.A. interoffice correspondence from R.H. Moffitt to K. Torrence regarding operational analysis of SBT Ruyan Atomizing Nicotine Inhaler (Sep. 27, 2004).
Pilot Corp. Stores Offer Ruyan Smoking Alternatives in Knoxville, Tenn.-Area Convenience Stores; Ruyan Vegas(R) Disposable E-Cigar in Select Stores in December; Jazz Disposable E-Cigarette Will Premier in Next 30 Days, PR Newswire, Dec. 16, 2008.
Plaintiffs' Notice of Motion and Motion for Summary Judgment, *Apple Inc.* v. *Iancu*, No. 5:20-cv-06128-EJD (N.D. Cal. Nov. 23, 2020), ECF No. 65.
Plaintiffs' Opposition to Defendants' Partial Motion to Stay Plaintiffs' Claims Regarding U.S. Pat. Nos. 9,814,268 and 10,492,542, *RAI Strategic Holdings, Inc.* v. *Altria Client Services LLC*, No. 1:20-cv-00393-LO-TCB (E.D. Va. Dec. 2, 2020), ECF No. 405.
Press Release, Altria, FDA Authorizes Sale of IQOS Tobacco Heating System in the U.S. (Apr. 30, 2019) ("Altria Announcement").
Public Version of Complainant's Opening Post-Hearing Brief in International Trade Commission Investigation No. 337-TA-1199 in the matter of *Certain Tobacco Heating Articles and Components Thereof* on Mar. 31, 2021.
Public Version of Representative Claim Chart of Domestic Industry of Claims 1-4 in U.S. Pat. No. 9,930,915 by the VUSE Solo Device from ITC Inv. No. 337-TA-1199 Nov. 25, 2020.
Public Version of Respondents' Petition and Contingent Petition for Review of the Final Initial Determination in United States International Trade Commission Investigation 337-TA-1199 in the matter of Certain Tobacco Heating Articles and Components Thereof on May 28, 2021.
Public Version of Respondents' Post-Hearing Responsive Brief filed in United States International Trade Commission Investigation 337-TA-1199 in the matter of Certain Tobacco Heating Articles and Components Thereof on Mar. 31, 2021.
R.J. Reynolds Tobacco Co., *Chemical and Biological Studies on New Cigarette Prototypes that Heat Instead of Burn Tobacco*, Reynolds Tobacco Company Monograh, 1988, pp. 60-62, pp. 119-124.
R.R. Baker, *Temperature Distribution Inside a Burning Cigarette*, Nature, vol. 247, pp. 405-406, (1974).
Rebuttal Expert Report of Charles Clemens in *Certain Tobacco Heating Articles and Components Thereof*, No. 337-TA-1199 (U.S. I.T.C. Oct. 23, 2020).
Record of Oral Hearing held Oct. 27, 2021, in IPR2020-01094, *Inter Partes* Review of U.S. Pat. No. 9,930,915, Nov. 24, 2021.

(56) References Cited

OTHER PUBLICATIONS

Remote Deposition of Seetharama C. Deevi, Ph.D. in *Inter Partes* Review of U.S. Pat. No. 9,930,915, dated Aug. 20, 2021.
Remote Deposition of Seetharama C. Deevi, Ph.D. in *Inter Partes* Review of U.S. Pat. No. 9,930,915, dated Mar. 26, 2021.
Reply Support of Defendants' Partial Motion to Stay Plaintiffs' Claims Regarding U.S. Pat. Nos. 9,814,268 and 10,492,542, *RAI Strategic Holdings, Inc.* v. *Altria Client Services LLC*, No. 1:20-cv-00393-LO-TCB (E.D. Va. Dec. 3, 2020), ECF No. 422.
Respondents' Opening Claim Construction Brief in *Certain Tobacco Heating Articles and Components Thereof*, No. 337-TA-1199 (U.S. I.T.C. Aug. 21, 2020).
Respondents' Responsive Claim Construction Brief in *Certain Tobacco Heating Articles and Components Thereof*, No. 337-TA-1199 (U.S.I.T.C. Sept. 4, 2020).
Richard R. Baker, *Smoke Generation Inside a Burning Cigarette: Modifying Combustion to Develop Cigarettes That May be Less Hazardous to Health*, Progress in Energy and Combustion Science, vol. 32, pp. 373-385, (2006).
Robert W. Messler, Jr., Joining of Materials and Structures, Elsevier Butterworth-Heinemann 2004—Excerpt, 4 pgs.
Rohsenow, "Heat, Mass, and Momentum Transfer", copyright 1961 Prentice-Hall, 3 pgs.
Rule 16(b) Scheduling Order, *RAI Strategic Holdings, Inc.* v. *Altria Client Services LLC*, No. 1:20-cv-00393-LO-TCB (E.D. Va. Sep. 8, 2020), ECF No. 99.
Samejima, T., et al., "Moisture Sorption Isotherms of Various Tobaccos", 1978, *Agric. Biol. Chem.*, vol. 42(12), pp. 2285-2290.
Sherz, Paul, Practical Electronics for Inventors, 2000, p. 107, p. 234.
Steven M. Kaplan, Wiley Electrical and Electronics Engineering Dictionary (2004), pp. 144-145.
Submission in Opposition Proceedings, filed in corresponding European Application No. 18173918.6, Patent No. 3398460, dated Dec. 3, 2020.
Submission in opposition proceedings, Further Written Submissions filed in corresponding European Application No. 18173918.6, Patent No. 3398460. Dated Apr. 16, 2021.
Summary of Group #3 Brainstorming on May 13, 1994.
The American Heritage Dictionary of the English Language (5th ed. 2011), p. 1467.
The Lady Smokes, www.theladysmokes.com, webpages archived at (Nov. 7, 2006).
Thermal Ink-Jet Print Cartridge Designer's Guide (2nd Edition Hewlett Packard) ("Jet Print Cartridge Designers Guide"), 12 pgs.
Third Party Observation filed in corresponding European Application No. 19151515.4, Patent No. 3508076, mailed Jan. 18, 2021.
Third Party Observation filed in corresponding European Application No. 19151515.4, Patent No. 3508076, mailed Mar. 12, 2020.
Transcript of Motion Hearing Proceedings (Via Zoom Conference) Before the Honorable Theresa C. Buchanan, United States District Court Magistrate Judge, *RAI Strategic Holdings, Inc.* v. *Altria Client Services LLC*, No. 1:20-cv-00393-LO-TCB (E.D. Va. Dec. 4, 2020).
Transcript Record of Oral Hearing held May 11, 2022 in *Inter Partes* Review of U.S. Pat. No. 9,814,268.
U.S. Appl. No. 60/722,036.
UK Approved Judgment In the High Court of Justice Business and Property Courts of England and Wales Intellectual Property List (ChD) Patents Court, dated Mar. 9, 2021, EWHC 537.
Unknown. Heater Development. Mar. 1994. Philip Morris Records; Master Settlement Agreement. Unknown. https://www.industrydocuments.ucsf.edu/docs/hxwy0118.
Unknown. Philip Morris Patent Database Search Invention Disclosures Dating From About 800000 to Present for Which Patent Applications Were Not Filed. Aug. 2, 19961. Philip Morris Records; Master Settlement Agreement. Unknown. https://www.industrydocuments.ucsf.edu/docs/kgd10071.
Unknown. Project Beta Core Teams—Ashland. May 6, 1994. Philip Morris Records; Master Settlement Agreement. Unknown. https://www.industrydocuments.ucsf.edu/docs/szjn0076.
Videotaped Deposition of Charles E. Clemens, Conducted Virtually in United States International Trade Commission Investigation 337-TA-1199 in the matter of Certain Tobacco Heating Articles and Components Thereof on Nov. 5, 2020.
Waybackmachine Archive of Wikipedia page "Polycarbonate" 2006, Accessed from web.archive.org/web/20060913000000/https://en.wikipedia.org/wiki/Polycarbonate.
Webpages from Beijing SBT Ruyan Technology & Development Corp., Sbtry.cn (archived at web.archive.org, 2005-2006, with affidavit).
Webpages from E-cig.com (archived at web.archive.org, 2006-2007, with affidavit).
Wiley Electrical and Electronics Engineering Dictionary (2004), p. 181.
Written Opinion of the International Searching Authority in International Application No. PCT/US2007/081461, mailed Apr. 18, 2009.
Yunus A. Cengel & Michael A. Boles, Thermodynamics: an Engineering Approach (5th ed. 2006) (excerpts) ("Thermodynamics"), 9 pgs.
Patent Owner Preliminary Response in post-grant review of U.S. Pat. No. 10,492,542 dated Oct. 16, 2020.
Petitioner's Reply to the Patent Owner Preliminary Response in post-grant review of U.S. Pat. No. 10,492,542 entered Nov. 10, 2020.
Patent Owner's Sur-Reply to Petitioner's Reply to Patent Owner's Preliminary Response in post-grant review of U.S. Pat. No. 10,492,542 dated Nov. 20, 2020.
Decision Granting Institution of Post-Grant Review in post-grant review of U.S. Pat. No. 10,492,542 entered Jan. 13, 2021.
Declaration of Charles E. Clemens in post-grant review of U.S. Pat. No. 10,492,542 dated Apr. 6, 2021.
Deposition of Dr. Seetharama C. Deevi taken by videoconference on Mar. 22, 2021 in post-grant review of U.S. Pat. No. 10,492,542.
Patent Owner Response to Petition for Post-Grant Review Pursuant to 37 C.F.R. § 42.220 in post-grant review of U.S. Pat. No. 10,492,542 dated Apr. 7, 2021.
Petitioner's Reply in post-grant review of U.S. Pat. No. 10,492,542 entered Jun. 30, 2021.
Videotaped Deposition of Dr. Seetharama C. Deevi, Ph.D. taken remotely via Zoom on Jul. 30, 2021 in post-grant review of U.S. Pat. No. 10,492,542.
Patent Owner Sur-Reply in post-grant review of U.S. Pat. No. 10,492,542 dated Aug. 11, 2021.
Judgment Final Written Decision Determining All Challenged Claims Unpatentable in post-grant review of U.S. Pat. No. 10,492,542 entered Jan. 10, 2022.
Patent Owner's Rehearing Request in post-grant review of U.S. Pat. No. 10,492,542 dated Feb. 9, 2022.
Decision Denying Patent Owner's Request for Rehearing in post-grant review of U.S. Pat. No. 10,492,542 entered Mar. 31, 2022.
File History regarding U.S. Pat. No. 10,492,542 ("'542 FH").
Patent Owner Preliminary Response in *Inter Partes* Review of U.S. Pat. No. 9,901,123, dated Aug. 17, 2020.
Petitioner's Reply to the Patent Owner Preliminary Response in *Inter Partes* Review of U.S. Pat. No. 9,901,123, entered Sep. 18, 2020.
Patent Owner's Sur-Reply to Petitioner's Reply to the Patent Owner's Preliminary Response in *Inter Partes* Review of U.S. Pat. No. 9,901,123, dated Sep. 29, 2020.
Decision Denying Institution of *Inter Partes* Review in *Inter Partes* Review of U.S. Pat. No. 9,901,123, dated Nov. 16, 2020.
Patent Owner's Demonstratives for Oral Argument: RAI's PTAB Presentation, *Philip Morris Products, S.A.* v. *RAI Strategic Holdings, Inc.*, IPR2020-01602, Exhibit 2017, Jan. 6, 2021.
Patent Owner Preliminary Response in *Inter Partes* Review of U.S. Pat. No. 9,901,123, dated Jan. 8, 2021.
Petitioner's Reply to the Patent Owner Preliminary Response in *Inter Partes* Review of U.S. Pat. No. 9,901,123, entered Feb. 9, 2021.
Decision Granting Institution of *Inter Partes* Review in *Inter Partes* Review of U.S. Pat. No. 9,901,123, dated Apr. 2, 2021.
Declaration of Charles E. Clemens in *Inter Partes* Review of U.S. Pat. No. 9,901,123, dated Jul. 1, 2021.

(56) References Cited

OTHER PUBLICATIONS

Patent Owner Response in *Inter Partes* Review of U.S. Pat. No. 9,901,123, dated Jul. 2, 2021.
Remote Videotaped Deposition of Stewart M. Fox on Jun. 25, 2021, in *Inter Partes* Review of U.S. Pat. No. 9,901,123.
Petitioner's Reply in *Inter Partes* Review of U.S. Pat. No. 9,901,123, dated Oct. 8, 2021.
Patent Owner Sur-Reply in *Inter Partes* Review of U.S. Pat. No. 9,901,123, dated Nov. 19, 2021.
Record of Oral Hearing held Jan. 6, 2022, in *Inter Partes* Review of U.S. Pat. No. 9,901, 123, entered Mar. 1, 2022.
Petitioner's Request for Rehearing of the Institution Decision in *Inter Partes* Review of U.S. Pat. No. 9,901,123, entered Jul. 21, 2022.
File History for U.S. Pat. No. 9,930,915.
File History for U.S. Pat. No. 9,901,123.
Petition for *Inter Partes* Review of U.S. Pat. No. 9,839,238.
Declaration of Samir Nayfeh, Ph.D. in Support of Petition for Inter Partes Review of '238 Patent ("Nayfeh Decl.").
Curriculum Vitae of Samir Nayfeh, Ph.D., 2019.
Monique Williams & Prue Talbot, Variability Among Electronic Cigarettes in the Pressure Drop, Airflow Rate, and Aerosol Production, 13 Nicotine & Tobacco Research 1276-84 (Dec. 2011) ("Williams and Talbot").
Public Version of Respondents' Notice of Prior Art filed in United States International Trade Commission Investigation 337-TA-1199 in the matter of Certain Tobacco Heating Articles and Components Thereof on Aug. 13, 2020.
Public Version of Respondents' Prehearing Brief filed in United States International Trade Commission Investigation 337-TA-1199 in the matter of Certain Tobacco Heating Articles and Components Thereof on Dec. 11, 2020.
Public Version of Complainants' Pre-Hearing Brief filed in United States International Trade Commission Investigation 337-TA-1199 in the matter of Certain Tobacco Heating Articles and Components Thereof on Dec. 11, 2020. (Parts 1 & 2).
Public Version of Commission Investigative Staff's Pre-Hearing Brief filed in United States International Trade Commission Investigation 337-TA-1199 in the matter of Certain Tobacco Heating Articles and Components Thereof on Jan. 4, 2021.
Public Version of Respondents' Post-Hearing Initial Brief filed in United States International Trade Commission Investigation 337-TA-1199 in the matter of Certain Tobacco Heating Articles and Components Thereof on Feb. 12, 2021.
Ariat-Technology, Honeywell Sensing and Productivity Solutions, accessed 2021.
Lish, Tom, What is the difference between Vented and Sealed Gauge Reference Pressure, Setra, Jan. 26, 2017.
Brief of *Amicus Curiae* Fitbit, Inc. in Support of Plaintiffs' Motion for Summary Judgment, *Apple Inc.* v. *Iancu*, No. 20-cv-06128-EJD (N.D. Cal Dec. 23, 2020), ECF No. 81-1.
Comments of The American Conservative Union in *Certain Tobacco Heating Articles and Components Thereof*, No. 337-3447 (U.S.I.T.C. Apr. 22, 2020).
Complainants RAI Strategic Holdings, Inc., R.J. Reynolds Vapor Company, and R.J. Reynolds Tobacco Company's Infringement Claim Chart for U.S. Pat. No. 9,839,238 from ITC Inv. No. 337-TA-1199.
Complainants' Opening Claim Construction Brief in *Certain Tobacco Heating Articles and Components Thereof*, No. 337-TA-1199 (U.S.I.T.C. Aug. 21, 2020).
Complainants' Responsive Claim Construction Brief in *Certain Tobacco Heating Articles and Components Thereof*, No. 337-TA-1199 (U.S.I.T.C. Sept. 4, 2020).
Complaint and Public Interest Statement in *Certain Tobacco Heating Articles and Components Thereof*, ITC Inv. No. 337-TA-1199.
Complaint for Patent Infringement in *RAI Strategic Holdings, Inc.* v. *Altria Client Services LLC*, No. 1:20-cv-393 (E.D. Va. Apr. 9, 2020).
Consent Order in *RAI Strategic Holdings, Inc.* v. *Altria Client Services LLC*, No. 1:20-cv-393 (E.D. Va. May 4, 2020).
Decision Denying Institution of *Inter Partes* Review of U.S. Pat. No. 9,839,238 (Jan. 19, 2021).
Decision Denying Petitioner's Request for Rehearing in *Inter Partes* Review of U.S. Pat. No. 9,839,238 (Jul. 30, 2021).
Defendants' Unopposed Motion to Invoke the Statutory Stay of Plaintiffs' Claims Relating to U.S. Pat. Nos. 9,839,238, 9,901,123, and 9,930,915 Pursuant to 28 U.S.C. § 1659 in *RAI Strategic Holdings, Inc.* v. *Altria Client Services LLC*, No. 1:20-cv-393 (E.D. Va. Jun. 12, 2020).
Email from Jonathan Strang "Precedential Opinion Panel Request: IPR2020-01097 (U.S. Pat. 9,839,238)" Exhibit 3001 in *Inter Partes* Review of U.S. Pat. No. 9,839,238 (Feb. 18, 2021).
FDA News release, *FDA Authorizes Marketing of IQOS Tobacco Heating System with 'Reduced Exposure' Information* (Jul. 7, 2020), https://www.fda.gov/news-events/press-announcements/fda-authorizesmarketing-iqos-tobacco-heating-system-reduced-exposure-information.
FDA News release, *FDA permits sale of IQOS Tobacco Heating System through premarket tobacco product application pathway* (Apr. 30, 2019), https://www.fda.gov/news-events/press-announcements/fdapermits-sale-iqos-tobacco-heating-system-through-premarket-tobaccoproduct-application-pathway.
File History regarding U.S. Pat. No. 9,839,238.
Joint Proposed Procedural Schedule in *Certain Tobacco Heating Articles and Components Thereof*, ITC Inv. No. 337-TA-1199 (U.S.I.T.C. Jun. 9, 2020).
Modification of Limited Exclusion Order and Cease and Desist Order; Termination of the Modification Proceeding as to U.S. Pat. No. 6,377,577 and Suspension of the Modification Proceeding as to U.S. Pat. No. 7,224,668 in *Certain Network Devices, Related Software and Components Thereof*, No. 337-TA-945 (U.S.I.T.C. Jun. 26, 2018) ("Commission Order").
Notification of Receipt of POP Request in *Inter Partes* Review of U.S. Pat. No. 9,839,238 (Mar. 24, 2021).
Order Granting Defendants' Unopposed Motion to Invoke the Statutory Stay of Plaintiffs' Claims Relating to U.S. Pat. Nos. 9,839,238, 9,901,123, and 9,930,915 Pursuant to 28 U.S.C. § 1659 in *RAI Strategic Holdings, Inc.* v. *Altria Client Services LLC*, No. 1:20-cv-393 (E.D. Va. Jun. 18, 2020).
Order No. 8 in *Certain Laser-driven Light Sources, Subsystems Containing Laser-driven Light Sources, and Products Containing Same*, No. 337-TA-983 (U.S.I.T.C. Mar. 3, 2016).
Order No. 8, Amending Ground Rules in *Certain Tobacco Heating Articles and Components Thereof*, No. 337-TA-1199 (U.S.I.T.C. Jul. 27, 2020).
Patent Owner Preliminary Response in *Inter Partes* Review of U.S. Pat. No. 9,839,238 (Oct. 27, 2020).
Patent Owner's Mandatory Notices in *Inter Partes* Review of U.S. Pat. No. 9,839,238, Jul. 2, 2020.
Patent Owner's Sur-Reply to Petitioner's Reply to Patent Owner's Preliminary Response in *Inter Partes* Review of U.S. Pat. No. 9,839,238 (Dec. 10, 2020).
Petitioner's Reply to the Patent Owner Preliminary Response in *Inter Partes* Review of U.S. Pat. No. 9,839,238 (Nov. 25, 2020).
Petitioner's Request for Rehearing of Decision Denying Institution in *Inter Partes* Review of U.S. Pat. No. 9,839,238 (Feb. 18, 2021).
Petitioner's Updated Mandatory Notices in *Inter Partes* Review of U.S. Pat. No. 9,839,238 (May 11, 2021).
Philip Morris Products SA's Comments to Complainants' Public Interest Statement in *Certain Tobacco Heating Articles and Components Thereof*, No. 337-TA-3447 (U.S.I.T.C. Apr. 23, 2020).
Public Interest Comments of Congressman George Holding in *Certain Tobacco Heating Articles and Components Thereof*, No. 337-TA-3447 (U.S.I.T.C. Apr. 15, 2020).
Public Interest Comments of Dr. Nikan H. Khatibi, MD in *Certain Tobacco Heating Articles and Components Thereof*, No. 337-TA-3447 (U.S.I.T.C. Apr. 23, 2020).
Public Interest Comments of Nextera Healthcare in *Certain Tobacco Heating Articles and Components Thereof*, No. 337-TA-3447 (U.S.I.T.C. Apr. 23, 2020).

(56) References Cited

OTHER PUBLICATIONS

Public Interest Comments of Spark MD in *Certain Tobacco Heating Articles and Components Thereof*, No. 337-TA-3447 (U.S.I.T.C. Apr. 23, 2020).
Public Interest Comments of TechFreedom in *Certain Tobacco Heating Articles and Components Thereof*, No. 337-TA-3447 (U.S. I.T.C. Apr. 23, 2020).
Public Interest Comments of the Consumer Advocates for Smoke-free Alternatives Association in *Certain Tobacco Heating Articles and Components Thereof*, No. 337-TA-3447 (U.S.I.T.C. Apr. 23, 2020).
Public Interest Comments of the Progressive Policy Institute in *Certain Tobacco Heating Articles and Components Thereof*, No. 337-TA-3447 (U.S.I.T.C. Apr. 23, 2020).
Public Interest Comments of the Reason Foundation in *Certain Tobacco Heating Articles and Components Thereof*, No. 337-TA-3447 (U.S.I.T.C. Apr. 23, 2020).
Public Interest Comments of the Schizophrenia and Related Disorder Alliance of America in *Certain Tobacco Heating Articles and Components Thereof*, No. 337-TA-3447 (U.S.I.T.C. Apr. 23, 2020).
Public Interest Comments of the Smoke-Free Alternatives Trade Association in *Certain Tobacco Heating Articles and Components Thereof*, No. 337-TA-3447 (U.S.I.T.C. Apr. 23, 2020).
Public Version of Commission Investigative Staff's Responsive Post-Hearing Brief in International Trade Commission Investigation No. 337-TA-1199 in the matter of *Certain Tobacco Heating Articles and Components Thereof* on Mar. 5, 2021.
Public Version of Commission Opinion in International Trade Commission Investigation No. 337-TA-1199 in the matter of *Certain Tobacco Heating Articles and Components Thereof* on Oct. 19, 2021.
Public Version of Complainant's Responsive Post-Hearing Brief in International Trade Commission Investigation No. 337-TA-1199 in the matter of *Certain Tobacco Heating Articles and Components Thereof* on Mar. 31, 2021.
Public Version of Initial Determination on Violation of Section 337 and Recommended Determination on Remedy and Bond in International Trade Commission Investigation No. 337-TA-1199 in the matter of *Certain Tobacco Heating Articles and Components Thereof* on May 14, 2021.
Public Version of Respondent's Joint Disclosure of Final Contentions in Response to Individual Interrogatory No. 12, in *Certain Tobacco Heating Articles and Components Thereof*, No. 337-TA-1199 (Sep. 18, 2020).
Patent Owner's Notice of Appeal in IPR2020-01094, *Inter Partes* Review of U.S. Pat. No. 9,930,915, Apr. 28, 2022.
Petitioner's Notice of Appeal in IPR2020-01602, *Inter Partes* Review of U.S. Pat. No. 9,901,123, May 27, 2022.
Notification of Receipt of POP Request in IPR2020-00919, *Inter Partes* Review of U.S. Pat. No. 9,901,123, Jul. 21, 2022.
POP Request in IPR2020-00919, *Inter Partes* Review of U.S. Pat. No. 9,901,123, Jul. 21, 2022.
POP Request Dismissed in IPR2020-00919, *Inter Partes* Review of U.S. Pat. No. 9,901,123, Jul. 26, 2022.
Panel Change Order Conduct of the Proceeding in IPR2020-00919, *Inter Partes* Review of U.S. Pat. No. 9,901,123, Sep. 13, 2022.
Decision Denying Petitioner's Request on Rehearing of Decision Denying Institution in IPR2020-00919, *Inter Partes* Review of U.S. Pat. No. 9,901,123, Oct. 13, 2022.
Notice of Allowance received in corresponding Korean patent application No. 10-2023-7000834, mailed Sep. 1, 2023.
Post-Grant Opposition filed May 26, 2024, in corresponding Indian Patent No. 432710, Application N. 201637029569.
Post-Grant Opposition Annexure I: Complete specification, Claims & Drawings along with abstract in corresponding Indian Patent No. 432710 filed May 26, 2024.
Post-Grant Opposition Annexure II: First Examination Report (FER) dated Feb. 14, 2019 in corresponding Indian Patent No. 432710 filed May 26, 2024.
Post-Grant Opposition Annexure III: Reply dated May 15, 2019 to the First Examination Report (FER) along with Amended Specification, Amended Claims, Fresh Drawings and Marked Up Claims in corresponding Indian Patent No. 432710 filed May 26, 2024.
Post-Grant Opposition Annexure IV: Hearing Notice dated Sep. 6, 2021 in corresponding Indian Patent No. 432710 filed May 26, 2024.
Post-Grant Opposition Annexure V: Written Submissions dated Oct. 19, 2021 filed by the Patentee in relation to hearing held on Oct. 5, 2021 along with Amended Specification, Amended Claims and Marked up Claims in corresponding Indian Patent No. 432710 filed May 26, 2024.
Post-Grant Opposition Annexure VI: Petition under Rule 137 of the Patents Rules, 2003 in corresponding Indian Patent No. 432710 filed May 26, 2024.
Post-Grant Opposition Annexure VII: Extended Hearing Notice dated Dec. 30, 2022 in corresponding Indian Patent No. 432710 filed May 26, 2024.
Post-Grant Opposition Annexure VIII: Response dated Jan. 12, 2023 to Extended Hearing Notice dated Dec. 30, 2022 along with Annexures in corresponding Indian Patent No. 432710 filed May 26, 2024.
Post-Grant Opposition Annexure IX: Written Submissions dated Jan. 19, 2023 filed in relation to the hearing dated Jan. 19, 2023 in corresponding Indian Patent No. 432710 filed May 26, 2024.
Post-Grant Opposition Annexure X: Response to Official communication dated Mar. 27, 2023 along with Revised Specification and marked up amended claims submitted on May 15, 2019 & Final revised specification and marked up amended claims as submitted on Oct. 19, 2021 after attending hearing dated Oct. 5, 2021 in corresponding Indian Patent No. 432710 filed May 26, 2024.
Post-Grant Opposition Annexure XI: '710 Patent Certificate along with intimation of Grant in corresponding Indian Patent No. 432710 filed May 26, 2024.
Post-Grant Opposition Annexure XV: Notice of Opposition in EP3110271B1 dated Feb. 2, 2021 along with post grant opposition documents in corresponding Indian Patent No. 432710 filed May 26, 2024.
Post-Grant Opposition Annexure XVI: EP Opposition Board decision dated Aug. 19, 2022 wherein granted Claim 13 (same as granted claim 20 of impugned Patent) was deleted in corresponding Indian Patent No. 432710 filed May 26, 2024.
'202 Patent Prosecution History.
*Curriculum Vitae* of Dr. Seetharama Deevi.
Declaration of Charles Clemens, *Philip Morris Products SA* v. *RAI Strategic Holdings, Inc.*, IPR2020-01602, EX2010.
Declaration of Dr. Robert Sturges, *RJ Reynolds Vapor Company et al* v. *Fontem Holdings 1 BV et al.*, IPR2018-00627, EX1002.
Declaration of Dr. Robert Sturges, *RJ Reynolds Vapor Company* v. *Fontem Holdings 1 BV*, IPR2016-01270, EX1009.
Declaration of Dr. Samir Nayfeh.
Declaration of Seetharama C. Deevi, Ph.D. in Support of Petition for Post-Grant Review of U.S. Pat. No. 11,925,202, dated Aug. 13, 2024 (PGR2024-00049 Exhibit No. 1003).
Declaration of Seetharama C. Deevi, Ph.D. in Support of Petition for Inter Partes Review of U.S. Pat. No. 11,925,202, dated Aug. 13, 2024 (IPR2024-01280 Exhibit No. 1003).
Final Written Decision in IPR2020-00921, Paper 32 (PTAB Jun. 30, 2022).
Initial Determination on Violation of Section 337 And Recommended Determination on Remedy and Bond, *Certain Tobacco Heating Articles and Components Thereof*, Inv. No. 337-TA-1199 [Public Version].
Institution Decision, *Philip Morris Products SA* v. *RAI Strategic Holdings, Inc.*, IPR2020-01602, Paper 9.
Kevin Hatch, et al., Preliminary Evaluation of a Commercially Available Electric Aerosol Inhaler from China (Sep. 14, 2006) ("Sep. 2006 Ruyan Product Evaluation"), available at https://www.industrydocuments.ucsf.edu/tobacco/docs/#id=jqyy0228.
P.M. Ling and S.A. Glantz, "Tobacco industry consumer research on socially acceptable cigarettes," Tobacco Control 14, e3 (2005) (http://www.tobaccocontrol.com/cgi/content/full/14/5/e3) ("Ling").

(56) References Cited

OTHER PUBLICATIONS

Patent Owner Response in IPR2020-01602, Paper 16 (PTAB Jul. 2, 2021).
Petition for *Inter Partes* Review of U.S. Pat. No. 11,925,202, Case IPR2024-01280, submitted Aug. 13, 2024.
Petition for *Inter Partes* Review of U.S. Pat. No. 11,925,202 Pursuant to 35 U.S.C. §§ 311-319, 37 C.F.R. § 42, submitted Sep. 6, 2024.
Petition for *Inter Partes* Review, *RJ Reynolds Vapor Company et al* v. *Fontem Holdings 1 BV et al.*, IPR2018-00627, Paper 2.
Petition for *Inter Partes* Review, *RJ Reynolds Vapor Company* v. *Fontem Holdings 1 BV*, IPR2016-01527, Paper 1.
Petition for Post-Grant Review of U.S. Pat. No. 11,925,202, Case PGR2024-00049, Dated Aug. 13, 2024.
Petition in IPR2018-00627, Paper 2 (PTAB Mar. 1, 2018).
Petitioner ECTO World LLC's Power of Attorney in *ECTO WORLD, LLC and SV3, LLC*, v. *rai strategic holdings, inc.*, IPR2024-01280, 3 pages, Aug. 13, 2024.
Petitioner SV3 LLC's Power of Attorney in *ECTO WORLD, LLC and SV3, LLC*, v. *RAI STRATEGIC HOLDINGS, INC.*, IPR2024-01280, 3 pages, Aug. 13, 2024.
Petitioner's Power of Attorney in Post Grant Proceedings Before the Patent Trial and Appeal Board in IPR2024-01406, 1 p. 2024.
Reynolds' Motion for Temporary Relief [Public Version], Certain Disposable Vaporizer Devices; Inv. No. 337-TA-1410.
Petitioner ECTO World LLC's Power of Attorney in *ECTO WORLD, LLC and SV3, LLC*, v. *RAI STRATEGIC HOLDINGS, INC.*, PGR2024-00049, 3 pages, Aug. 13, 2024.
Petitioner SV3 LLC's Power of Attorney in *ECTO WORLD, LLC and SV3, LLC*, v. *RAI STRATEGIC HOLDINGS, INC.*, PGR2024-00049, 3 pages, Aug. 13, 2024.
Respondents' Notice of Prior Art for Temporary Exclusion Order Proceedings, Inv. No. 337-TA-1410, Aug. 2024.
Decision Denying Institution of *Inter Partes* Review in IPR2024-01280, *ECTO WORLD, LLC and SV3, LLC*, v. *RAI STRATEGIC HOLDINGS, INC.*, entered Mar. 6, 2025.
Decision Denying Institution of *Inter Partes* Review in PGR2024-00049, *ECTO WORLD, LLC and SV3, LLC*, v. *RAI STRATEGIC HOLDINGS, INC.*, entered Mar. 10, 2025.
Ex. 2001 from Patent Owner Preliminary Response, Complaint from ITC Investigation No. 337-TA-1410.
Ex. 2002 from Patent Owner Preliminary Response, Notice of Institution of ITC Investigation No. 337-TA-1410.
Ex. 2003 from Patent Owner Preliminary Response, Initial Determination Denying TEO, ITC Investigation No. 337-TA-1410.
Ex. 2007 from Patent Owner Preliminary Response, File History of U.S. Pat. No. 9,801,416.
Ex. 2008 from Patent Owner Preliminary Response, File History of U.S. Pat. No. 10,231,488.
Ex. 2009 from Patent Owner Preliminary Response, Complainants' Responsive Claim Construction Brief from ITC Investigation No. 337-TA-1410.
Ex. 2010 from Patent Owner Preliminary Response in IPR2024-01406, Patari & Mahapatra, Liquid Wicking in a Paper Strip: An Experimental and Numerical Study, ACS Omega 5, 22931-22939 (2020).
Ex. 2010 from Patent Owner Preliminary Response, Respondents' Opening Claim Construction Brief from ITC Investigation No. 337-TA-1410.
Ex. 2011 from Patent Owner Preliminary Response, Reinskje Talhout et al., Cigarette Design Features: Effects on Emission Levels, User Perception, and Behavior, Tob Regul Sci. Author manuscript; available in PMC, Jan. 1, 2019.
Invalidity Claim Chart—Chinese Utility Model No. 2719043 ("Hon '043")—Appendix C.
Invalidity Claim Chart—Derivation from Ruyan E-Cigar ("Ruyan E-Cigar")—Appendix D.
Invalidity Claim Chart—International Patent Appl. Pub. No. 2000/028843 ("Pienemann")—Appendix B.
Invalidity Claim Chart—Ruyan E-Cigar ("Ruyan E-Cigar") and U.S. Pat. No. 4,947,874 ("Brooks")—Appendix G.
Invalidity Claim Chart—U.S. Patent Appl. Pub. No. 2005/0205084 ("Gupta")—Appendix J.
Invalidity Claim Chart—U.S. Patent Appl. Pub. No. 2006/0016453 ("Kim")—Appendix A.
Invalidity Claim Chart—U.S. Pat. No. 5,249,586 ("Morgan")—Appendix K.
Invalidity Claim Chart—U.S. Pat. No. 6,155,268 ("Takeuchi")—Appendix H.
Invalidity Claim Chart—WIPO PCT Appl. No. WO 2006/082571A1 ("Oglesby")—Appendix I.
Invalidity Claim Chart—WIPO PCT Appl. No. WO2007/131450 ("Hon 2007")—Appendix E.
Invalidity Claim Chart—WIPO PCT Appl. No. WO2008/108889 ("Robinson 2008")—Appendix F.
Patent Owner Preliminary Response in IPR2024-01280, *ECTO WORLD, LLC and SV3, LLC*, v. *RAI STRATEGIC HOLDINGS, INC.*, dated Dec. 11, 2024.
Patent Owner Preliminary Response in IPR2024-01406, *SHENZHEN KANGVAPE TECHNOLOGY CO., LTD.*, v. *RAI STRATEGIC HOLDINGS, INC.*, dated Dec. 30, 2024.
Patent Owner Preliminary Response in PGR2024-00049, *ECTO WORLD, LLC and SV3, LLC*, v. *RAI STRATEGIC HOLDINGS, INC.*, dated Dec. 11, 2024.
Petition for *Inter Partes* Review of U.S. Pat. No. 11,925,202 Pursuant to 35 U.S.C. §§ 311-319, 37 C.F.R. § 42, dated Sep. 6, 2024.
Public Version Order No. 28: Initial Determination Denying Motion for Temporary Relief in *Certain Disposable Vaporizer Devices*, Inv. No. 337-TA-1410 (USITC Nov. 19, 2024).
Respondents' Joint Disclosure of Contentions for Which they Bear the Burden in Response to Individual Interrogatories, Inv. No. 337-TA-1410, Oct. 2024.
Respondents' Notice of Prior Art in *Certain Disposable Vaporizer Devices*, Inv. No. 337-TA-1410, Dec. 16, 2024.
Brief Communication with Letter from Opponent regarding Oral Proceedings on Oct. 15, 2024, in corresponding European Patent Application No. 20156199.0, Patent No. 3669682, dated Aug. 21, 2024.
Brief Communication regarding Interlocutory decision in Opposition proceedings with EPO form 2327, in corresponding European Patent Application No. 20156199.0, Patent No. 3669682, dated Jan. 3, 2025.
Grounds of Appeal filed on May 5, 2025, in Opposition Proceedings for corresponding European Patent Application No. 20156199.0, Patent No. 3669682.
Order No. 34: Construing Certain Terms Of The Asserted Claims Of The Patent At Issue from ITC Investigation No. 337-TA-1410, mailed Mar. 14, 2025.
Rebuttal Expert Report Of Ramon Alarcon Regarding Validity Of U.S. Pat. No. 11,925,202 from ITC Investigation No. 337-TA-1410, Dated Jan. 10, 2025. (Parts 1 & 2).
Report Of Doug Dean, PH.D. from ITC Investigation No. 337-TA-1410, dated Dec. 16, 2024. (Parts 1, 2, & 3).
Decision Granting Institution of Inter Partes Review in IPR2024-01406, U.S. Pat. No. 11,925,202 B2, Entered Mar. 20, 2025.
Order Granting Director Review, Vacating the Decision Granting Institution, and Remanding to the Patent Trial and Appeal Board for Further Proceedings in IPR2024-01406, U.S. Pat. No. 11,925,202 B2, Dated May 19, 2025.
Decision Denying Institution of Inter Partes Review on Remand in IPR2024-01406, U.S. Pat. No. 11,925,202 B2, Dated Jun. 25, 2025.
Order Granting Director Review, Vacating the Decision Denying Institution, and Remanding to the Board for Further Proceedings in IPR2024-01280, U.S. Pat. No. 11,925,202 B2, Dated May 19, 2025.
Decision Denying Institution of Inter Partes Review on Remand in IPR2024-01280, Dated Jun. 25, 2025.

* cited by examiner

CONTROL BODY FOR AN ELECTRONIC SMOKING ARTICLE

CROSS-REFERENCE TO RELATED APPLICATIONS

The present application is a continuation of U.S. application Ser. No. 16/734,982, filed Jan. 6, 2020, which is a continuation of U.S. application Ser. No. 15/815,223, filed Nov. 16, 2017, and which issued as U.S. Pat. No. 10,524,511, on Jan. 7, 2020, which is a continuation of U.S. application Ser. No. 14/193,961 filed Feb. 28, 2014, and which issued as U.S. Pat. No. 9,839,238, on Dec. 12, 2017, the disclosures of which are incorporated by reference herein in their entirety.

FIELD OF THE DISCLOSURE

The present disclosure relates to aerosol delivery devices such as smoking articles. The smoking articles may be configured to heat a material, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. Pub. No. 2013/0255702 to Griffith Jr. et al., U.S. Pat. Pub. No. 2014/0000638 to Sebastian et al., U.S. patent application Ser. No. 13/602,871 to Collett et al., filed Sep. 4, 2012, U.S. patent application Ser. No. 13/647,000 to Sears et al., filed Oct. 8, 2012, U.S. patent application Ser. No. 13/826,929 to Ampolini et al., filed Mar. 14, 2013, and U.S. patent application Ser. No. 14/011,992 to Davis et al., filed Aug. 28, 2013, which are incorporated herein by reference in their entirety.

It would be desirable to provide a smoking article that employs heat produced by electrical energy to provide the sensations of cigarette, cigar, or pipe smoking, that does so without combusting tobacco to any significant degree, that does so without the need of a combustion heat source, and that does so without necessarily delivering considerable quantities of incomplete combustion and pyrolysis products. Further, advances with respect to manufacturing electronic smoking articles would be desirable.

SUMMARY OF THE DISCLOSURE

The present disclosure relates to materials and combinations thereof useful in electronic smoking articles and like personal devices. In particular, the present disclosure relates to a control body that can include one or more elements useful to improve the function thereof.

The control body particularly can include an electronic circuit board therein that is configured for improved functioning of the device. For example, in some embodiments, the electronic circuit board is in an orientation that provides for improved communication between a pressure sensor and drawn air entering the device. This can incorporate a coupler element that includes an exterior opening that allows external air to enter the device and a pressure channel that communicates a pressure drop caused by the drawn air to an isolated segment of the device that includes a portion of the pressure sensor. Such coupler can particularly be useful to reduce or prevent passage of liquid from an attached cartridge through the coupler and into the control body and thus reduce or prevent contamination of the sensor or other electronic elements present in the control body.

In some embodiments, a control body for an electronic smoking article according to the present disclosure can comprise an elongated shell with an interior, a proximal end, and an opposing distal end. A coupler can be present and can have a body end that is in engagement with the proximal end of the shell and can have an opposing connector end that is configured to releasably engage a cartridge. An electrical power source can be included as well as an electronic circuit board, which can be positioned within the shell interior between the electrical power source and the coupler. The electronic circuit board particularly can include a control circuit, which can comprise a microcontroller, a microprocessor, or the like, and any further control components suitable for controlling power delivery from the power source and any further functions of the device. Further, the shell can have a central axis therethrough from the proximal end to the distal end, and the electronic circuit board can be oriented parallel to the central axis of the shell.

In further embodiments, the control body can comprise a pressure sensor attached to the electronic circuit board (i.e., is on the circuit board). The pressure sensor can be attached directly to the electronic circuit board, which can include a spacing factor, as further described herein. The shell interior of the control body can include a normal pressure space and a pressure reduction space, and a first end of the pressure sensor can be in fluid communication with the pressure reduction space while a second end of the pressure sensor can be in fluid communication with the normal pressure space. The body end of the coupler can include a wall, and the connector end of the coupler can have a central opening therethrough. Further, the coupler can include a pressure channel extending between a first end in fluid communication with the central opening and a second end that opens through the wall at the body end of the coupler to be in fluid communication with the pressure reduction space. In some embodiments, the pressure channel can be integrally formed in the coupler. The control body can comprise a sealing member configured to form an air tight seal around the pressure sensor and the second end of the pressure channel and thus define the pressure reduction space encompassing the opening at the second end of the pressure channel and the first end of the pressure sensor. Further, the sealing member can be in physical contact with an inner surface of the shell.

The coupler can include an air inlet channel in fluid communication with the central opening therein. In some embodiments, the air inlet channel can be formed entirely within the coupler body. An air inlet aperture can be present in the exterior surface of the coupler and be in fluid communication with the air inlet. An ambient air flow pathway can extend from the exterior of the coupler (i.e., through the air inlet aperture), through the coupler body, and through the central opening. The control circuit of the control body can be configured to establish electrical current flow from the electrical power source when the pressure sensor detects a reduced pressure in the pressure reduction space relative to the pressure in the normal pressure space. In some embodiments, the electronic circuit board can be positioned entirely within the normal pressure space.

In further embodiments, the control body can comprise at least one light emitting diode (LED) attached to the electronic circuit board. At least a portion of the coupler can be light transmissive such that light from the LED is visible through the coupler. Further, the control circuit can be configured to cause an LED to emit a defined lighting signal that corresponds to a status of the electronic smoking article. In some embodiments, the control body can comprise an input element. The control circuit can be configured to cause the at least one LED to emit the defined lighting signal in response to an input from the input element. The input element can be a manual input element (e.g., a pushbutton or touchscreen). In some embodiments, the input element can be at least partially light transmissive. The input to the LED also may be automatically generated by the control circuit in response to detecting a status of the smoking article. If desired, the control body can comprise an LED positioned at the distal end of the shell.

In other embodiments, a control body for an electronic smoking article can comprise an elongated shell with an interior, a proximal end, and an opposing distal end. The control body further can comprise a coupler formed of an elongated body having a first end that forms a wall and that engages the proximal end of the shell and a second end that comprises a cavity configured to releasably engage a cartridge, wherein the coupler includes a pressure channel extending between a first end that is in fluid communication with the cavity and a second end that opens through the wall at the first end of the coupler, wherein the coupler includes an air inlet channel in fluid communication with the cavity and an air inlet aperture in an exterior surface of the coupler, and wherein the coupler has a longitudinal axis extending from the first end to the second end, and the first end of the pressure channel is spatially separated from the air inlet channel relative to the longitudinal axis of the coupler. The control body further can comprise one or more additional components, such as a power source, a microprocessor or other control component, or the like. In some embodiments, the first end of the pressure channel in the coupler can be spatially separated from the air inlet channel so as to be relatively nearer the second end of the coupler.

In further embodiments, the present disclosure can provide an electronic smoking article. Such smoking article can comprise a control body as described herein and a cartridge comprising an aerosol precursor composition and a heater adapted to vaporize the aerosol precursor composition.

BRIEF DESCRIPTION OF THE FIGURES

Figure 1:
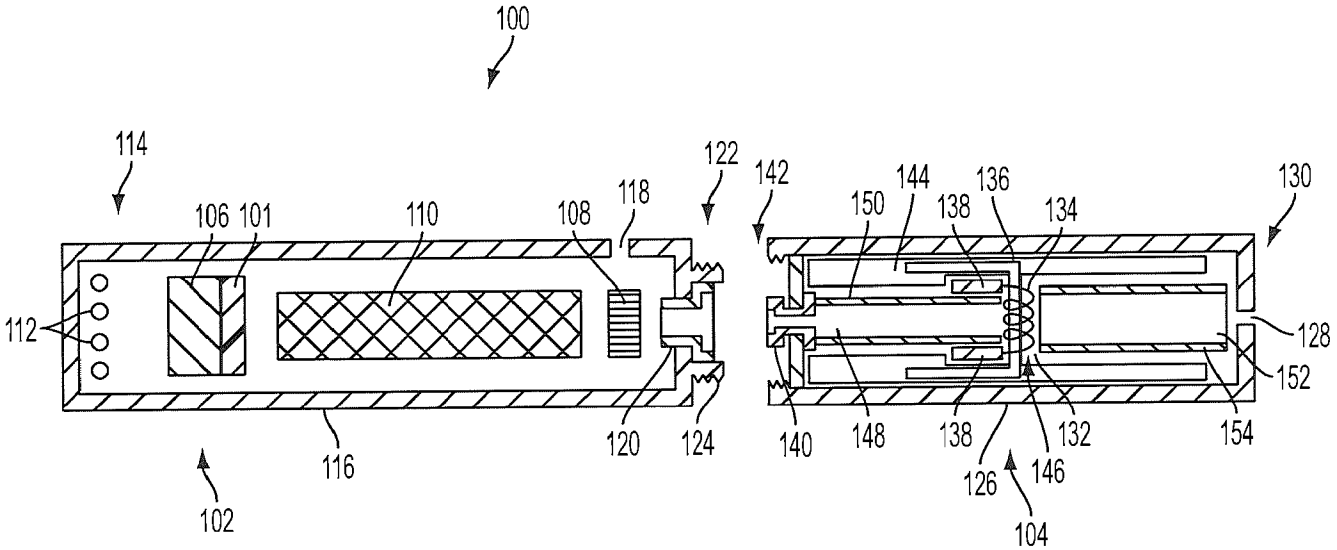
Figure 2:
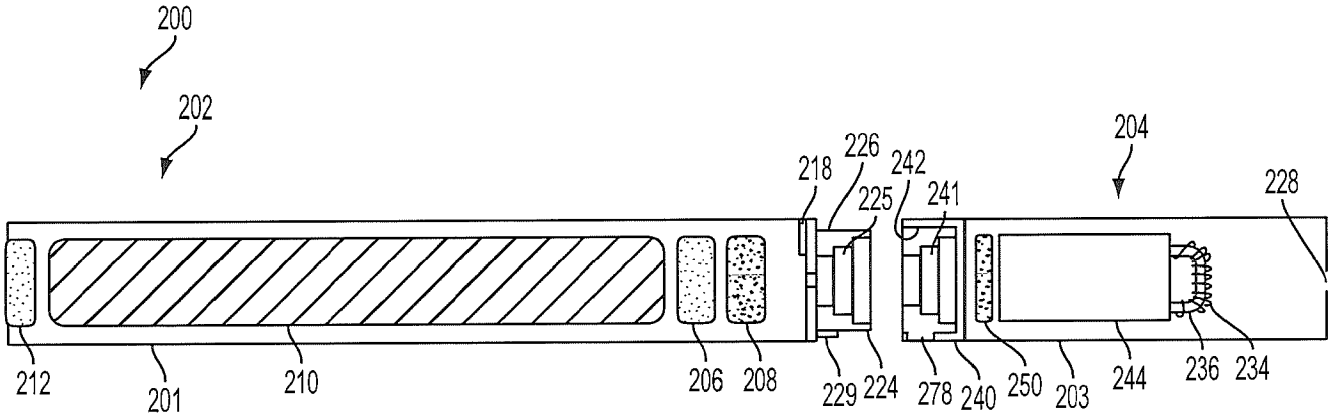
Figure 3:
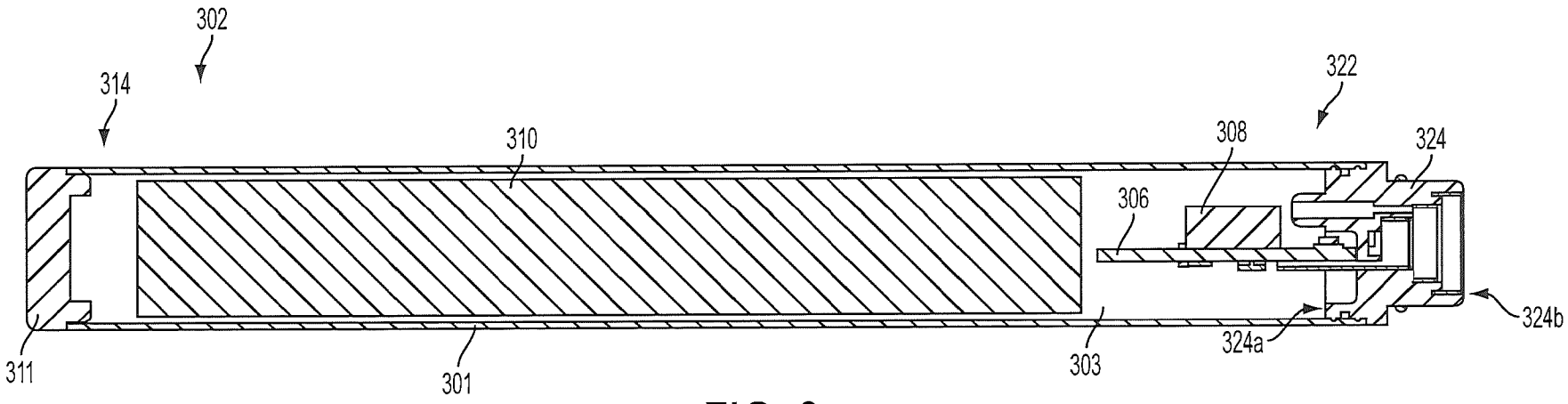
Figure 4:
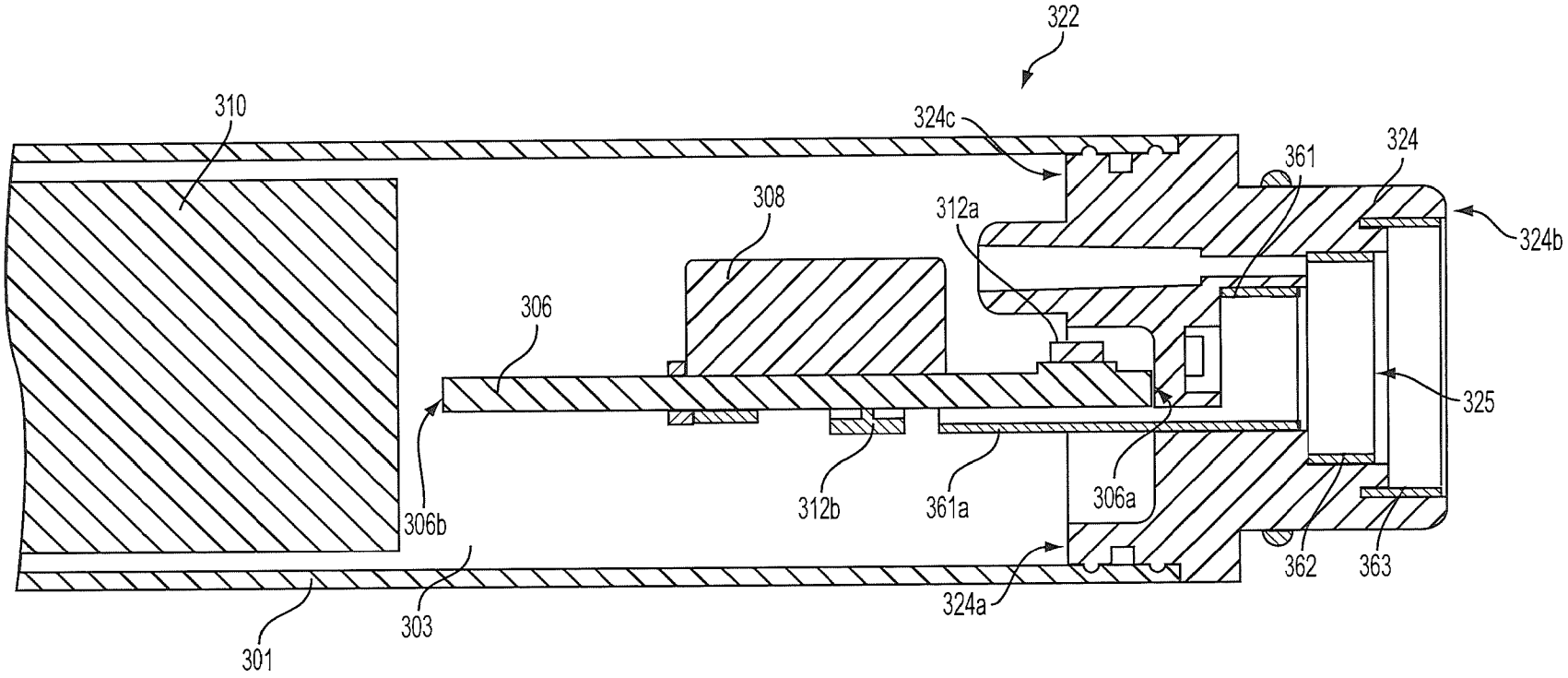
Figure 5:
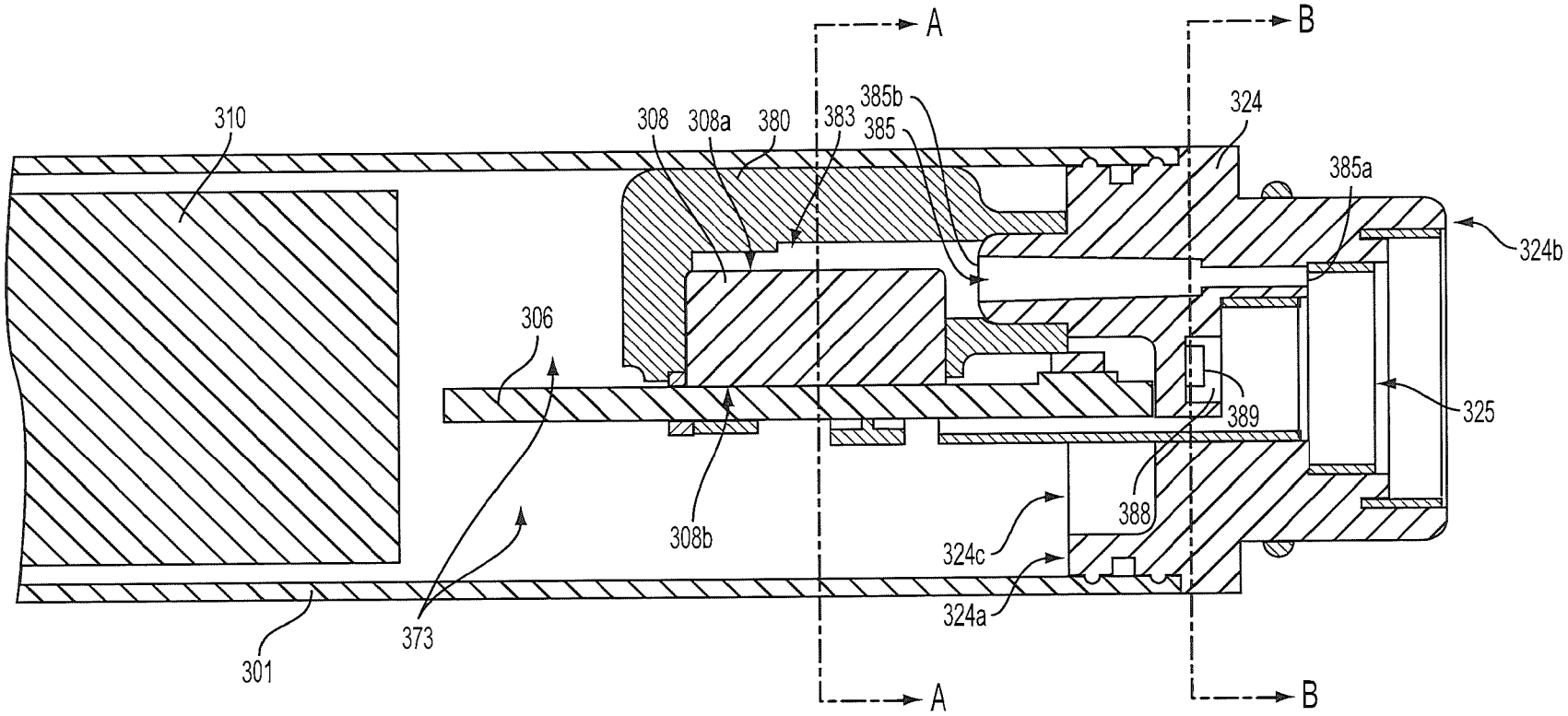
Figure 6A:
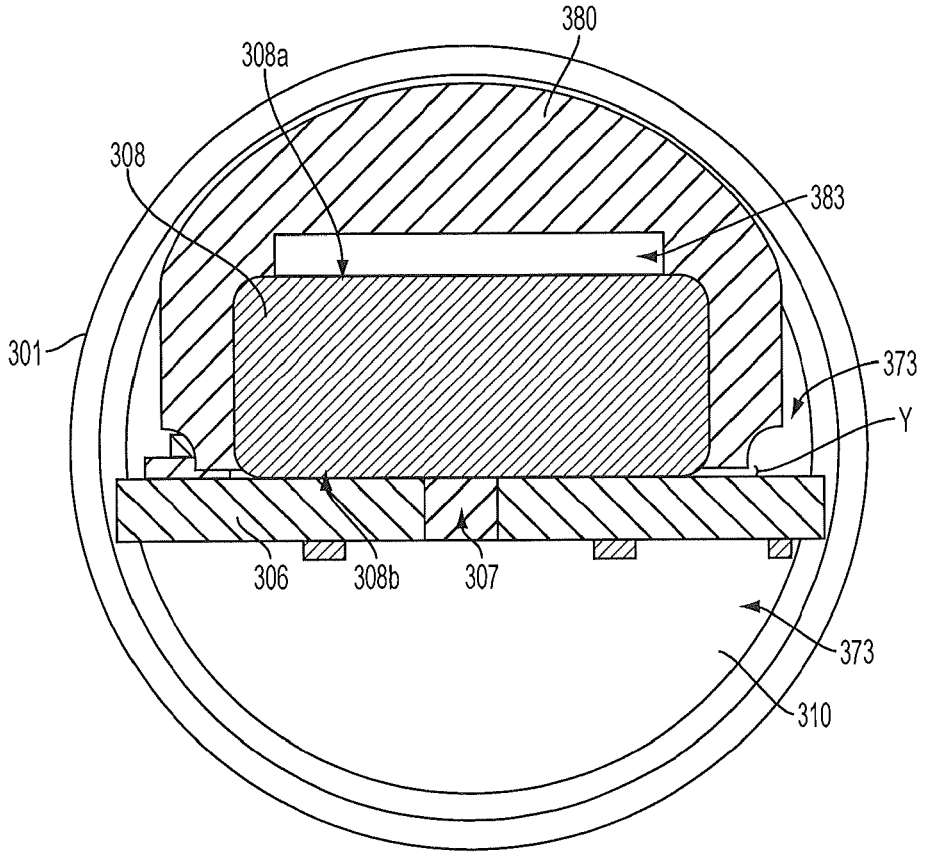
Figure 6B:
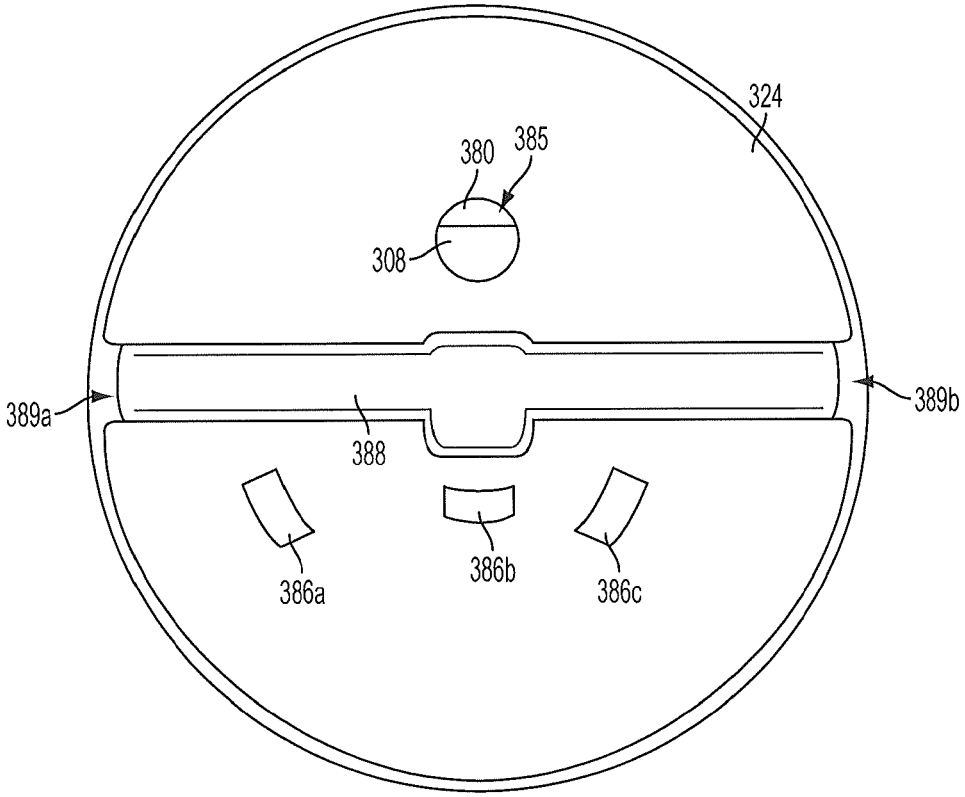
Figure 7:
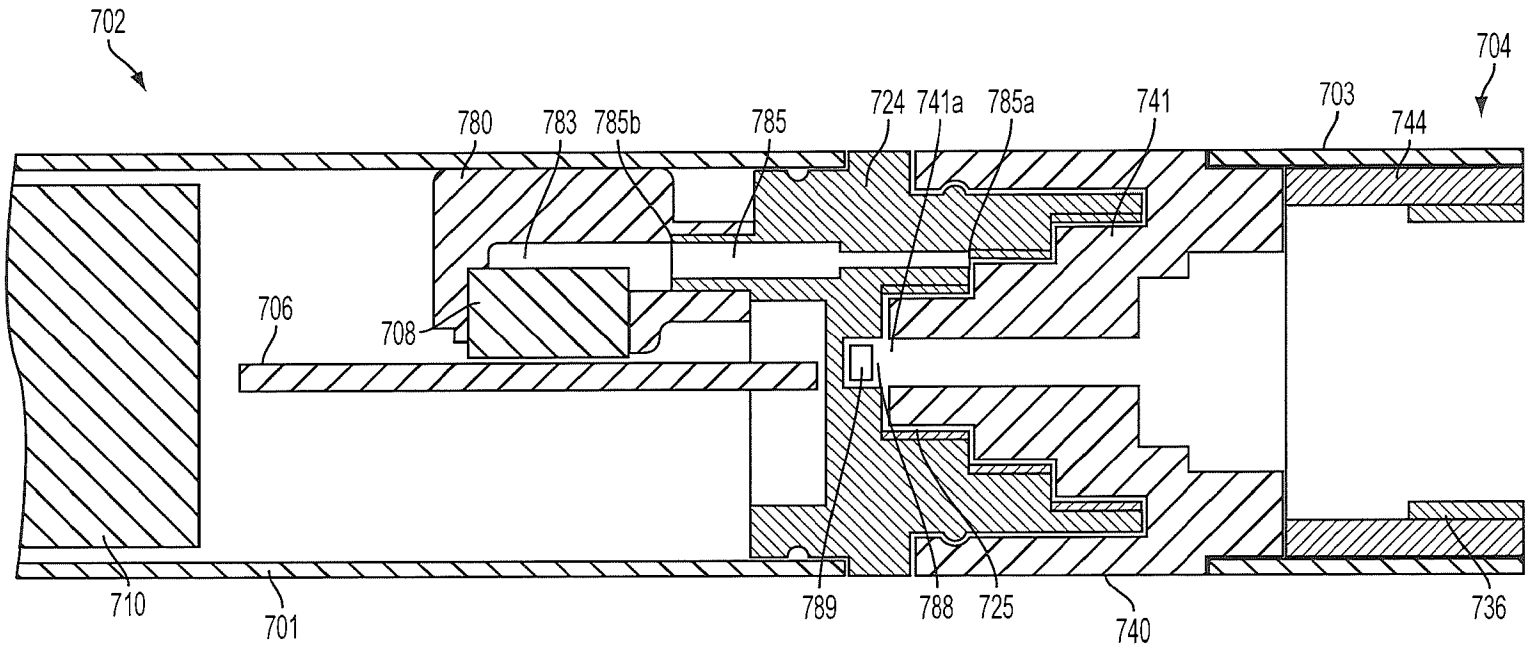
Figure 8:
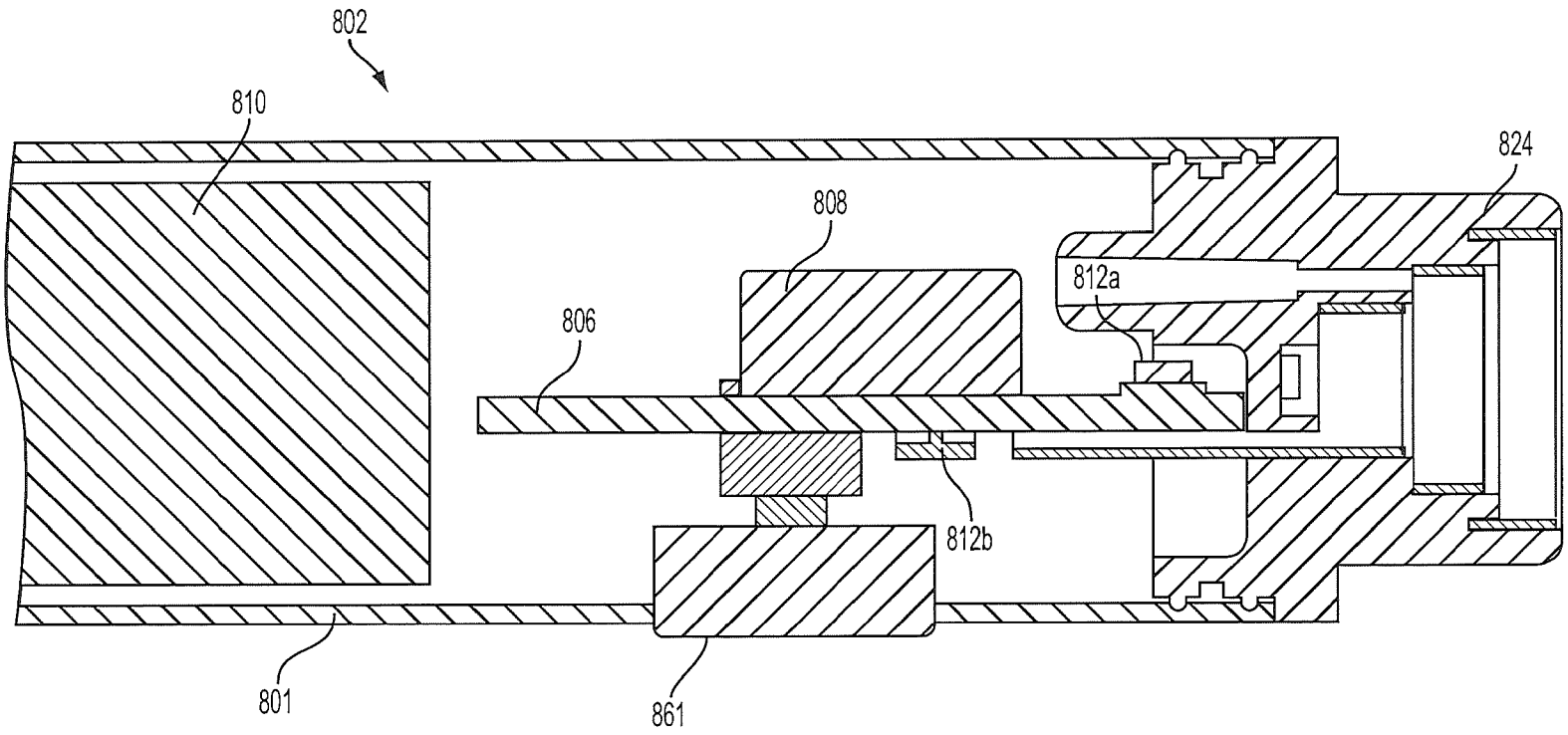
Figure 9:
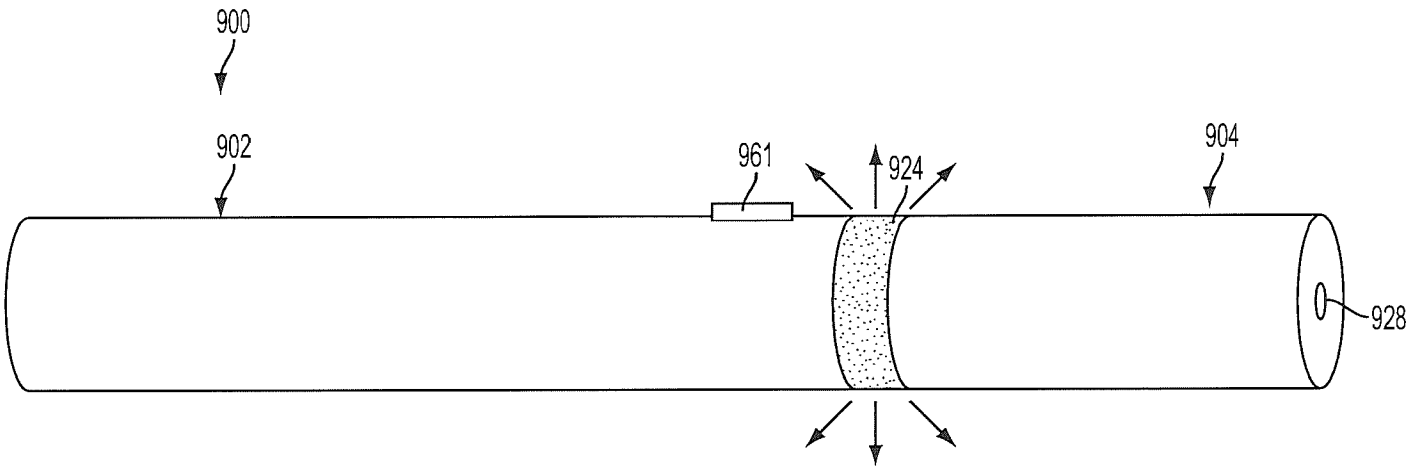

Having thus described the disclosure in the foregoing general terms, reference will now be made to the accompanying drawings, which are not necessarily drawn to scale, and wherein:

FIG. 1 is a sectional view through an electronic smoking article comprising a control body and a cartridge;

FIG. 2 is a sectional view through an electronic smoking article comprising a cartridge and a control body according to an example embodiment of the present disclosure;

FIG. 3 is a sectional view through a control body of an electronic smoking article according to an example embodiment of the present disclosure;

FIG. 4 is a detailed view of the proximal end of the control body illustrated in FIG. 3;

FIG. 5 is a detailed view of the proximal end of the control body illustrated in FIG. 3 that also illustrates a sealing member;

FIG. 6A is a cross-section through Line A-A of FIG. 5;

FIG. 6B is a cross-section through Line B-B of FIG. 5;

FIG. 7 is a partial sectional view of an electronic smoking article according a further example embodiment of the present disclosure showing a control body connected to a cartridge via the control body coupler and the cartridge base;

FIG. 8 is a sectional view of the proximal end a control body of an electronic smoking article according to a further example embodiment of the present disclosure that illustrates an input element; and FIG. 9 is a perspective view of an electronic smoking article according to an example embodiment of the present disclosure showing a control body attached to a cartridge through a light transmissive coupler.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of aerosol delivery devices or smoking articles, such as so-called "e-cigarettes." It should be understood that the mechanisms, components, features, and methods may be embodied in many different forms and associated with a variety of articles.

In this regard, the present disclosure provides descriptions of aerosol delivery devices that use electrical energy to heat a material (preferably without combusting or pyrolyzing the material to any significant degree) to form an inhalable substance; such articles most preferably being sufficiently compact to be considered "hand-held" devices. An aerosol delivery device may provide some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion or pyrolysis of any component of that article or device. The aerosol delivery device may not produce smoke in the sense of the aerosol resulting from by-products of combustion or pyrolysis of tobacco, but rather, that the article or device may yield vapors (including vapors within aerosols that can be considered to be visible aerosols that might be considered to be described as smoke-like) resulting from volatilization or vaporization of certain components of the article or device. In highly preferred embodiments, aerosol delivery devices may incorporate tobacco and/or components derived from tobacco.

Aerosol delivery devices of the present disclosure also can be characterized as being vapor-producing articles, smoking articles, or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Aerosol delivery devices of the present disclosure generally include a number of components provided within an outer body or shell. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary shell; or the elongated body can be formed of two or more separable pieces. For example, an aerosol delivery device can comprise an elongated shell or body that can be substantially tubular in shape and, as such, resemble the shape of a conventional cigarette or cigar. In one embodiment, all of the components of the aerosol delivery device are contained within one outer body or shell. Alternatively, an aerosol delivery device can comprise two or more shells that are joined and are separable. For example, an aerosol delivery device can possess at one end a control body comprising an outer body or shell containing one or more reusable components (e.g., a rechargeable battery and various electronics for controlling the operation of that article), and at the other end and removably attached thereto an outer body or shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various aerosol delivery device designs and component arrangements can be appreciated upon consideration of the commercially available electronic aerosol delivery devices, such as those representative products listed in the background art section of the present disclosure.

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., a microcontroller), a heater or heat generation component (e.g., an electrical resistance heating element or component commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthend region or tip for allowing draw upon the aerosol delivery device for aerosol inhalation (e.g., a defined air flow path through the article such that aerosol generated can be withdrawn therefrom upon draw). Exemplary formulations for aerosol precursor materials that may be used according to the present disclosure are described in U.S. Pat. Pub. No. 2013/0008457 to Zheng et al. and U.S. patent application Ser. No. 13/536,438 to Sebastian et al., filed Jun. 28, 2012, the disclosures of which are incorporated herein by reference in their entirety.

Alignment of the components within the aerosol delivery device can vary. In specific embodiments, the aerosol precursor composition can be located near an end of the article (e.g., within a cartridge, which in certain circumstances can be replaceable and disposable), which may be proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various aerosol delivery device components can be appreciated upon consideration of the commercially available electronic aerosol delivery devices, such as those representative products listed in the background art section of the present disclosure.

An aerosol delivery device incorporates a battery or other electrical power source to provide current flow sufficient to provide various functionalities to the article, such as resistive heating, powering of control systems, powering of indicators, and the like. The power source can take on various embodiments. Preferably, the power source is able to deliver sufficient power to rapidly heat the heating member to provide for aerosol formation and power the article through use for the desired duration of time. The power source preferably is sized to fit conveniently within the aerosol delivery device so that the aerosol delivery device can be easily handled; and additionally, a preferred power source is of a sufficiently light weight to not detract from a desirable smoking experience.

One example embodiment of an aerosol delivery device 100 is provided in FIG. 1. As seen in the cross-section illustrated therein, the aerosol delivery device 100 can comprise a control body 102 and a cartridge 104 that can be permanently or detachably aligned in a functioning relationship. Although a threaded engagement is illustrated in FIG. 1, it is understood that further means of engagement may be employed, such as a press-fit engagement, interference fit, a magnetic engagement, or the like. In particular, connection components, such as further described herein may be used. For example, the control body may include a coupler that is adapted to engage a connector on the cartridge. Such couplers and connectors are further discussed herein.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (i.e., cigarette lighter receptacle), and connection to a computer, such as through a universal serial bus (USB) cable. For example, an adaptor including a USB connector at one end and a control body connector at an opposing end is disclosed in U.S. patent application Ser. No. 13/840,264 to Novak et al., filed Mar. 15, 2013, which is incorporated herein by reference in its entirety. Further, in some embodiments the cartridge may comprise a single-use cartridge, as disclosed in U.S. patent application Ser. No. 13/603,612 to Chang et al., filed Sep. 5, 2012, which is incorporated herein by reference in its entirety.

In the exemplified embodiment, the control body 102 includes a control component 106 (e.g., a microcontroller), a flow sensor 108, and a battery 110, which can be variably aligned, and can include a plurality of indicators 112 at a distal end 114 of an outer body 116. The indicators 112 can be provided in varying numbers and can take on different shapes and can even be an opening in the body (such as for release of sound when such indicators are present). In the exemplified embodiment, a haptic feedback component 101 is included with the control component 106. As such, the haptic feedback component may be integrated with one or more components of a smoking article for providing vibration or like tactile indication of use or status to a user. See, for example, the disclosure of U.S. patent application Ser. No. 13/946,309 to Galloway et al., filed Jul. 19, 2013, which is incorporated herein by reference in its entirety.

An air intake 118 may be positioned in the outer body 116 of the control body 102. A coupler 120 also is included at the proximal attachment end 122 of the control body 102 and may extend into a control body projection 124 to allow for ease of electrical connection with an atomizer or a component thereof, such as a resistive heating element (described below) when the cartridge 104 is attached to the control body. Although the air intake 118 is illustrated as being provided in the outer body 116, in another embodiment the air intake may be provided in a coupler as described, for example, in U.S. patent application Ser. No. 13/841,233 to DePiano et al., filed Mar. 15, 2013.

The cartridge 104 includes an outer body 126 with a mouth opening 128 at a mouthend 130 thereof to allow passage of air and entrained vapor (i.e., the components of the aerosol precursor composition in an inhalable form) from the cartridge to a consumer during draw on the aerosol delivery device 100. The aerosol delivery device 100 may be substantially rod-like or substantially tubular shaped or substantially cylindrically shaped in some embodiments. In other embodiments, further shapes and dimensions are encompassed—e.g., a rectangular or triangular cross-section, or the like.

The cartridge 104 further includes an atomizer 132 comprising a resistive heating element 134 (e.g., a wire coil) configured to produce heat and a liquid transport element 136 (e.g., a wick) configured to transport a liquid. Various embodiments of materials configured to produce heat when electrical current is applied therethrough may be employed to form the resistive heating element 134. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), and ceramic (e.g., a positive temperature coefficient ceramic). Further to the above, representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

Electrically conductive heater terminals 138 (e.g., positive and negative terminals) at the opposing ends of the heating element 134 are configured to direct current flow through the heating element and configured for attachment to the appropriate wiring or circuit (not illustrated) to form an electrical connection of the heating element with the battery 110 when the cartridge 104 is connected to the control body 102. Specifically, a plug 140 may be positioned at a distal attachment end 142 of the cartridge 104. When the cartridge 104 is connected to the control body 102, the plug 140 engages the coupler 120 to form an electrical connection such that current controllably flows from the battery 110, through the coupler and plug, and to the heating element 134. The outer body 126 of the cartridge 104 can continue across the distal attachment end 142 such that this end of the cartridge is substantially closed with the plug 140 protruding therefrom.

A liquid transport element can be combined with a reservoir to transport an aerosol precursor composition to an aerosolization zone. In the embodiment shown in FIG. 1, the cartridge 104 includes a reservoir layer 144 comprising layers of nonwoven fibers formed into the shape of a tube encircling the interior of the outer body 126 of the cartridge, in this embodiment. An aerosol precursor composition is retained in the reservoir layer 144. Liquid components, for example, can be sorptively retained by the reservoir layer 144. The reservoir layer 144 is in fluid connection with a liquid transport element 136. The liquid transport element 136 transports the aerosol precursor composition stored in the reservoir layer 144 via capillary action to an aerosolization zone 146 of the cartridge 104. As illustrated, the liquid transport element 136 is in direct contact with the heating element 134 that is in the form of a metal wire coil in this embodiment.

It is understood that an aerosol delivery device that can be manufactured according to the present disclosure can encompass a variety of combinations of components useful in forming an electronic aerosol delivery device. Reference is made for example to the reservoir and heater system for controllable delivery of multiple aerosolizable materials in an electronic smoking article disclosed in U.S. patent application Ser. No. 13/536,438 to Sebastian et al., filed Jun. 28, 2012, which is incorporated herein by reference in its entirety. Further, U.S. patent application Ser. No. 13/602,871 to Collett et al., filed Sep. 4, 2012, discloses an electronic smoking article including a microheater, and which is incorporated herein by reference in its entirety.

Reference also is made to U.S. Pat. Pub. No. 2013/0213419 to Tucker et al., which discloses a ribbon of electrically resistive mesh material that may be wound around a wick, and to U.S. Pat. Pub. No. 2013/0192619 to Tucker et al., which discloses a heater coil about a wick wherein the coil windings have substantially uniform spacing between each winding. In certain embodiments according to the present disclosure, a heater may comprise a metal wire, which may be wound with a varying pitch around a liquid transport element, such as a wick. An exemplary variable pitch heater that may be used according to the present disclosure is described in U.S. patent application Ser. No. 13/827,994 to DePiano et al., filed Mar. 14, 2013, the disclosure of which is incorporated herein by reference in its entirety.

Reference also is made to a liquid supply reservoir formed of an elastomeric material and adapted to be manually compressed so as to pump liquid material therefrom, as disclosed in U.S. Pat. Pub. No. 2013/0213418 to Tucker et al. In certain embodiments according to the present disclosure, a reservoir may particularly be formed of a fibrous material, such as a fibrous mat or tube that may absorb or adsorb a liquid material.

In another embodiment substantially the entirety of the cartridge may be formed from one or more carbon materials, which may provide advantages in terms of biodegradability and absence of wires. In this regard, the heating element may comprise a carbon foam, the reservoir may comprise carbonized fabric, and graphite may be employed to form an electrical connection with the battery and controller. Such carbon cartridge may be combined with one or more elements as described herein for providing illumination of the cartridge in some embodiments. An example embodiment of a carbon-based cartridge is provided in U.S. Pat. Pub. No. 2013/0255702 to Griffith Jr. et al., which is incorporated herein by reference in its entirety.

In use, when a user draws on the article 100, the heating element 134 is activated (e.g., such as via a flow sensor), and the components for the aerosol precursor composition are vaporized in the aerosolization zone 146. Drawing upon the mouthend 130 of the article 100 causes ambient air to enter the air intake 118 and pass through the central opening in the coupler 120 and the central opening in the plug 140. In the cartridge 104, the drawn air passes through an air passage 148 in an air passage tube 150 and combines with the formed vapor in the aerosolization zone 146 to form an aerosol. The aerosol is whisked away from the aerosolization zone 146, passes through an air passage 152 in an air passage tube 154, and out the mouth opening 128 in the mouthend 130 of the article 100.

The various components of an aerosol delivery device according to the present disclosure can be chosen from components described in the art and commercially available. Examples of batteries that can be used according to the disclosure are described in U.S. Pat. App. Pub. No. 2010/0028766 to Peckerar et al., the disclosure of which is incorporated herein by reference in its entirety.

An exemplary mechanism that can provide puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Further description of current regulating circuits and other control components, including microcontrollers that can be useful in the present aerosol delivery device, are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

Reference also is made to International Publications WO 2013/098396 to Talon, WO 2013/098397 to Talon, and WO 2013/098398 to Talon, which describe controllers configured to control power supplied to a heater element from a power source as a means to monitor a status of the device, such as heater temperature, air flow past a heater, and presence of an aerosol forming material near a heater. In particular embodiments, the present disclosure provides a variety of control systems adapted to monitor status indicators, such as through communication of a microcontroller in a control body and a microcontroller or other electronic component in a cartridge component.

The aerosol precursor, which may also be referred to as an aerosol precursor composition or a vapor precursor composition, can comprise one or more different components. For example, the aerosol precursor can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference.

Still further components can be utilized in the aerosol delivery device of the present disclosure. For example, U.S. Pat. No. 5,154,192 to Sprinkel et al. discloses indicators that may be used with smoking articles; U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. App. Pub. No. 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,388,574 to Ingebrethsen; U.S. Pat. No. 5,666,977 to Higgins et al.; U.S. Pat. No. 6,053,176 to Adams et al.;

U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. No. 8,156,944 to Hon; U.S. Pat. No. 8,365,742 to Hon; U.S. Pat. No. 8,375,957 to Hon; U.S. Pat. No. 8,393,331 to Hon; U.S. Pat. App. Pub. Nos. 2006/0196518 and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; WO 2010/091593 to Hon; WO 2013/089551 to Foo; and U.S. Pat. Pub. No. 2013/0037041 to Worm et al., each of which is incorporated herein by reference in its entirety. A variety of the materials disclosed by the foregoing documents may be incorporated into the present devices in various embodiments, and all of the foregoing disclosures are incorporated herein by reference in their entireties.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure.

In various embodiments according to the present disclosure, an electronic smoking article, particularly a cartridge thereof, may include a reservoir housing, which can be used in addition to, or in the absence of, a porous medium. For example, a porous medium, such as the fibrous mat material, may be present inside the reservoir housing. Alternatively, the reservoir housing may form the reservoir in the absence of any porous medium inside the reservoir housing. Electronic smoking articles incorporating reservoir housings are particularly described in U.S. patent application Ser. No. 14/087,594 to Chang et al., filed Nov. 22, 2013, the disclosure of which is incorporated herein by reference in its entirety.

Any of the elements shown in the article illustrated in FIG. 1 or as otherwise described above may be included in a smoking article according to the present disclosure. In particular, any of the above described and illustrated components of a control body can be incorporated into a control body according to the present disclosure An exemplary embodiment of a smoking article 200 according to the present disclosure is shown in FIG. 2. As illustrated therein, a control body 202 can be formed of a control body shell 201 that can include a control component 206, a flow sensor 208, a battery 210, and an LED 212. A cartridge 204 can be formed of a cartridge shell 203 enclosing the reservoir housing 244 that is in fluid communication with a liquid transport element 236 adapted to wick or otherwise transport an aerosol precursor composition stored in the reservoir housing to a heater 234. An opening 228 may be present in the cartridge shell 203 to allow for egress of formed aerosol from the cartridge 204. Such components are representative of the components that may be present in a cartridge and are not intended to limit the scope of cartridge components that are encompassed by the present disclosure.

Although the control component 206 and the flow sensor 208 are illustrated separately, it is understood that the control component and the flow sensor may be combined as an electronic circuit board with the air flow sensor attached directly thereto. Further, the electronic circuit board may be positioned horizontally relative the illustration of FIG. 2 in that the electronic circuit board can be lengthwise parallel to the central axis of the control body.

The cartridge 204 also may include one or more electronic components 250, which may include an IC, a memory component, a sensor, or the like. The electronic component 250 may be adapted to communicate with the control component 206.

The control body 202 and the cartridge 204 may include components adapted to facilitate a fluid engagement therebetween. As illustrated in FIG. 2, the control body 202 can include a coupler 224 having a cavity 225 therein. The cartridge 204 can include a base 240 adapted to engage the coupler 224 and can include a projection 241 adapted to fit within the cavity 225. Such engagement can facilitate a stable connection between the control body 202 and the cartridge 204 as well as establish an electrical connection between the battery 210 and control component 206 in the control body and the heater 234 in the cartridge. Further, the control body shell 201 can include an air intake 218, which may be a notch in the shell where it connects to the coupler 224 that allows for passage of ambient air around the coupler and into the shell where it then passes through the cavity 225 of the coupler and into the cartridge through the projection 241.

A coupler and a base useful according to the present disclosure are described in U.S. patent application Ser. No. 13/840,264 to Novak et al., filed Mar. 15, 2013, the disclosure of which is incorporated herein by reference in its entirety. For example, a coupler as seen in FIG. 2 may define an outer periphery 226 configured to mate with an inner periphery 242 of the base 240. In one embodiment the inner periphery of the base may define a radius that is substantially equal to, or slightly greater than, a radius of the outer periphery of the coupler. Further, the coupler 224 may define one or more protrusions 229 at the outer periphery 226 configured to engage one or more recesses 278 defined at the inner periphery of the base. However, various other embodiments of structures, shapes, and components may be employed to couple the base to the coupler. In some embodiments the connection between the base 240 of the cartridge 204 and the coupler 224 of the control body 202 may be substantially permanent, whereas in other embodiments the connection therebetween may be releasable such that, for example, the control body may be reused with one or more additional cartridges that may be disposable and/or refillable.

The coupler may further comprise a plurality of electrical contacts configured to contact terminals associated with the base projection. The electrical contacts may be positioned at differing radial distances in the cavity 225 of the coupler 224 and positioned at differing depths within the coupler. The depth and radius of each of the electrical contacts is configured such that the end of the terminals come into contact therewith when the base and the coupler are joined together to establish an electrical connection therebetween. For example, a first electrical contact can define the smallest diameter, a third electrical contact can define the greatest diameter, and a second electrical contact can define a diameter therebetween. Further, the electrical contacts can be located at differing depths within the connector relative to a connector end thereof. For example, a first electrical contact can be located at a greatest depth, a third electrical contract can be located at a smallest depth, and a second electrical contact can be located at a depth therebetween. The electrical contacts may comprise circular metal bands of varying radii positioned at differing depths within the coupler. See, for example, the electrical contacts illustrated in FIG. 4.

In particular embodiments according to the present disclosure, the coupler utilized with the shell of the control body may be configured to provide for additional or improved functionalities, particularly in relation to communications between the coupler and a control component within the control body. This can arise from a desired configuration of an electronic circuit board within the shell in relation to the coupler. For example, referring to FIG. 3, a control body 302 useful with an electronic smoking article can comprise a shell 301 with an interior 303, a proximal end 322, and an opposing distal end 314. The control body 302 further includes a coupler 324 having a body end 324*a* in engagement with the proximal end 322 of the shell 302 and an opposing connector end 324*b* configured to releasably engage a cartridge. An end cap 311 is shown engaging the distal end 314 of the shell 302. The control body 302 also includes a battery 310 and an electronic circuit board 306 positioned within the interior 303 of the shell 301 between the battery 310 and the coupler 324. The electronic circuit board can include a control circuit, memory, microprocessors, and/or the like. As illustrated in FIG. 3, the shell 301 has a central axis extending along the length of the shell 301. In some embodiments, the electronic circuit board 306 can be oriented as illustrated in FIG. 3 to be substantially parallel to the central axis of the shell 301. In other words, the electronic circuit board can have a thickness and a length such that the length is greater than the thickness, and the electronic circuit board can be positioned lengthwise within the shell to be substantially parallel to the central axis of the shell. An electronic circuit board can be considered to be substantially parallel to the central axis of the shell when the alignment deviates from parallel by less than 45 degrees, less than 30 degrees, or less than 15 degrees. In such alignment, the functional surface(s) of the electronic circuit board to which working components may be attached face the shell wall, and thus the functional surface(s) of the electronic circuit board is substantially perpendicular to the central axis of the shell. In embodiments wherein an electronic circuit board is positioned substantially perpendicular to the central axis of the shell, the surface area of the electronic circuit board to which components may be attached can be limited. As illustrated in FIG. 3, however, positioning the electronic circuit board to be substantially parallel to the central axis of the shell makes a most efficient use of space within the shell and allows for an increased surface area for the electronic circuit board for attachment of components, such as a microprocessor, LED's, and other control components.

The electronic circuit board 306 can include a pressure sensor 308 attached directly thereto. A direct attachment in this sense is intended to mean a connection whereby the pressure sensor can be electrically connected to the electronic circuit board via integrated components (e.g., pins) as opposed to a wired connection. Previous devices incorporating a pressure sensor and an electronic circuit typically have the pressure sensor spaced a significant distance from the electronic circuit board, and the electrical connection therebetween is formed using wires attached to the pressure sensor and the electronic circuit board. In the present configurations, the need for a wired connection between an electronic circuit board and a pressure sensor can be eliminated. This can reduce expense associated with hand soldering of wired connections and improve reliability associated with the assembly process. In some embodiments, a direct connection can encompass the use of an intermediate attachment element or spacer (e.g., a spacer attached directly to the electronic circuit board and a pressure sensor attached directly to the spacer). The direct attachment can mean that the electrical contacts or pins of the pressure sensor are in direct contact with the electronic circuit board although the body of the pressure sensor may be spaced apart from the electronic circuit board. A substantially direct attachment between the pressure sensor and the electronic circuit board can encompass any attachment whereby the body of the pressure sensor is spaced apart from the electronic circuit board by less than 50% of the diameter of the shell 301, less than 25% of the diameter of the shell, less than 10% of the diameter of the shell, or less than 5% of the diameter of the shell. For example, the spacing can 5 mm or less, 2 mm or less, or 1 mm or less. As illustrated, the pressure sensor 308 has a central axis extending between a first, free end and a second end attached to the electronic circuit board 306 (308*a* and 308*b*, as illustrated in FIG. 5). This central axis of the pressure sensor 308 is substantially perpendicular to the central axis of the shell 301.

The positioning of the electronic circuit board is more clearly seen in the partial section shown in FIG. 4. As seen therein, the electronic circuit board 306 is positioned within the shell 301 between the battery 310 and the coupler 324 such that the lengthwise axis of the electronic circuit board is substantially parallel to the central axis of the shell. As such, the electronic circuit board 306 has a first end 306*a* that is adjacent the coupler 324 and a second end 306*b* that is adjacent the battery 310. The electronic circuit board may be at least partially within the coupler. As such, the electronic circuit board may be attached (e.g., interference fit, glued, or otherwise affixed) to the coupler. Alternatively, the electronic circuit board may be interconnected with the coupler through an intermediate attachment, such as the extension 361*a* of the first electrical contact 361 (as more fully discussed below).

In the embodiment illustrated, the first end 306*a* of the electronic circuit board 306 is located within the coupler 324, and this can provide various advantages as is evident from the further disclosure herein. For example, such location can facilitate ease of connection between the electronic circuit board and the electrical contacts in the coupler. As seen in FIG. 4, a first electrical contact 361, a second electrical contact 362, and a third electrical contact 363 are provided as bands encircling the central opening 325 (or cavity) in the connector end 324*b* of the coupler 324. Visible in FIG. 4 is an extension 361*a* of the first electrical contact 361 extending between the contact and the electronic circuit board 306 and passing through the coupler 324. A second electrical contact extension and a third electrical contact extension also are present but not visible in the illustration.

The orientation of the electronic circuit board also is beneficial in that the interior 303 of the shell 301 can be partitioned into different spaces or sections that can experience different pressures. For example, the shell interior can include a normal pressure space and a pressure reduction space. The normal pressure space can be maintained at ambient pressure and experience no significant change in pressure related to use of the control body in an electronic smoking article. Normal pressure can be maintained with an opening in the shell 301 to the surrounding atmosphere. For example, the end cap 311 can be arranged to allow communication between the normal pressure space of the shell and the surrounding atmosphere. Such pressure communication between the normal pressure space and the surrounding atmosphere can be facilitated with an opening located elsewhere on the shell 301 and/or around the connection of the coupler 324 with the shell. The pressure reduction space can be isolated from the normal pressure space, and the pressure within the pressure reduction space can be reduced below the pressure in the normal pressure space during use of the article (i.e., during draw on the article).

In the embodiment illustrated in FIG. 5, a first end 308*a* of the pressure sensor 308 can be positioned to be in fluid communication with the pressure reduction space 383, and a second end 308*b* of the pressure sensor can be positioned to be in fluid communication with the normal pressure space 373. In some embodiments, the pressure reduction space can be defined by a sealing member 380. For example, the sealing member can comprise a silicone rubber or like material. In some embodiments, the sealing member may be a cup seal. The sealing member 380 can substantially surround the perimeter of the pressure sensor 308 and be in a sealing contact therewith. As illustrated, the pressure sensor 308 is directly attached to the electronic circuit board 306, but the sealing member 380 does not extend completely down the length of the pressure sensor and thus does not form a sealing contact with the electronic circuit board. As such, the second end 308*b* of the pressure sensor 308 and the electronic circuit board 306 are positioned within the normal pressure space 373.

This configuration is further seen in the cross-section of FIG. 6A where the pressure sensor 308 is directly attached to the electronic circuit board 306. The sealing member 380 surrounds the top and perimeter of the pressure sensor 308 but does not contact the electronic circuit board 306. The gap "Y" between the sealing member 380 and the electronic circuit board 306 maintains the second end 308*b* of the pressure sensor 308 within the normal pressure space 373 while the first end 308*a* of the pressure sensor is within the pressure reduction space 383. To ensure that the second end 308*b* of the pressure sensor 308 is maintained at ambient pressure, the direct connection of the pressure sensor to the electronic circuit board 306 can encompass a spacing factor, as otherwise discussed herein. As such, the second end 308*b* of the pressure sensor 308 may be prevented from forming an air tight seal with the electronic circuit board 306. Alternatively or in combination, an aperture 307 may be formed in the electronic circuit board 306 adjacent the second end 308*b* of the pressure sensor 306 to provide pressure communication between the second end of the pressure sensor and the normal pressure space 373.

The coupler 324 also can include a pressure channel 385 that opens into the pressure reduction space 383. As illustrated in the embodiment of FIG. 5, the body end 324*a* of the coupler 324 includes a wall 324*c* that can include one or more openings or channels therethrough. For example, the coupler wall 324*c* can include the pressure channel 385 and apertures that accommodate passage of the electrical contact extensions. The body end 342*a* of the coupler 324 thus can be described has having a wall 324*c* through which the pressure channel 385 can extend.

The connector end 324*b* of the coupler 324 has a cavity 325. The cavity 325 can be sized and shaped to receive a projection formed in the base of the cartridge (see FIG. 2). More particularly, the pressure channel can extend between a first end 385*a* that is in fluid communication with the cavity 325 and a second end 385*b* that opens through the wall 324*c* at the body end 324*a* of the coupler 324 to be in fluid communication with the pressure reduction space 383. The pressure channel can be integrally formed in the coupler, although other means of providing the channel also are encompassed. For example, a separate tube can be inserted through the coupler, or an aperture may be created in the coupler body.

As seen in FIG. 5, the second end 385*b* of the pressure channel 385 can project into the interior of the shell 301, and the sealing member 380 can substantially surround the perimeter of the second end of the pressure channel. If desired, the second end 385*b* of the pressure channel 385 may be flush with the wall 324*c* at the body end 324*a* of the coupler 324, and a sealing engagement may be made between the sealing member 380 and the wall at the body end of the coupler around the second end of the pressure channel. Preferably, the sealing member 380 is configured to form an air tight seal around the first end 308*a* of the pressure sensor 308 and the second end 385*b* of the pressure channel 385. As such, the pressure reduction space can encompass the opening at the second end 385*b* of the pressure channel and the first end 308*a* of the pressure sensor 308. In some embodiments, the sealing member 380 can be in physical contact with an inner surface of the shell 301.

In some embodiments, the coupler 324 can include an air inlet channel 388 that can be adapted to distribute drawn, ambient air through an electronic smoking article including the coupler. The air inlet channel 388 particularly can be in fluid communication with the cavity 325. Drawn, ambient air can enter the air inlet channel 388 through an air inlet aperture 389 that opens through the outer surface of the coupler.

The configuration of the air inlet channel 388 is further illustrated in the cross-section of FIG. 6B where the air inlet channel extends across the diameter of the coupler 324 between a first air inlet aperture 389*a* and a second air inlet aperture 389*b*. The air inlet apertures open through the exterior surface of the coupler and provide an entry for ambient air to be drawn into the coupler to be distributed to other portions of an electronic smoking article utilizing the coupler. In other embodiments, the air inlet channel may extend only across a portion of the coupler, may be branched, may open to only a single air inlet aperture, or may open to more than two air inlet apertures. In certain embodiments, the air inlet channel can be formed entirely within the coupler body.

In FIG. 6B, the pressure sensor 308 can be seen through the pressure channel 385. Also visible through the pressure channel 385 is the interior surface of the sealing member 380 that defines the pressure reduction space 383 at the first end 308*a* of the pressure sensor 308. The cross-section of FIG. 6B further illustrates three openings (386*a*, 386*b*, and 386*c*) through which the electrical contact extensions may pass.

As seen in FIG. 5, the first end 385*a* of the pressure channel 385 extends beyond the air inlet channel 388 toward the connector end 324*b* of the coupler 324. In other words, the first end 385*a* of the pressure channel 385 is positioned closer to the connector end 324*b* of the coupler 324 than the air inlet channel 388. This configuration can be useful to prevent backflow of liquids or vapors into the control body. The first end 385*a* of the pressure channel 385 also can have a diameter that is smaller than the diameter of the second end 385*b* of the pressure channel. Similarly, the pressure channel 385 may increase in diameter from the first end 385*a* to the second end 385*b* thereof.

In light of the above-described configuration, the coupler 324 may define an ambient air flow pathway therethrough. In some embodiments, the ambient air flow pathway can extend from the exterior of the coupler 324 (e.g., through one or more air inlet apertures 389), through the air inlet channel 388 in the coupler body 324, and through the cavity 325. The air flow pathway further can extend into a cartridge that is attached to the coupler (such as through a cartridge base, as shown in FIG. 2) and out of the cartridge, such as through an opening in an opposing end thereof (see element 228 in FIG. 2).

The spatial relationship of the air inlet channel and the first end of the pressure channel is further illustrated in FIG. 7. As seen therein, a control body 702 is engaged with a cartridge 704 via a coupler 724 on the control body and a base 740 on the cartridge. The coupler 724 includes a cavity 725 that receives a projection 741 on the base 740. As illustrated, the cavity 725 and the projection 741 each have a stepped configuration such that rings of successively smaller diameter are present in the cavity, and corresponding projection segments of successively smaller diameter are present on the base. The projection 741 includes an air flow entry 741*a* that seats in the cavity 725 of the coupler 724 proximate the air inlet channel 788. The coupler 724 further includes a pressure channel 785 having a first end 785*a* opening within the cavity 725 of the coupler and a second end 785*b* opening within the control body 702, particularly within the pressure reduction space 783. The first end 785*a* of the pressure channel 785 is spatially arranged relative to the air inlet channel 788 to be separated along the longitudinal axis of the coupler 724 (and thus also the shell 701 of the control body 702). The longitudinal separation can be at least about 1 mm, at least about 2 mm, or at least about 3 mm.

When the cartridge 704 engages the control body 702, air draw on the mouthend of the cartridge (see element 130 in FIG. 1) causes air to enter the air inlet channel 788 of the coupler 724 through one or more air inlet apertures 789 and flow into the air flow entry 741*a* of the projection 741 from which the drawn air passes through the interior of the base 740 and into the cartridge 704. Air flow through the device thus can proceed from the air inlet channel 788 downstream toward the mouthend of the cartridge 704. The longitudinal separation of the first end 785*a* of the pressure channel 785 and the air inlet channel 788 is such that the first end of the air inlet channel is downstream from the air inlet channel. In other words, the first end 785*a* of the pressure channel 785 and the air inlet channel 788 are spatially arranged and separated such that the first end of the pressure channel is relatively nearer to the connector end 324*b* of the coupler. Likewise, when the projection 741 of the base 740 engages the cavity 725 of the coupler 724, the air flow entry 741 seats upstream in the cavity from the first end 785*a* of the pressure channel 785. As such, the distance between the air flow entry 741 and the first end 785*a* of the pressure channel 785 when the projection 740 engages the cavity 725 can be at least about 1 mm, at least about 2 mm, or at least about 3 mm.

When draw on the device causing air to enter the air inlet channel 788 through the air inlet aperture 789 causes a pressure drop, such pressure drop is communicated to the cavity 725. The matched configuration of the cavity 725 and the projection 741 preferably does not substantially form an air tight connection therebetween. Thus, the pressure drop in the cavity 725 is likewise communicated to the pressure channel 785 from the first end 785*a* to the second end 785*b* and thus the pressure reduction space 783. Because of the spatial arrangement of the air inlet channel 788 and the first end 785*a* of the pressure channel 785, however, the air flow entry 741 of the seated projection 740 is sufficiently spaced apart from the first end of the pressure channel to prevent or reduce incidence of passage of liquid from the cartridge 704 through the base 740 and into the control body 702.

In use, an individual may draw on the mouthend of a cartridge (which may include a mouthpiece), and air flow may be established along an air flow pathway, such as described above. Drawn air enters the air inlet channel through the air inlet aperture. The air inlet channel can present a restriction to the flow of air so that the pressure on the interior of the coupler is lower than ambient pressure (and thus lower than the normal pressure space within the control body shell). This reduced pressure is transmitted to the pressure sensor in the control body shell by the pressure channel formed in the coupler. In this manner, a pressure differential can be created across the pressure sensor between the first end of the pressure sensor in the pressure reduction space and the second end of the pressure sensor in the normal pressure space within the shell. More particularly, the control circuit can be configured to establish electrical current flow from the electrical power source when the pressure sensor detects a reduced pressure in the pressure reduction space relative to the pressure in the normal pressure space. Such electrical current flow can energize a heater in the cartridge to vaporize the aerosol precursor composition. By utilizing the pressure channel, air entering the coupler is not required to pass through the control body shell, such as would be required in devices having an air inlet formed in the shell of the control body.

As noted above, the spatial arrangement of openings in the coupler can be beneficial in preventing passage of any aerosol precursor composition from a cartridge into the interior of the control body. When a cartridge is attached to the control body, any aerosol formed within the cartridge that is not withdrawn by the user can condense. Likewise, water vapor may condense within the cartridge and/or liquid stored in a reservoir within the cartridge may leak within the cartridge. In some instances, such liquids can pass from the cartridge through any air opening that is present to provide passage of drawn air from the control body to the cartridge. When an inlet for drawn air is present in the control body shell, the air flow passage between the air inlet and the cartridge necessarily extends through at least a portion of the control body. Any liquid passing out of the cartridge through the air flow passage thus can enter the control body where the liquid can contact the power source, pressure sensor, or control components of the device and cause damage to the control body.

According to the present disclosure, however, when a cartridge engages the control body, the air flow entry on the projection of the cartridge's base is seated upstream from the first end of the pressure channel. Thus, any liquid passing through the air flow entry in the cartridge's base projection would only enter the air inlet channel in the coupler where it can pass out of the coupler through the air inlet aperture or simply flow back into the cartridge.

Referencing FIG. 4, the electronic circuit board 306 can include a variety of elements in addition to the pressure sensor 308. As illustrated, the electronic circuit board 306 further includes a first light emitting diode (LED) 312*a* and a second LED 312*b*. A microprocessor, memory, and the like also may be present on the electronic circuit board. The electronic circuit board may include any elements suitable for establishing a control circuit suitable for controlling one or more functions of an electronic smoking article or the like.

In some embodiments, one or more LEDs on the electronic circuit board may be adapted to emit light that is visible exterior to the control body. For example, at least a portion of the control body shell and/or the coupler can be translucent or otherwise light transmissive. The embodiment of a control body 802 illustrated in FIG. 8 comprises an electronic circuit board 806 positioned within a shell 801 between a battery 810 and a coupler 824. The electronic circuit board 806 is configured lengthwise such that it is substantially parallel with a central axis of the shell 801. The electronic circuit board 806 comprises a first LED 812*a* and a second LED 812*b*. Further, in the illustrated embodiment, the coupler 824 is light transmissive such that light from the first LED 812*a* and/or light from the second LED 812*b* is visible external to the control body through the coupler. The coupler may be formed, for example, from a translucent thermoplastic material. The control body 802 further can include an input element, such as a pushbutton 861, which can be adapted to activate power delivery from the power source in the control body to a heater, such as in an attached cartridge (see FIG. 2). The input element alternatively can be adapted to active a further control function of the device, such as described in greater detail below.

As seen in FIG. 9, when the control body 902 is attached to a cartridge 904, the coupler 924 forms a visible ring around the smoking article 900. When an LED on the electronic circuit board is activated, light is emitted through the coupler ring, as shown by the arrows in FIG. 9. The light emitted can be decorative in nature. In some embodiments, the control circuit can be configured to cause at least one LED to emit a defined lighting signal that corresponds to a status of the electronic smoking article.

The lighting signal can be defined by a color, a series of different colors, a blinking light of a single color or a series of different colors, or by a specified number of blinks of a light of a single color or a series of different colors. The status of the electronic smoking article can include any status associated with an electronic smoking article including, but not limited to battery power status, volume of aerosol precursor composition remaining in a cartridge, number of puffs remaining for a cartridge, a working status, an error code, heater activation, or the like. The control circuit may be configured to automatically activate the lighting signal upon detecting a defined input. For example, when a battery is depleted to half power, a power depletion input may be received by the control circuit, and the control circuit may cause an LED to emit a defined lighting signal to alert the user of the battery status. As a further, non-limiting example, a defined lighting signal may be automatically activated every time a user draws on the device and activates the heater. The control element may include programming for activating any number of lighting signals automatically in response to an input. The input may be an electronic signal that is automatically generated in response to programming of the control circuit.

In some embodiments, the control body can include an input element. The input element, may be an element adapted for manual activation by a user. A pushbutton 961 as illustrated in FIG. 9 is an example of a manual input element. In other embodiments, a manual input element may be a resistive sensing device or a capacitive sensing device including, but not limited to, a touchscreen. A manual input element can provide an input or a plurality of inputs to the control circuit, which in turn transmits an input to an LED. The manual input may be adapted to provide one input or a plurality of different inputs to generate a lighting signal indicative of a status of the electronic smoking article. As a non-limiting example, a single push of a button or tap on a touchscreen may generate a lighting signal providing a battery status, and two rapid pushes of the button or taps on the touchscreen in succession may generate a lighting signal indicating the number of puffs remaining for a cartridge attached to the control body. The control element may include programming for activating any number of lighting signals in response to a variety of manual inputs to indicate a number of statuses of the device.

In some embodiments, an input element (e.g., a pushbutton) can be at least partially light transmissive. As such, a lighting signal generated as discussed above may be visible through the input element as well as the coupler or instead of the coupler. For example, a lighting signal indicating one status may be visible through the input element, and a lighting signal indicating a second, different status may be visible through the coupler. If desired, an LED may also be positioned at the distal end of the control body shell (see element 212 in FIG. 2), and such LED likewise may be adapted to emit a lighting signal.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A control body for an electronic smoking article, which is engageable with a cartridge in a functioning relationship, the control body comprising:

an elongated shell having a longitudinal axis extending through a center of the elongated shell;

an electrical power source within the elongated shell;

an electronic circuit board within the elongated shell, the electronic circuit board being oriented substantially parallel to the longitudinal axis of the elongated shell;

an input element adapted for activation by a user of the control body, the input element being configured to cause power to be delivered from the electrical power source to a further element;

a coupler that has a connector end and extends into the elongated shell to an opposing body end defined by a bottom wall extending internally toward the center of the elongated shell and that separates a cavity formed by the bottom wall in the coupler from an interior space in the control body, and the connector end of the coupler being configured to releasably engage the cartridge; and an air inlet channel formed in the coupler, the air inlet channel being configured to distribute drawn, ambient air to the cavity, wherein one or more projection segments are arranged peripherally around the bottom wall and extending upward therefrom toward the cavity such that the cartridge is spaced apart from the bottom wall when the cartridge is engaged with the connector end of the coupler to distribute the drawn ambient air to the cavity.

2. The control body according to claim 1, comprising at least one light emitting diode attached to the electronic circuit board.

3. The control body according to claim 2, comprising a control circuit that is configured to cause the at least one light emitting diode to emit a defined lighting signal that corresponds to a status of the electronic smoking article.

4. The control body according to claim 3, wherein the control circuit is configured to cause the at least one light emitting diode to emit the defined lighting signal in response to an input from the input element.

5. The control body according to claim 2, wherein at least a portion of the elongated shell or the coupler is light transmissive, and wherein the at least one light emitting diode is positioned so that light from the at least one light emitting diode is visible through the at least a portion of the elongated shell or the coupler that is light transmissive.

6. The control body according to claim 2, wherein the at least one light emitting diode comprises a first light emitting diode and a second light emitting diode.

7. The control body according to claim 1, wherein the input element is at least partially light transmissive.

8. The control body according to claim 1, wherein the input element comprises a pushbutton.

9. The control body according to claim 1, wherein the electronic circuit board comprises a first end that is adjacent the coupler and a second end that is adjacent the electrical power source.

10. The control body according to claim 1, wherein the air inlet channel is formed entirely within the coupler.

11. The control body according to claim 1, wherein the coupler is configured to engage the cartridge in a press-fit engagement.

12. The control body according to claim 1, further comprising a haptic feedback component.

13. An electronic smoking article comprising a control body according claim 1 and a cartridge comprising an aerosol precursor composition and a heater adapted to vaporize the aerosol precursor composition when engaged with the control body.

14. An electronic smoking article comprising:

a control body that is defined by an elongated shell and that has a longitudinal axis extending through a center of the elongated shell;

an electrical power source positioned within the elongated shell;

an electronic circuit board positioned within the elongated shell so as to be oriented substantially parallel to the longitudinal axis of the elongated shell;

a coupler included in the elongated shell, the coupler having a connector end, a control body end, and a cavity accessible through the connector end, the body end being defined by a bottom wall extending internally toward the center of the elongated shell and that separates the cavity from an interior space in the control body;

a sensing component configured to detect an input from a user of the control body to thereby generate a signal that causes power to be directed from the electrical power source toward a heating component;

a plurality of light emitting diodes connected to the electronic circuit board and arranged so that light from the light emitting diodes is visible through a light transmitting portion of the elongated shell or the coupler;

an air inlet channel formed entirely within the coupler;

wherein, when a disposable cartridge comprising an aerosol precursor composition is inserted into the coupler in a press-fit engagement, provision of an input by a user to the sensing component is effective to cause heating and vaporization of at least a portion of the aerosol precursor composition in the disposable cartridge, and when the user thereafter draws on a mouthend of the disposable cartridge during the heating, ambient air is drawn through the air inlet channel and distributed into the cavity so as to enter a first end of the disposable cartridge, mix with the vaporized portion of the aerosol precursor composition, and exit an opposing, second end of the disposable cartridge as an aerosol, wherein one or more projection segments are arranged peripherally around the bottom wall and extending upward therefrom toward the cavity such that the cartridge is spaced apart from the bottom wall when the cartridge is engaged with the connector end of the coupler to distribute the drawn ambient air to the cavity.

15. The electronic smoking article according to claim 14, comprising a control circuit that is configured to cause the plurality of light emitting diodes to emit a defined lighting signal that corresponds to a status of the electronic smoking article.

16. The electronic smoking article according to claim 15, wherein the control circuit is configured to cause the plurality of light emitting diodes to emit the defined lighting signal in response to an input from an input element.

17. The electronic smoking article according to claim 14, wherein the electronic circuit board comprises a first end that is adjacent the coupler and a second end that is adjacent the electrical power source.

18. The electronic smoking article according to claim 14, further comprising a haptic feedback component.

* * * * *